US009039488B2

(12) United States Patent
Duescher

(10) Patent No.: US 9,039,488 B2
(45) Date of Patent: May 26, 2015

(54) PIN DRIVEN FLEXIBLE CHAMBER ABRADING WORKHOLDER

(71) Applicant: Wayne O. Duescher, Roseville, MN (US)

(72) Inventor: Wayne O. Duescher, Roseville, MN (US)

( * ) Notice: Subject to any disclaimer, the term of this patent is extended or adjusted under 35 U.S.C. 154(b) by 0 days.

(21) Appl. No.: 14/154,133

(22) Filed: Jan. 13, 2014

(65) Prior Publication Data

US 2014/0127976 A1 May 8, 2014

Related U.S. Application Data

(63) Continuation-in-part of application No. 14/148,729, filed on Jan. 7, 2014, which is a continuation-in-part of application No. 13/869,198, filed on Apr. 24, 2013, which is a continuation of application No. 13/662,863, filed on Oct. 29, 2012, now Pat. No. 8,845,394.

(51) Int. Cl.
*B24B 37/04* (2012.01)
*B24B 37/30* (2012.01)
*B24B 37/10* (2012.01)

(52) U.S. Cl.
CPC ..... *B24B 37/30* (2013.01); *B24B 37/042* (2013.01); *B24B 37/10* (2013.01)

(58) Field of Classification Search
CPC ..... B24B 37/042; B24B 37/30; B24B 37/04; B24B 37/26; B24B 37/24
USPC ..... 451/41, 285–290, 397–398
See application file for complete search history.

(56) References Cited

U.S. PATENT DOCUMENTS

| | | | | | |
|---|---|---|---|---|---|
| 1,799,332 | A | * | 4/1931 | Stevens | 15/97.1 |
| 4,593,495 | A | | 6/1986 | Kawakami et al. | |
| 4,918,870 | A | | 4/1990 | Torbert et al. | |
| 5,205,082 | A | | 4/1993 | Shendon et al. | |
| 5,364,655 | A | | 11/1994 | Nakamura et al. | |
| 5,365,700 | A | * | 11/1994 | Sawada et al. | 451/28 |
| 5,384,991 | A | * | 1/1995 | Lee | 451/57 |
| 5,421,768 | A | | 6/1995 | Fujiwara et al. | |
| 5,443,416 | A | | 8/1995 | Volodarsky et al. | |

(Continued)

OTHER PUBLICATIONS

Wayne O. Duescher, Three-point spindle-supported floating abrasive platen, U.S. Appl. No. 12/661,212, filed Mar. 12, 2010. Earliest Publication No. US 20110223835 A1 Earliest Publication Date: Sep. 15, 2011.

(Continued)

*Primary Examiner* — George Nguyen
(74) *Attorney, Agent, or Firm* — Mark A. Litman & Associates, P.A.

(57) ABSTRACT

Flat-surfaced workpieces such as semiconductor wafers or sapphire disks are attached to a rotatable floating workpiece holder carrier that is supported by a pressurized-air flexible elastomer sealed air-chamber device and is rotationally driven by a lug-pin device. The rotating wafer carrier rotor is restrained by a set of idlers that are attached to a stationary housing to provide rigid support against abrading forces. The abrading system can be operated at the very high abrading speeds used in high speed flat lapping with raised-island abrasive disks. The range of abrading pressures is large and the device can provide a wide range of torque to rotate the workholder. Vacuum can also be applied to the elastomer chamber to quickly move the wafer away from the abrading surface. Internal constraints limit the axial, lateral and circumferential motion of the workholder. Wafers can be quickly attached to the workpiece carrier with vacuum.

21 Claims, 34 Drawing Sheets

(56) References Cited

U.S. PATENT DOCUMENTS 5,569,062 A 10/1996 Karlsrud et al.
5,597,346 A 1/1997 Hempel, Jr.
5,643,053 A 7/1997 Shendon
5,643,067 A 7/1997 Katsuoka et al.
5,647,789 A * 7/1997 Kitta et al. ..... 451/41
5,681,215 A * 10/1997 Sherwood et al. ..... 451/388
5,683,289 A 11/1997 Hempel, Jr.
5,738,574 A 4/1998 Tolles et al.
5,769,697 A 6/1998 Nishio
5,795,215 A * 8/1998 Guthrie et al. ..... 451/286
5,800,254 A 9/1998 Motley et al.
5,851,140 A * 12/1998 Barns et al. ..... 451/288
5,860,853 A * 1/1999 Hasegawa et al. ..... 451/285
5,874,318 A 2/1999 Baker et al.
5,910,041 A 6/1999 Duescher
5,913,714 A * 6/1999 Volodarsky et al. ..... 451/41
5,913,718 A * 6/1999 Shendon ..... 451/288
5,916,009 A 6/1999 Izumi et al.
5,944,583 A 8/1999 Cruz et al.
5,964,651 A 10/1999 Hose
5,967,882 A 10/1999 Duescher
5,975,997 A 11/1999 Minami
5,985,093 A 11/1999 Chen
5,989,104 A 11/1999 Kim et al.
5,993,298 A 11/1999 Duescher
5,993,302 A 11/1999 Chen et al.
6,019,670 A * 2/2000 Cheng et al. ..... 451/56
6,027,398 A 2/2000 Numoto et al.
6,048,254 A 4/2000 Duescher
6,050,882 A 4/2000 Chen
6,056,632 A 5/2000 Mitchel et al.
6,066,030 A * 5/2000 Uzoh ..... 451/41
6,074,277 A 6/2000 Arai
6,080,050 A 6/2000 Chen et al.
6,083,090 A * 7/2000 Bamba ..... 451/288
6,089,959 A 7/2000 Nagahashi
6,093,088 A * 7/2000 Mitsuhashi et al. ..... 451/285
6,102,777 A * 8/2000 Duescher et al. ..... 451/36
6,113,468 A * 9/2000 Natalicio ..... 451/41
6,116,993 A 9/2000 Tanaka
6,120,352 A 9/2000 Duescher
6,126,993 A 10/2000 Orcel et al.
6,132,298 A 10/2000 Zuniga et al.
6,146,259 A 11/2000 Zuniga et al.
6,149,506 A * 11/2000 Duescher ..... 451/59
6,165,056 A 12/2000 Hayashi et al.
6,168,506 B1 1/2001 McJunken
6,179,956 B1 1/2001 Nagahara et al.
6,183,354 B1 2/2001 Zuniga et al.
6,196,903 B1 * 3/2001 Kimura ..... 451/285
6,217,411 B1 * 4/2001 Hiyama et al. ..... 451/8
6,217,433 B1 4/2001 Herrman et al.
6,251,215 B1 6/2001 Zuniga et al.
6,270,392 B1 8/2001 Hayashi et al.
6,299,741 B1 10/2001 Sun et al.
6,354,907 B1 * 3/2002 Satoh et al. ..... 451/5
6,361,420 B1 3/2002 Zuniga et al.
6,371,838 B1 4/2002 Holzapfel
6,390,901 B1 5/2002 Hiyama et al.
6,390,905 B1 5/2002 Korovin et al.
6,394,882 B1 5/2002 Chen
6,398,906 B1 6/2002 Kobayashi et al.
6,409,585 B1 * 6/2002 Oowada ..... 451/364
6,425,809 B1 7/2002 Ichimura et al.
6,436,828 B1 8/2002 Chen et al.
6,439,965 B1 8/2002 Ichino
6,443,821 B1 9/2002 Kimura et al.
6,447,368 B1 9/2002 Fruitman et al.
6,491,570 B1 12/2002 Sommer et al.
6,506,105 B1 1/2003 Kajiwara et al.
6,558,232 B1 5/2003 Kajiwara et al.
6,585,567 B1 7/2003 Black et al.
6,592,434 B1 7/2003 Vanell et al.
6,607,157 B1 * 8/2003 Duescher ..... 242/417.3
6,659,850 B2 12/2003 Korovin et al.
6,672,949 B2 1/2004 Chopra et al.
6,716,094 B2 * 4/2004 Shendon et al. ..... 451/288
6,722,962 B1 * 4/2004 Sato et al. ..... 451/259
6,729,944 B2 5/2004 Birang et al.
6,752,700 B2 6/2004 Duescher
6,761,618 B1 * 7/2004 Leigh et al. ..... 451/11
6,769,969 B1 8/2004 Duescher
6,805,613 B1 * 10/2004 Weldon et al. ..... 451/6
6,837,779 B2 1/2005 Smith et al.
6,893,332 B2 5/2005 Castor
6,896,584 B2 5/2005 Perlov et al.
6,899,603 B2 5/2005 Homma et al.
6,899,607 B2 5/2005 Brown
6,899,609 B2 5/2005 Hong
6,935,013 B1 8/2005 Markevitch et al.
7,001,251 B2 2/2006 Doan et al.
7,001,257 B2 2/2006 Chen et al.
7,008,303 B2 3/2006 White et al.
7,014,535 B2 3/2006 Custer et al.
7,018,906 B2 3/2006 Chen et al.
7,029,380 B2 4/2006 Horiguchi et al.
7,033,251 B2 4/2006 Elledge
7,044,838 B2 5/2006 Maloney et al.
7,081,042 B2 7/2006 Chen et al.
7,101,273 B2 9/2006 Tseng et al.
7,125,313 B2 10/2006 Zelenski et al.
7,144,304 B2 12/2006 Moore
7,147,541 B2 12/2006 Nagayama et al.
7,166,016 B1 1/2007 Chen
7,250,368 B2 7/2007 Kida et al.
7,276,446 B2 10/2007 Robinson et al.
7,292,427 B1 11/2007 Murdoch et al.
7,294,041 B1 * 11/2007 Lee et al. ..... 451/8
7,357,699 B2 4/2008 Togawa et al.
7,367,867 B2 5/2008 Boller
7,393,790 B2 7/2008 Britt et al.
7,419,910 B2 9/2008 Minamihaba et al.
7,422,634 B2 9/2008 Powell et al.
7,445,847 B2 11/2008 Kulp
7,446,018 B2 11/2008 Brogan et al.
7,452,817 B2 11/2008 Yoon et al.
7,456,106 B2 11/2008 Koyata et al.
7,456,107 B2 11/2008 Keleher et al.
7,470,169 B2 12/2008 Taniguchi et al.
7,485,028 B2 2/2009 Wilkinson et al.
7,485,241 B2 2/2009 Schroeder et al.
7,488,235 B2 2/2009 Park et al.
7,488,236 B2 2/2009 Shimomura et al.
7,488,240 B2 2/2009 Saito
7,491,116 B2 2/2009 Sung
7,491,342 B2 2/2009 Kamiyama et al.
7,507,148 B2 3/2009 Kitahashi et al.
7,510,974 B2 3/2009 Li et al.
7,520,798 B2 4/2009 Muldowney et al.
7,520,800 B2 4/2009 Duescher
7,527,271 B2 5/2009 Oh et al.
7,527,722 B2 5/2009 Sharan
7,553,214 B2 6/2009 Menk et al.
7,568,970 B2 8/2009 Wang
7,572,172 B2 8/2009 Aoyama et al.
7,579,071 B2 8/2009 Huh et al.
7,582,221 B2 9/2009 Netsu et al.
7,601,050 B2 10/2009 Zuniga et al.
7,614,939 B2 11/2009 Tolles et al.
7,618,529 B2 11/2009 Ameen et al.
7,632,434 B2 12/2009 Duescher
7,648,410 B2 1/2010 Choi
7,699,684 B2 4/2010 Prasad
7,708,621 B2 5/2010 Saito
7,731,568 B2 6/2010 Shimomura et al.
7,741,656 B2 6/2010 Nakayama et al.
7,753,761 B2 7/2010 Fujita
7,754,611 B2 7/2010 Chen et al.
7,762,870 B2 7/2010 Ono et al.
7,807,252 B2 10/2010 Hendron et al.
7,822,500 B2 10/2010 Kobayashi et al.
7,833,907 B2 11/2010 Anderson et al.
7,837,800 B2 11/2010 Fukasawa et al.
7,838,482 B2 11/2010 Fukasawa et al.

(56) References Cited

U.S. PATENT DOCUMENTS

| | | | | |
|---|---|---|---|---|
| 7,840,305 | B2 | 11/2010 | Behr et al. | |
| 7,883,397 | B2 | 2/2011 | Zuniga et al. | |
| 7,884,020 | B2 | 2/2011 | Hirabayashi et al. | |
| 7,897,250 | B2 | 3/2011 | Iwase et al. | |
| 7,922,783 | B2 | 4/2011 | Sakurai et al. | |
| 7,947,190 | B2 | 5/2011 | Brown | |
| 7,950,985 | B2 | 5/2011 | Zuniga et al. | |
| 7,955,964 | B2 | 6/2011 | Wu et al. | |
| 7,972,396 | B2 | 7/2011 | Feng et al. | |
| 8,002,860 | B2 | 8/2011 | Koyama et al. | |
| 8,021,215 | B2 | 9/2011 | Zuniga et al. | |
| 8,025,813 | B2 | 9/2011 | Liu et al. | |
| 8,029,640 | B2 | 10/2011 | Zuniga et al. | |
| 8,043,140 | B2 | 10/2011 | Fujita | |
| 8,047,899 | B2 | 11/2011 | Chen et al. | |
| 8,062,096 | B2 | 11/2011 | Brusic et al. | |
| 8,071,479 | B2 | 12/2011 | Liu | |
| 8,088,299 | B2 | 1/2012 | Chen et al. | |
| 8,101,060 | B2 | 1/2012 | Lee | |
| 8,101,093 | B2 | 1/2012 | De Rege et al. | |
| 8,845,394 | B2 * | 9/2014 | Duescher | 451/41 |
| 2001/0009843 | A1 * | 7/2001 | Hirokawa et al. | 451/160 |
| 2001/0011003 | A1 * | 8/2001 | Numoto | 451/379 |
| 2001/0034199 | A1 * | 10/2001 | Park | 451/287 |
| 2001/0041522 | A1 * | 11/2001 | Shendon et al. | 451/288 |
| 2001/0044268 | A1 * | 11/2001 | Shendon | 451/285 |
| 2002/0009958 | A1 * | 1/2002 | Gotcher | 451/288 |
| 2002/0033230 | A1 * | 3/2002 | Hayashi et al. | 156/345 |
| 2002/0173256 | A1 * | 11/2002 | Suwabe | 451/287 |
| 2003/0008600 | A1 * | 1/2003 | Ide | 451/41 |
| 2003/0008604 | A1 * | 1/2003 | Boo et al. | 451/388 |
| 2003/0129932 | A1 * | 7/2003 | Ficarro | 451/288 |
| 2005/0118939 | A1 | 6/2005 | Duescher | |
| 2007/0111641 | A1 * | 5/2007 | Lee et al. | 451/11 |
| 2008/0299875 | A1 | 12/2008 | Duescher | |
| 2010/0003904 | A1 | 1/2010 | Duescher | |
| 2011/0223835 | A1 | 9/2011 | Duescher | |
| 2011/0223836 | A1 | 9/2011 | Duescher | |
| 2011/0223838 | A1 | 9/2011 | Duescher | |
| 2014/0127976 | A1 * | 5/2014 | Duescher | 451/41 |

OTHER PUBLICATIONS

Wayne O. Duescher, Three-point fixed-spindle floating-platen abrasive system, U.S. Appl. No. 12/799,841, filed May 3, 2010. Earliest Publication No. US 20110223836 A1 Earliest Publication Date: Sep. 15, 2011.

Wayne O. Duescher, Fixed-spindle and floating-platen abrasive system using spherical mounts , U.S. Appl. No. 12/807,802, filed Sep. 14, 2010. Earliest Publication No. US 20110223838 A1 Earliest Publication Date: Sep. 15, 2011.

* cited by examiner

PIN DRIVEN FLEXIBLE CHAMBER ABRADING WORKHOLDER

CROSS REFERENCE TO RELATED APPLICATIONS

This invention is a continuation-in-part of U.S. patent application Ser. No. 14/148,729 filed Jan. 7, 2014 that is a continuation-in-part of U.S. patent application Ser. No. 13/869,198 filed Apr. 24, 2013 that is a continuation-in-part of U.S. patent application Ser. No. 13/662,863 filed Oct. 29, 2012. These are each incorporated herein by reference in their entirety.

BACKGROUND OF THE INVENTION

Field of the Invention

The present invention relates to the field of abrasive treatment of surfaces such as grinding, polishing and lapping. In particular, the present invention relates to a high speed semiconductor wafer or abrasive lapping workholder system for use with single-sided abrading machines that have rotary abrasive coated flat-surfaced platens. The slide-pin drive workholders employed here allow the workpiece substrates to be rotated at the same desired high rotation speeds as the platens. Often these platen and workholder speeds exceed 3,000 rpm to obtain abrading speeds of over 10,000 surface feet per minute (SFPM). Conventional wafer-polishing workholders are typically very limited in speeds and can not attain these rotational speeds that are required for high speed lapping and polishing. Even very thin and ultra-hard disks such as sapphire can be easily abraded and polished at very high production rates with this high speed abrading system especially when using diamond abrasives.

The slide-pin arm driven workholders having flexible elastomer or bellows chamber devices provide that a wide range of uniform abrading pressures can be applied across the full abraded surfaces of the workpieces such as semiconductor wafers. These slide-pin devices also allow the workholder carrier device to have a spherical-action rotation which provides flat-surfaced contact of workpieces that are attached to the workholder device with a flat-surfaced abrasive coating on a rotating abrading platen. One or more of the workholders can be used simultaneously with a rotary abrading platen.

High speed flat lapping is typically performed using flexible disks that have an annular band of abrasive-coated raised islands. These raised-island disks are attached to flat-surfaced platens that rotate at high abrading speeds. The use of the raised island disks prevent hydroplaning of the lapped workpieces when they are lapped at high speeds with the presence of coolant water. Hydroplaning causes the workpieces to tilt which results in non-flat lapped workpiece surfaces. Excess water is routed from contact with the workpiece flat surfaces into the recessed passageways that surround the abrasive coated raised island structures.

Flat lapping of workpiece surfaces used to produce precision-flat and mirror smooth polished surfaces is required for many high-value parts such as semiconductor wafer and rotary seals. The accuracy of the lapping or abrading process is constantly increased as the workpiece performance, or process requirements, become more demanding. Workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance.

The chemical mechanical planarization (CMP) liquid-slurry abrading system has been the system-of-choice for polishing semiconductor wafers that are already exceedingly flat. During CMP polishing, a very small amount of material is removed from the surface of the wafer. Typically the amount of material removed by polishing is measured in angstroms where the overall global flatness of the wafer is not affected much. It is critical that the global flatness of the wafer surface is maintained in a precision-flat condition to allow new patterned layers of metals and insulating oxides to be deposited on the wafer surfaces with the use of photolithography techniques. Global flatness is a measure of the flatness across the full surface of the wafer. Site or localized flatness of a wafer refers to the flatness of a localized portion of the wafer surface.

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800, commonly assigned U.S. patent application published numbers 20100003904; 20080299875 and 20050118939 and U.S. patent application Ser. Nos. 12/661,212, 12/799,841 and 12/807,802 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,425,809 (Ichimura et al) describes a semiconductor wafer polishing machine where a polishing pad is attached to a rigid rotary platen. The polishing pad is in abrading contact with flat-surfaced wafer-type workpieces that are attached to rotary workpiece holders. These workpiece holders have a spherical-action universal joint. The universal joint allows the workpieces to conform to the surface of the platen-mounted abrasive polishing pad as the platen rotates. However, the spherical-action device is the workpiece holder and is not the rotary platen that holds the fixed abrasive disk.

U.S. Pat. No. 6,769,969 (Duescher) describes flexible abrasive disks that have annular bands of abrasive coated raised islands. These disks use fixed-abrasive particles for high speed flat lapping as compared with other lapping systems that use loose-abrasive liquid slurries. The flexible raised island abrasive disks are attached to the surface of a rotary platen to abrasively lap the surfaces of workpieces.

U.S. Pat. No. 8,328,600 (Duescher) describes the use of spherical-action mounts for air bearing and conventional flat-surfaced abrasive-covered spindles used for abrading where the spindle flat surface can be easily aligned to be perpendicular to another device. Here, in the present invention, this type of air bearing and conventional flat-surfaced abrasive-covered spindles can be used where the spindle flat abrasive surface can be easily aligned to be perpendicular with the rotational axis of a floating bellows-type workholder device. This patent is incorporated herein by reference in its entirety.

Various abrading machines and abrading processes are described in U.S. Pat. No. 5,364,655 (Nakamura et al). U.S. Pat. No. 5,569,062 (Karlsrud), U.S. Pat. No. 5,643,067 (Katsuoka et al), U.S. Pat. No. 5,769,697 (Nisho), U.S. Pat. No. 5,800,254 (Motley et al), U.S. Pat. No. 5,916,009 (Izumi et al), U.S. Pat. No. 5,964,651 (hose), U.S. Pat. No. 5,975,997 (Minami, U.S. Pat. No. 5,989,104 (Kim et al), U.S. Pat. No. 6,089,959 (Nagahashi, U.S. Pat. No. 6,165,056 (Hayashi et al), U.S. Pat. No. 6,168,506 (McJunken), U.S. Pat. No. 6,217,433 (Herrman et al), U.S. Pat. No. 6,439,965 (Ichino), U.S. Pat. No. 6,893,332 (Castor), U.S. Pat. No. 6,896,584 (Perlov et al), U.S. Pat. No. 6,899,603 (Homma et al), U.S. Pat. No. 6,935,013 (Markevitch et al), U.S. Pat. No. 7,001,251 (Doan et al), U.S. Pat. No. 7,008,303 (White et al), U.S. Pat. No. 7,014,535 (Custer et al), U.S. Pat. No. 7,029,380 (Horiguchi et al), U.S. Pat. No. 7,033,251 (Elledge), U.S. Pat. No. 7,044,838 (Maloney et al), U.S. Pat. No. 7,125,313 (Zelenski et al), U.S. Pat. No. 7,144,304 (Moore), U.S. Pat. No. 7,147,541 (Nagayama et al), U.S. Pat. No. 7,166,016 (Chen), U.S. Pat. No. 7,250,368 (Kida et al), U.S. Pat. No. 7,367,867 (Boller), U.S. Pat. No. 7,393,790 (Britt et al), U.S. Pat. No. 7,422,634 (Powell et al), U.S. Pat. No. 7,446,018 (Brogan et al), U.S. Pat. No. 7,456,106 (Koyata et al), U.S. Pat. No. 7,470,169 (Taniguchi et al), U.S. Pat. No. 7,491,342 (Kamiyama et al), U.S. Pat. No. 7,507,148 (Kitahashi et al), U.S. Pat. No. 7,527,722 (Sharan) and U.S. Pat. No. 7,582,221 (Netsu et al).

Also, various CMP machines, resilient pads, materials and processes are described in U.S. Pat. No. 8,101,093 (de Rege Thesauro et al.), U.S. Pat. No. 8,101,060 (Lee), U.S. Pat. No. 8,071,479 (Liu), U.S. Pat. No. 8,062,096 (Brusic et al.), U.S. Pat. No. 8,047,899 (Chen et al.), U.S. Pat. No. 8,043,140 (Fujita), U.S. Pat. No. 8,025,813 (Liu et al.), U.S. Pat. No. 8,002,860 (Koyama et al.), U.S. Pat. No. 7,972,396 (Feng et al.), U.S. Pat. No. 7,955,964 (Wu et al.), U.S. Pat. No. 7,922,783 (Sakurai et al.), U.S. Pat. No. 7,897,250 (Iwase et al.), U.S. Pat. No. 7,884,020 (Hirabayashi et al.), U.S. Pat. No. 7,840,305 (Behr et al.), U.S. Pat. No. 7,838,482 (Fukasawa et al.), U.S. Pat. No. 7,837,800 (Fukasawa et al.), U.S. Pat. No. 7,833,907 (Anderson et al.), U.S. Pat. No. 7,822,500 (Kobayashi et al.), U.S. Pat. No. 7,807,252 (Hendron et al.), U.S. Pat. No. 7,762,870 (Ono et al.), U.S. Pat. No. 7,754,611 (Chen et al.), U.S. Pat. No. 7,753,761 (Fujita), U.S. Pat. No. 7,741,656 (Nakayama et al.), U.S. Pat. No. 7,731,568 (Shimomura et al.), U.S. Pat. No. 7,708,621 (Saito), U.S. Pat. No. 7,699,684 (Prasad), U.S. Pat. No. 7,648,410 (Choi), U.S. Pat. No. 7,618,529 (Ameen et al.), U.S. Pat. No. 7,579,071 (Huh et al.), U.S. Pat. No. 7,572,172 (Aoyama et al.), U.S. Pat. No. 7,568,970 (Wang), U.S. Pat. No. 7,553,214 (Menk et al.), U.S. Pat. No. 7,520,798 (Muldowney), U.S. Pat. No. 7,510,974 (Li et al.), U.S. Pat. No. 7,491,116 (Sung), U.S. Pat. No. 7,488,236 (Shimomura et al.), U.S. Pat. No. 7,488,240 (Saito), U.S. Pat. No. 7,488,235 (Park et al.), U.S. Pat. No. 7,485,241 (Schroeder et al.), U.S. Pat. No. 7,485,028 (Wilkinson et al), U.S. Pat. No. 7,456,107 (Keleher et al.), U.S. Pat. No. 7,452,817 (Yoon et al.), U.S. Pat. No. 7,445,847 (Kulp), U.S. Pat. No. 7,419,910 (Minamihaba et al.), U.S. Pat. No. 7,018,906 (Chen et al.), U.S. Pat. No. 6,899,609 (Hong), U.S. Pat. No. 6,729,944 (Birang et al.), U.S. Pat. No. 6,672,949 (Chopra et al.), U.S. Pat. No. 6,585,567 (Black et al.), U.S. Pat. No. 6,270,392 (Hayashi et al.), U.S. Pat. No. 6,165,056 (Hayashi et al.), U.S. Pat. No. 6,116,993 (Tanaka), U.S. Pat. No. 6,074,277 (Arai), U.S. Pat. No. 6,027,398 (Numoto et al.), U.S. Pat. No. 5,985,093 (Chen), U.S. Pat. No. 5,944,583 (Cruz et al.), U.S. Pat. No. 5,874,318 (Baker et al.), U.S. Pat. No. 5,683,289 (Hempel Jr.), U.S. Pat. No. 5,643,053 (Shendon),), U.S. Pat. No. 5,597,346 (Hempel Jr.).

Other wafer carrier heads are described in U.S. Pat. No. 5,421,768 (Fujiwara et al.), U.S. Pat. No. 5,443,416 (Volodarsky et al.), U.S. Pat. No. 5,738,574 (Tolles et al.), U.S. Pat. No. 5,993,302 (Chen et al.), U.S. Pat. No. 6,050,882 (Chen), U.S. Pat. No. 6,056,632 (Mitchel et al.), U.S. Pat. No. 6,080,050 (Chen et al.), U.S. Pat. No. 6,126,116 (Zuniga et al.), U.S. Pat. No. 6,132,298 (Zuniga et al.), U.S. Pat. No. 6,146,259 (Zuniga et al.), U.S. Pat. No. 6,179,956 (Nagahara et al.), U.S. Pat. No. 6,183,354 (Zuniga et al.), U.S. Pat. No. 6,251,215 (Zuniga et al.), U.S. Pat. No. 6,299,741 (Sun et al.), U.S. Pat. No. 6,361,420 (Zuniga et al.), U.S. Pat. No. 6,390,901 (Hiyama et al.), U.S. Pat. No. 6,390,905 (Korovin et al.), U.S. Pat. No. 6,394,882 (Chen), U.S. Pat. No. 6,436,828 (Chen et al.), U.S. Pat. No. 6,443,821 (Kimura et al.), U.S. Pat. No. 6,447,368 (Fruitman et al.), U.S. Pat. No. 6,491,570 (Sommer et al.), U.S. Pat. No. 6,506,105 (Kajiwara et al.), U.S. Pat. No. 6,558,232 (Kajiwara et al.), U.S. Pat. No. 6,592,434 (Vanell et al.), U.S. Pat. No. 6,659,850 (Korovin et al.), U.S. Pat. No. 6,837,779 (Smith et al.), U.S. Pat. No. 6,899,607 (Brown), U.S. Pat. No. 7,001,257 (Chen et al.), U.S. Pat. No. 7,081,042 (Chen et al.), U.S. Pat. No. 7,101,273 (Tseng et al.), U.S. Pat. No. 7,292,427 (Murdock et al.), U.S. Pat. No. 7,527,271 (Oh et al.), U.S. Pat. No. 7,601,050 (Zuniga et al.), U.S. Pat. No. 7,883,397 (Zuniga et al.), U.S. Pat. No. 7,947,190 (Brown), U.S. Pat. No. 7,950,985 (Zuniga et al.), U.S. Pat. No. 8,021,215 (Zuniga et al.), U.S. Pat. No. 8,029,640 (Zuniga et al.), U.S. Pat. No. 8,088,299 (Chen et al.), All references cited herein are incorporated herein in the entirety by reference.

SUMMARY OF THE INVENTION

The presently disclosed technology includes precision-thickness flexible abrasive disks having disk thickness variations of less than 0.0001 inches (3 microns) across the full annular bands of abrasive-coated raised islands to allow flat-surfaced contact with workpieces at very high abrading speeds. Use of a rotary platen vacuum flexible abrasive disk attachment system allows quick set-up changes where different sizes of abrasive particles and different types of abrasive material can be quickly attached to the flat platen surfaces.

Semiconductor wafers require extremely flat surfaces when using photolithography to deposit patterns of materials to form circuits across the full flat surface of a wafer. When theses wafers are abrasively polished between deposition steps, the surfaces of the wafers must remain precisely flat.

Water coolant is used with these raised island abrasive disks, which allows them to be used at very high abrading speeds, often in excess of 10,000 SFPM (160 km per minute). The same types of chemicals that are used in the conventional CMP polishing of wafers can be used with this abrasive lapping or polishing system. These liquid chemicals can be applied as a mixture with the coolant water that is used to cool both the wafers and the fixed abrasive coatings on the rotating abrading platen This mixture of coolant water and chemicals continually washes the abrading debris away from the abrading surfaces of the fixed-abrasive coated raised islands which prevents unwanted abrading contact of the abrasive debris with the abraded surfaces of the wafers.

Slurry lapping is often done at very slow abrading speeds of about 5 mph (8 kph). By comparison, the high speed flat lapping system often operates at or above 100 mph (160 kph). This is a speed difference ratio of 20 to 1. Increasing abrading speeds increase the material removal rates. High abrading speeds result in high workpiece production rates and large cost savings.

Workpieces are often rotated at rotational speeds that are approximately equal to the rotational speeds of the platens to provide equally-localized abrading speeds across the full radial width of the platen annular abrasive when the workpiece spindles are rotated in the same rotation direction as the platens. Often these platen and workholder rotational speeds exceed 3,000 rpm. Typically, conventional spherical-action types of workholders are used to provide flat-surfaced contact of workpieces with a flat-surfaced abrasive covered platen that rotates at very high speeds. In addition, the abrading friction forces that are applied to the workpieces by the moving abrasive tend to tilt the workpieces that are attached to the offset workholders. Tilting causes non-flat abraded workpiece surfaces.

Also, these conventional rotating offset spherical-action workholders are nominally unstable at very high rotation speeds, especially when the workpieces are not held firmly in direct flat-surfaced contact with the platen abrading surface. It is necessary to provide controlled operation of these unstable spherical-action workholders to prevent unwanted vibration or oscillation of the workholders (and workpieces) at very high rotational speeds of the workholders. Vibrations of the workholders can produce patterns of uneven surface wear of an expensive semiconductor wafer.

The present system provides friction-free and vibrationally stable rotation of the workpieces without the use of offset spherical-action universal joint rotation devices. Tilting of the workpieces dos not occur because the offset spherical-action universal joint rotation devices are not used. Uniform abrading pressures are applied across the full abraded surfaces of the workpieces such as semiconductor wafers by the air bearing workholders. Also, one or more of the workholders can be used simultaneously with a rotary abrading platen.

The slide-pin arm driven workholders having flexible elastomer or bellows chamber devices provide that a wide range of uniform abrading pressures can be applied across the full abraded surfaces of the workpieces such as semiconductor wafers.

These slide-pin devices also allow the workholder device to have a spherical-action rotation which provides flat-surfaced contact of workpieces that are attached to the workholder device with a flat-surfaced abrasive coating on a rotating abrading platen. The circular shaped workholder is supported by a set of stationary but rotatable idler bearings that contact the outer periphery of the workholder at selected locations around the circumference of the workholder. The abrading friction forces that are applied to the workpieces and thus to the free-floating workholder by abrading contact with the rotating abrasive platen are resisted by the workholder bearing idlers. These idlers maintain the circular workholder in a position that is concentric with the axis of the workholder drive shaft during the abrading action as the abrasive platen is rotated. One or more of the workholders can be used simultaneously with a rotary abrading platen.

Conventional flexible elastomeric pneumatic-chamber wafer carrier heads have a substantial disadvantage in that the vertical walls of the elastomeric chambers are very weak in a lateral or horizontal direction. The abrading pressures and vacuum that are applied to these sealed chambers are typically very small, in part, to avoid very substantial lateral deflections of the elastomer walls. The sealed abrading-chamber wire-reinforced elastomeric annular tubes described here are flexible axially along the length of the tubes which allows axial motion of the workholder. The wire reinforcements provide radial stiffness of the elastomer tubes to resist substantial lateral distortion of the walls which allows the use of high chamber abrading pressures and high levels of vacuum.

DETAILED DESCRIPTION OF THE INVENTION

Figure 1:
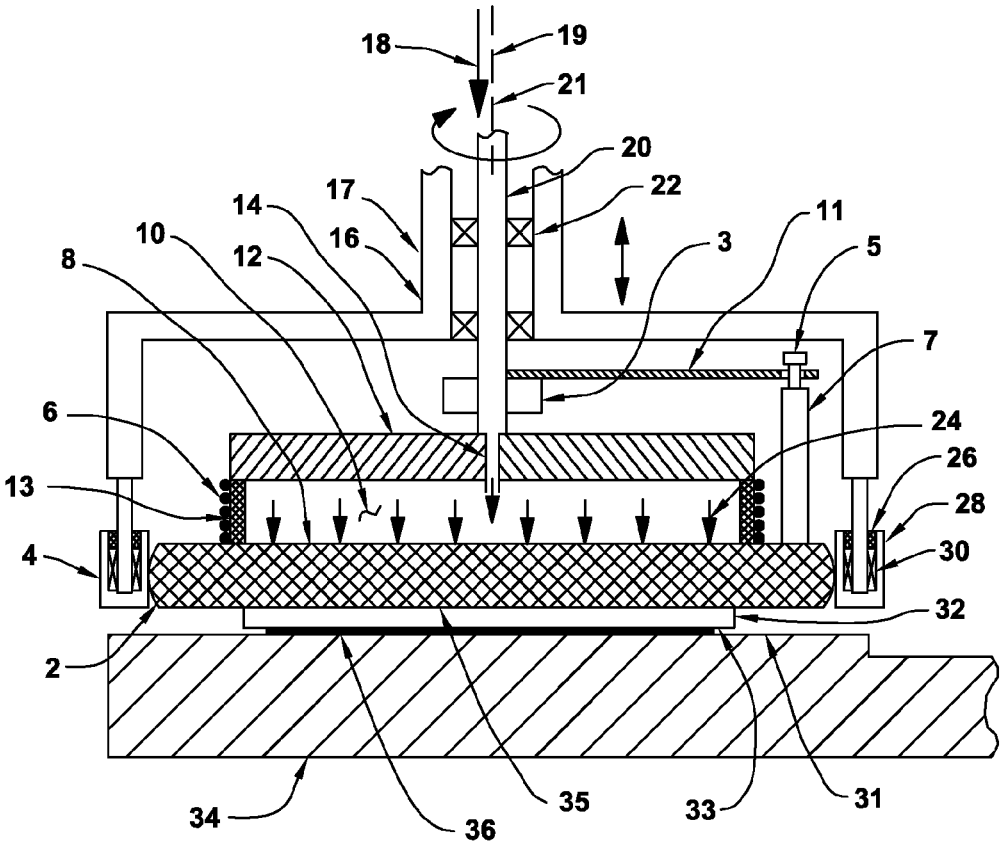
FIG. 1 is a cross section view of a pin rotational driven wafer polishing workpiece carrier.

FIG. 1 is a cross section view of a sliding-contact drive-pin rotationally driven floating workpiece carrier used for lapping or polishing semiconductor wafers or other workpiece substrates. A stationary workpiece carrier head 17 has a flat-surfaced workpiece 32 that is attached to a floating workpiece carrier rotor 35 that is rotationally driven by a drive-pin device 5. A nominally-horizontal drive plate 12 is attached to a hollow drive shaft 20 having a rotation axis 19 that is supported by bearings 22 that are supported by a stationary carrier housing 16 where the carrier housing 16 can be raised and lowered in a vertical direction.

A nominally-rigid rotational drive arm 11 is attached to the hollow drive shaft 20 where rotation of the hollow drive shaft 20 rotates the rotational drive arm 11. The drive-pin device 5 is attached a rigid annular member 7 or multiple individual posts 7 that is/are attached to the workpiece carrier rotor 35 which allows the drive-pin device 5 to rotationally drive the workpiece carrier rotor 35. The workpiece carrier rotor 35 has an outer periphery 2 that has a spherical shape which allows the workpiece carrier rotor 35 outer periphery 2 to remain in contact with stationary rotatable roller idlers 28 when the rotating carrier rotor 35 is tilted.

The workpiece carrier rotor 35 has a rotation axis 21 that is coincident or near-coincident with the hollow drive shaft 20 rotation axis 19 to avoid interference action of the workpiece carrier rotor 35 with the hollow drive shaft 20 when the hollow drive shaft 20 is rotated. The workpiece 32 carrier rotor 35 rotation axis 21 is positioned to be coincident or near-coincident with the hollow drive shaft 20 rotation axis 19 by the controlled location of the stationary roller idlers 28 that are mounted to the stationary workpiece carrier head 17. Rolling contact of the workpiece carrier rotor 35 outer periphery 2 with the set of stationary roller idlers 28 that are precisely located at prescribed positions assures that the workpiece carrier rotor 35 rotation axis 21 is coincident or near-coincident with the hollow drive shaft 20 rotation axis 19. The stationary roller idlers 28 are mounted at positions on the carrier housing 16 where the diameters of the stationary roller idlers 28 and the diameters of the respective workpiece carrier rotors 35 are selected to provide that the workpiece carrier rotor 35 rotation axis 21 is coincident or near-coincident with the hollow drive shaft 20 rotation axis 19.

An annular flexible elastomer tube-section device 13 that is attached to the drive plate 12 is also attached to the workpiece carrier rotor 35 which flexes in a direction parallel to the workpiece carrier rotor 35 rotation axis 21 or drive shaft 20 rotation axis 19. Here, the elastomer tube-section device 13 allows the workpiece carrier rotor 35 to be translated vertically along the workpiece carrier rotor 35 rotation axis 21

If the workpiece carrier rotor 35 rotation axis 21 is positioned to be offset a small distance from the hollow drive shaft 20 rotation axis 19 then the flexible elastomer tube-section device 13 that is attached to both the workpiece carrier rotor 35 and to the drive plate 12 that is attached to the hollow drive shaft 20 will experience a small lateral distortion in a horizontal direction. Also, horizontal translation of the drive-pin device 5 will occur if the workpiece carrier rotor 35 rotation axis 21 is positioned to be offset a small distance from the hollow drive shaft 20 rotation axis 19.

The roller idlers 28 can have a cylindrical peripheral surface 4 or other surface shapes including a "spherical" hourglass type shape and can have low-friction roller bearings 30 or air bearings 30 and roller idler 28 seals 26 shape and can have low-friction roller bearings 30 or air bearings 30 and roller idler 28 seals 26. The roller idler 28 seals 26 prevent contamination of the low-friction roller bearings 30 or air bearings 30 by abrading debris or coolant water or other fluids or materials that are used in the abrading procedures. The air bearings 30 can provide zero friction and can rotate at very high speeds when the workpiece carrier rotor 35 is rotated at speeds of 3,000 rpm or more that are typically used in high speed flat lapping. Because the diameters of the roller idlers 28 are typically much smaller than the diameters of the workpiece carrier rotors 35 the roller idlers 28 typically have rotational speeds that are much greater than the rotational speeds of the workpiece carrier rotors 35.

Pressurized air or another fluid such as water 18 is supplied through the hollow drive shaft 20 that has a fluid passage 14 that allows pressurized air or another fluid such as water 18 to fill the sealed chamber 10 that is formed by the sealed annular flexible elastomer tube-section device 13. This controlled fluid 18 pressure is present in the sealed chamber 10 to provide uniform abrading pressure 24 across the full flat top surface 8 of the carrier rotor 35 where uniform abrading pressure 24 pressure is directly transferred to the workpiece 32 abraded surface 33 that is in abrading contact with the abrasive 36 coating on the rotary platen 34. When the sealed chamber 10 is pressurized by a fluid, the sealed annular flexible elastomer tube-section device 13 can tend to expand radially in a horizontal direction.

Radial expansion of the annular flexible elastomer tube-section device 13 is limited by flexible cords or woven threads 6 that are wound around the outer periphery of the sealed annular flexible elastomer tube-section device 13 to provide hoop-strength to the elastomer tube-section device 13. These radially-rigid flexible metal wires or polymer or natural material cords or woven threads 6 can have high tensile strengths and can be very stiff along the axis of the cords to minimize the stretching of the cords 6 and bulging of the annular flexible elastomer tube-section device 13 when pressure is applied to the sealed chamber 10. These cords 6 can be wound in a serpentine pattern in a single cord 6 layer to provide radial strengthening of the elastomer tube-section device 13 but allow free low-friction expansion and contraction of localized portions of the elastomer tube-section device 13 in a direction nominally along the workpiece 32 carrier rotor 35 rotation axis 21. The cords or wires 6 can range in diameter from 0.001 to 0.125 inches (0.0025 to 0.317 cm) or more and they can be attached to the annular flexible elastomer tube-section device 13 with adhesives or they can be imbedded in the annular wall of the flexible elastomer tube-section device 13.

The workpiece carrier rotor 35 and the flat-surfaced workpiece 32 such as a semiconductor wafer is allowed to be tilted from a horizontal position when they are stationary or rotated by the flexing action provided by the elastomer tube-section device 13 and vertical translation of the drive-pin device. The workpiece carrier rotor 35 can be operated at very high rotational speeds. The drive-pin device 5 can constructed from metals or corrosion-resistant metals such as stainless steel or from polymers.

When the flat-surfaced workpieces 32 and the workpiece carrier rotor 35 are subjected to abrading friction forces that are parallel to the abraded surface 33 of the workpieces 32, these abrading friction forces are resisted by the workpiece carrier rotor 35 as it contacts the multiple idlers 28 that are located around the outer periphery of the workpiece carrier rotor 35. The circular drive plate 12 has an outer periphery 2 spherical shape which allows the workpiece carrier rotor 35 outer periphery 2 to remain in contact with the cylindrical-surfaced roller idlers 28 when the rotating carrier rotor 35 is tilted where the stationary-position surfaced roller idlers 28 that are spaced around the outer periphery of the workpiece carrier rotor 35 act together as a centering device that controls the center of rotation of the workpiece carrier rotor 35 as it rotates.

The circular drive plate 12 outer periphery 2 spherical shape provides that the center of rotation of the workpiece carrier rotor 35 remains aligned with the rotational axis of drive shaft 20 when the workpiece carrier rotor 35 is tilted as it rotates. The workpiece carrier rotor 35 can be tilted due to numerous causes including: flat-surfaced workpiece 32 that have non-parallel opposed surfaces; misalignment of components of the stationary workpiece carrier head 17; misalignment of other components of the abrading machine (not shown); a platen 34 that has an abrading surface 31 that is not flat.

The rigid member 7 is attached to the at least one individual drive-pin device 5 that are in sliding contact with a radial bar 11 that is attached to the drive shaft 20 hub 3 where the nominally-rigid member 11 is attached to the carrier rotor 35 and where the at least one individual drive-pin device 5 and the radial bar 11 are used to rotate the carrier rotor 35.

The at least one individual drive-pin device 5 and the radial bar 11 are selected to provide substantial tangential torque forces to rotationally drive the carrier rotor 35. The vertical and horizontal sliding action between the sliding-contact drive-pin device 5 and the radial bar 11 provide motion of the workpiece carrier rotor 35 in a direction along the workpiece carrier rotor 35 rotation axis 21 to allow the workpiece rotor 35 to be translated along the workpiece carrier rotor 35 rotation axis 21 as changes in the air or fluid pressure 18 pressure 24 present in the sealed chamber 10 causes motion of the workpiece rotor 35.

The elastomer tube-section device 13 forms a sealed chamber 10 that allows pressurized air or another fluid such as water 18 to fill the sealed chamber 10 to provide controlled abrading pressure to be applied to the workpiece 32 abraded surface 33 that is in abrading contact with the abrasive 36 coating on the rotary platen 34. The elastomer tube-section device 13 does not provide the primary drive torque to rotate the workpiece carrier rotor 35 as this workpiece carrier rotor 35 rotation drive, acceleration or stopping torque is provided by the drive-pin device 5. The sealed flexible elastomer tube-section device 13 can be replaced by a sealed flexible bellows-type device (not shown) that provides flexing in a direction along the rotational axis 21 of the workpiece carrier rotor 35.

Figure 2:
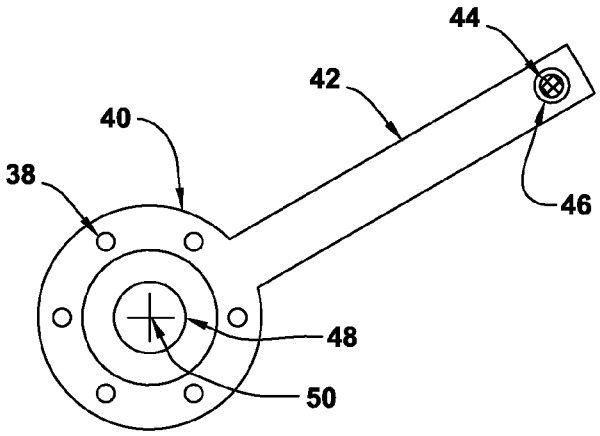
FIG. 2 is a top view of a pin-bracket floating workpiece carrier drive device.

FIG. 2 is a top view of a pin-bracket floating workpiece carrier drive device. A nominally-rigid rotational pin bracket 40 configuration shown here has an extended arm 42 that has a distal end that is in sliding contact with a drive pin 44 where the arm 42 has a pin access hole 46. The pin bracket 40 is shown with attachment bolt holes 38 to attach it to a workpiece carrier hub (not shown) that is attached to a rotatable spindle shaft 48. The pin bracket 40 is rotated about the pin bracket 40 rotation axis 50 to transmit the drive torque force loads from the pin bracket 40 to the drive pins 44 that are required to rotate the workpiece carrier rotor (not shown) during abrading operations. Other configurations of the pin bracket 40 include brackets that have hub shapes rather than arms 42 where single or multiple pins 44 can be contacted by at least one pin bracket 40.

Figure 3:
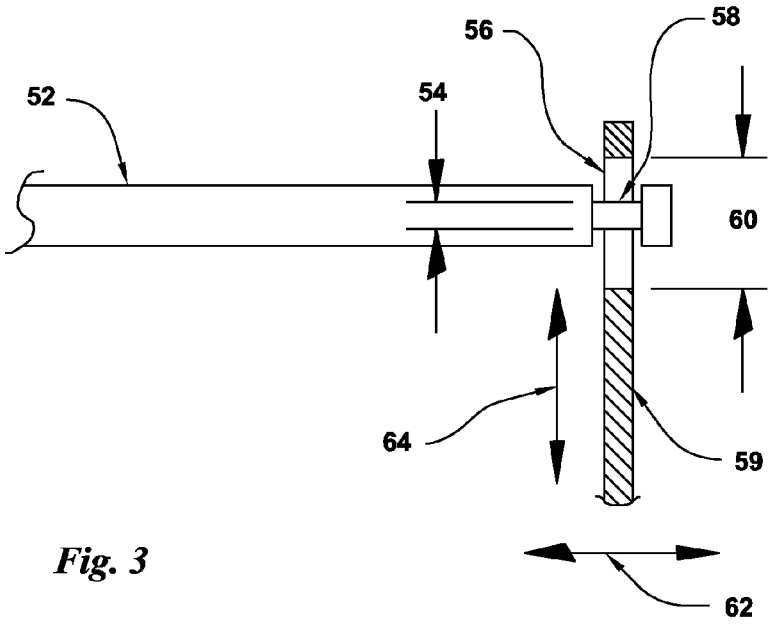
FIG. 3 is a cross section view of a slide-pin driven floating workpiece carrier rotation device.

FIG. 3 is a cross section view of a slide-pin driven floating workpiece carrier rotation device. A rotary carrier leg 52 is attached on one end to a rotatable spindle shaft (not shown) has a slideable pin 58 attached at the opposite end of the carrier leg 52 where the pin 58 has a diameter 54 that is smaller than the width (not shown) of the narrow slot 56 in a rotary arm 59 that captures the pin 58. The rotary arm 59 is attached to workpiece carrier plate (not shown). The pin 58 is in sliding contact with the rotary arm 59 where the rotary arm 59 transmits rotational forces from the spindle shaft to the pin 58 that rotate the workpiece carrier in both clockwise and counterclockwise directions to accelerate and decelerate the workpiece carrier. The pin 58 slides within the rotary arm 59 slot 56 having a vertical slot length 60 in a vertical direction 64 and also slides within the rotary arm 59 slot 56 in a horizontal direction 62.

Figure 4:
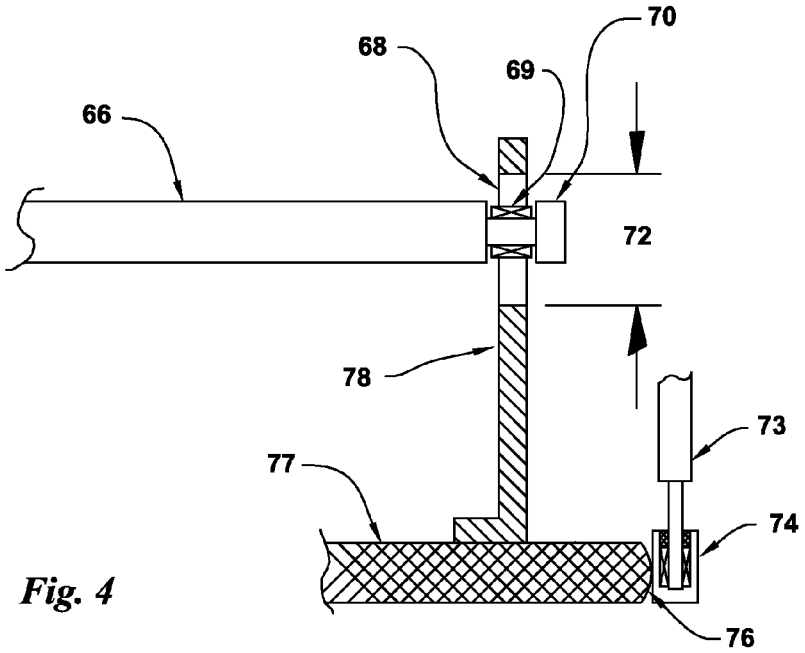
FIG. 4 is a cross section view of a slide-pin driven floating carrier constrained with idlers.

FIG. 4 is a cross section view of a slide-pin driven floating carrier constrained with idlers. A rotary carrier leg 66 that is attached on one end to a rotatable spindle shaft (not shown) has a slideable pin 70 attached at the opposite end of the carrier leg 66 where the pin 70 has a diameter that is smaller than the width (not shown) of the narrow slot 68 in a rotary arm 78 that captures the pin 70. The rotary arm 78 is attached to a workpiece carrier plate 77. The pin 70 shaft is shown with a rotary bearing 69 which is in sliding contact with the rotary arm 78 where the rotary arm 78 transmits rotational forces to the pin 70 through the bearing 69 to rotate the workpiece carrier 77 in both clockwise and counterclockwise directions to accelerate and decelerate the workpiece carrier 77.

The pin 70 and bearing 69 slide within the slot 68 having a vertical slot length 72 in a vertical direction within the vertical slot 68 in the rotary arm 78 and also slides within the slot 68 in a horizontal direction. The bearing 69 is mounted on the pin 70 to reduce the sliding friction between the pin 70 and the rotary arm 78 that is attached to the workpiece carrier plate 77. The bearing 69 can be a small-diameter needle bearing, a roller bearing or a sleeve-type bearing. The circular workpiece carrier plate 77 has a spherical surface 76 that is contacted by rotary bearing idlers 74 that are supported by idler shafts 73.

The idlers 74 are shown with cylindrical surfaces that are in rotating contact with a spherical-shaped 76 outer annular periphery of the circular workpiece carrier plate 77. In another embodiment, the idlers 74 can have spherical surface shapes and the circular workpiece carrier plate 77 can have an annular cylindrical shape where the circular workpiece carrier plate 77 can pivot or be tilted while it maintains running-contact with the idlers 74.

Figure 5:
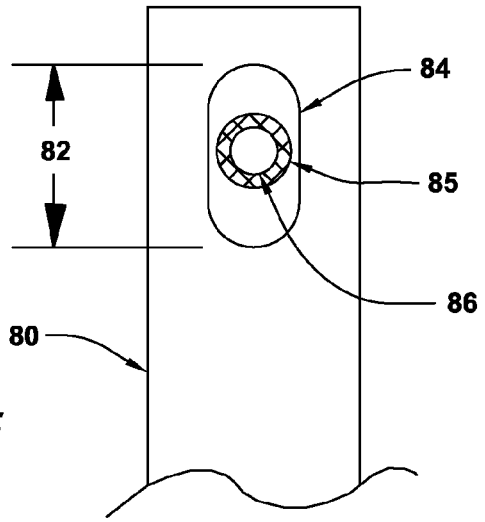
FIG. 5 is a cross section view of a bearing-type slide-pin floating carrier drive.

FIG. 5 is a cross section view of a bearing-type slide-pin floating carrier drive. A rotary carrier leg (not shown) that is attached on one end to a rotatable spindle shaft (not shown) has a slide pin 86 attached at the opposite end of the carrier leg where the slide pin 86 has a concentric rotary bearing 85 which is in sliding contact with a slot 84 in the vertical rotary arm 80. The rotary carrier leg transmits rotational forces to the pin 86 through the bearing 85 and to the vertical rotary arm 80 to rotate a workpiece carrier (not shown) in both clockwise and counterclockwise directions to accelerate and decelerate the workpiece carrier. The rotary bearing 85 is contained within the vertical slot 84 in the nominally-vertical rotary arm 80. Also, in other embodiments, the relative orientation and the locations of the rotary arm 80, the slide pin 86 and the rotary carrier leg can be changed from that shown in this figure and from that as shown in the other associated figures.

Figure 6:
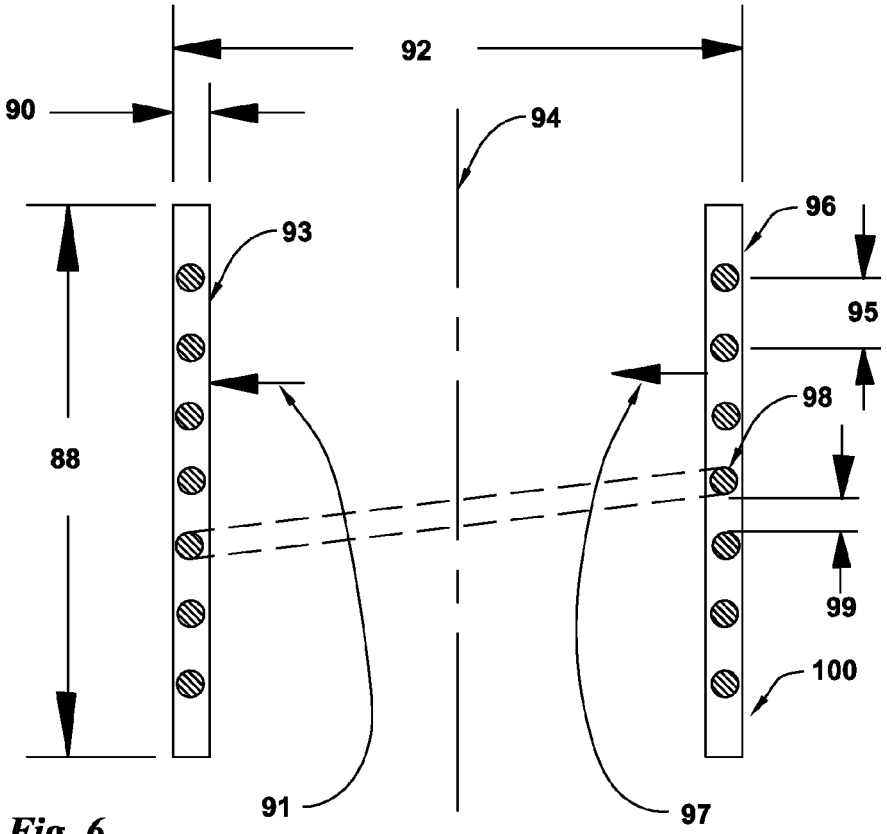
FIG. 6 is a cross section view of a flexible coiled-wire sealed elastomeric tube section.

FIG. 6 is a cross section view of a sealed flexible coiled-wire reinforced elastomeric tube section that is flexible along the axis of the tube but is stiff radially. In one embodiment of a flexible elastomer tube 96, a spring-type single-strand radially-rigid coiled-wire 98 is imbedded in the tube 96 elastomer wall 93 wall material 100. The coiled wire 98 flexes readily along the longitudinal axis 94 of the tube 96 along with the flexible elastomeric material 100 to provide a desirable low flexural spring constant and low flexing forces along the axis 94 of the tube 96. However, the coiled wire 98 provides substantial radial stiffness to the tube 96 as the inner wall 93 of the tube is subjected to internal pressure positive forces 91 or vacuum negative-pressure forces 97. A positive internal pressure force 91 will tend to make the elastomer tube wall 93 to bulge radially outward from the tube axis 94 and a vacuum negative-pressure force 97 will tend to make the tube 96 wall 93 to collapse inwardly toward the tube axis 94, both of which are undesirable for this system.

The elastomer wall material 100 typically has a very low modulus of elasticity compared to typical materials of construction such as metals or engineering-type polymers which provides the desired low-force elasticity when the elastomer wall 93 is stretched or compressed along the elastomer tube axis 94. However, this same low modulus of elasticity tends to allow the elastomer wall 93 to bulge substantially radially outward when the pressure-sealed flexible elastomer tube 96 is subjected to an internal pressure force 9. Here, a vacuum negative-pressure force 97 which will tend to make the tube 96 wall 93 to substantially collapse inwardly. Radial deflection or distortion of the elastomer wall 93 is highly undesirable in a workpiece abrasive polishing head (not shown) because the radially-distorted elastomeric tube 96 wall 93 can contact other adjacent polishing head components and impede their functional operations.

Use of the radial stiffness of the coiled wire 98 which is attached integrally to the flexible elastomer tube 96 wall 93 reinforces the flexible elastomer tube 96 wall 93 which minimizes the radial deflection of the flexible elastomer tube 96 wall 93 when the elastomer tube 96 wall 93 is subjected to an internal pressure force 91 or a vacuum negative-pressure force 97. However, even though the coiled wire 98 provides substantial stiffness to the flexible elastomer tube 96 wall 93 in a radial direction, the coiled wire 98 is very flexible in a direction along the axis 94 of the tube 96 and allows the flexible elastomer tube 96 wall 93 to flex with low flexural forces along the axis 94 of the tube 96.

Other flexible sealed pressurized air-chamber rotating workpiece head systems that are typically used for abrasive polishing of semiconductor wafers can only be subjected to very small pressures of typically less than 3 psi because, in part, of the large distortions of their flexible elastomeric membranes which are used to apply abrading pressures to workpieces that are attached to the chamber-membrane exterior flat workpiece mounting surfaces. Large abrading pressures tend to bulge these flexible sealed elastomer chamber walls outward where they can contact other component members of the wafer polishing heads. Likewise, vacuum negative pressures of greater than 3 psi (out of a possible vacuum of 14.7 psi) will tend to collapse the flexible elastomer chamber walls inward.

It is very desirable to have abrading pressures and vacuum negative pressures that exceed this 3 psi value for effective abrading, lapping and polishing of workpieces including semiconductor wafers. Use of the coiled-wire 98 (or other configuration) reinforced elastomeric tubing 96 allows these higher pressures and vacuum to be used while retaining the ability of the elastomeric tube to be flex with desirable low spring constants along the longitudinal axis 94 of the tubes.

The coiled wire 98 is shown here as a serpentine-wound single strand of wire that has a coil shape such as an extension-spring or a compression-spring. The cross sectional shape of the coiled wire 98 can be circular, square, rectangular, oval or other shapes such as U-shaped. The wire 98 construction materials include steel, stainless steel, other metals, carbon, carbon fiber, natural material, polymers, composite materials, adhesive-impregnated fibers and ceramics. The wire coils 98 can also have the shape of non-serpentine-wound single continuous-hoops or rings of wire materials (not shown) that are sequentially spaced along the axis 94 of the tube 96. The diameter 92 of flexible elastomer tube 96 can have a range of sizes from 0.5 inches to 40 inches (1.27 to 102 cm) or more, depending on the size of the abrading system (not shown) they are used on.

The wall thickness 90 of the reinforced elastomeric tubing 96 can range from 0.003 to 0.375 inches (0.007 to 0.952 cm) or more and the length 88 of the elastomeric tubing 96 can range from 0.25 to 10.0 inches (0.63 to 25.4) or more. The elastomeric wall material 100 used to construct the elastomeric tubing 96 comprises silicone rubber, room temperature vulcanizing (RTV) silicone rubber, natural rubber, synthetic rubber, polyurethane and polymers. The wire coils 98 or wire rings (not shown) can be molded into the body of the elastomeric tube 96 or they can be made an integral part of the elastomeric tube 96 by laminating the wire coils 98 between two or more layers of the elastomeric wall material 100 or the wire coils 98 can be attached with adhesives to the elastomeric wall material 100 or the elastomeric wall material 100 can be deposited on or coated on the wire coils 98 or wire rings.

The distances 95 along the longitudinal axis 94 of the tube 96 between individual adjacent radially-stiff coils or rings of wire 98 is selected to correspond with the free-span distances 99 of the elastomeric wall material 100 along the longitudinal axis 94 of the flexible tube 96 to minimizes the radial distortion of the flexible tube 96 and to maximize the flexibility of the flexible tube 96 along the longitudinal axis 94 of the flexible tube 96.

When the flexible elastomer tube 96 elastomer wall 93 having a spring-type single-strand coiled-wire 98, the coiled-wires 98 can be in a neutral non-extended state or they can be extended or they can be compressed prior to imbedding the coiled-wires 98 in the tube 96 elastomer wall 93 wall or when attaching the coiled-wires 98 to single-layer or multiple-layer flexible elastomer tube 96 elastomer wall 93 walls using adhesives. After the flexible elastomer tube 96 having the "extended" coiled-wires 98 construction is completed and the elastomer tube 96 is allowed to assume its relaxed equilibrium shape, the elastomer tube 96 wall material 100 will tend to develop curvatures along the axis 94 of the tube 96 where the distances 95 along the longitudinal axis 94 of the tube 96 between individual adjacent radially-stiff coils or rings of wire 98 is reduced. The elastomer tube 96 wall material 100 having relaxed-shape curvatures along the axis 94 of the tube 96 will tend to have a lower spring constant along the longitudinal axis 94 of the tube 96 between where less force is required to initially stretch the elastomer tube 96 wall along the longitudinal axis 94 of the tube 96. Also, after the flexible elastomer tube 96 having the "compressed" coiled-wires 98 construction is completed and the elastomer tube 96 is allowed to assume its relaxed equilibrium shape, the elastomer tube 96 wall material 100 will tend to develop pre-stretched portions along the axis 94 of the tube 96 where the distances 95 along the longitudinal axis 94 of the tube 96 between individual adjacent radially-stiff coils or rings of wire 98 is increased.

Figure 7:
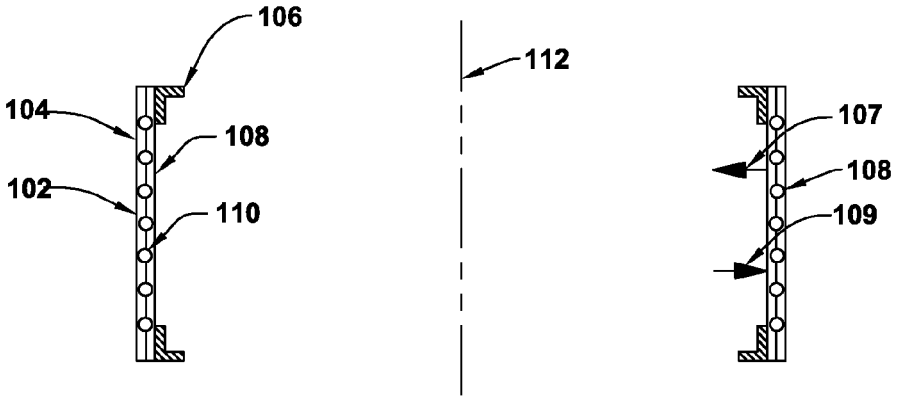
FIG. 7 is a cross section view of a coiled-wire elastomeric tube section with end rings.

FIG. 7 is a cross section view of a coiled-wire or wire-hoop reinforced elastomeric tube section with elastomeric tube mounting end rings. A laminated flexible elastomeric tube 104 having a longitudinal axis 112 is constructed from an outer annular elastomer layer 102 and an inner annular layer 108 with a single-strand coiled-wire 110 or closed-loop wire rings 108. Here, the outer annular elastomer layer 102 and the inner annular layer 108 and the single-strand coiled-wire 110 or the closed-loop wire rings 108 and bonded together with heat, chemical reactions or adhesives to form an integral laminated flexible elastomeric tube 104. The integral laminated flexible elastomeric tube 104 can be produced with multiple layers 102 and 108 and also other layers (not shown) where all of the layers 102 and 108 and other layers can have different layer thicknesses and have different layer materials including stretch-type and non-stretch-type woven materials. Annular elastomeric tube 104 mounting end rings 106 are attached to the integral laminated flexible elastomeric tube 104 at both longitudinal ends with adhesives or mechanical attachment devices such as clamps or annular-wound threads or wires (not shown).

The wires 108 or 110 provide radial stiffness to the laminated flexible elastomeric tube 104 but also provide flexibility of the laminated flexible elastomeric tube 104 in a direction along the elastomeric tube 104 longitudinal axis 112. The radial stiffness of the laminated flexible elastomeric tube 104 minimizes the radial deflection of the elastomeric tube 104 when the elastomeric tube 104 is subjected to internal pressure forces 109 and internal vacuum forces 107.

Figure 8:
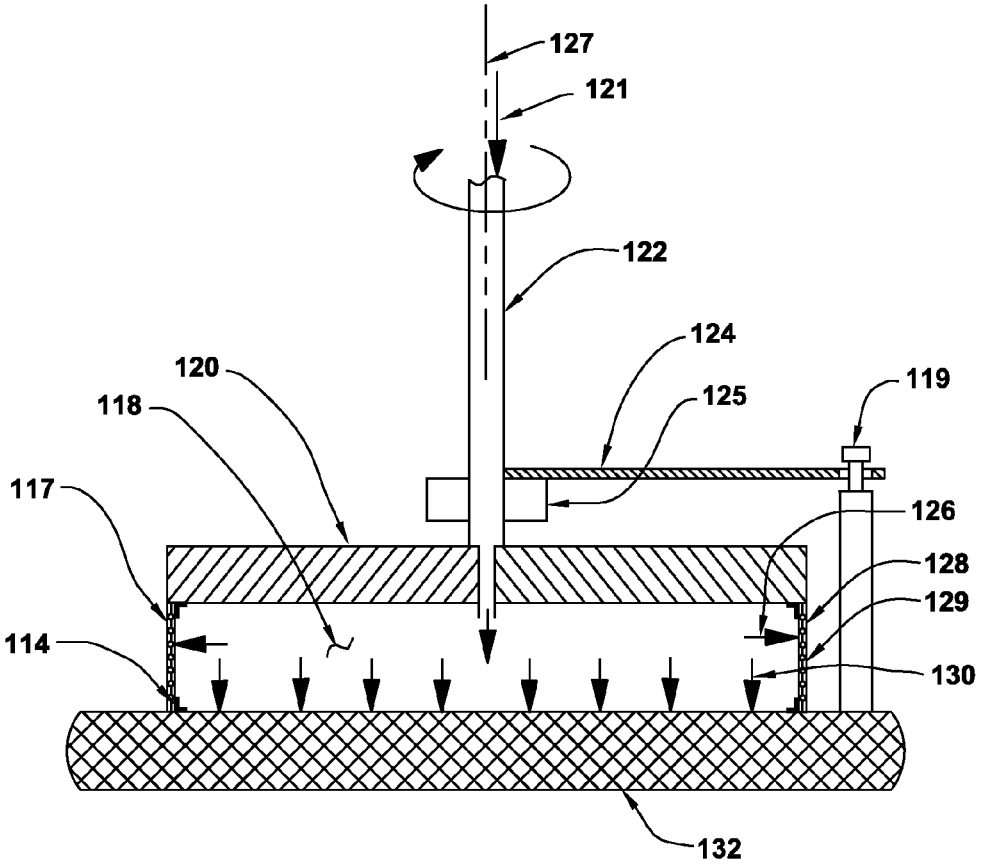
FIG. 8 is a cross section view of a reinforced elastomeric tube and a workpiece holder.

FIG. 8 is a cross section view of a reinforced elastomeric tube and a workpiece holder. An annular laminated elastomeric tube 128 has mounting rings 114 where one mounting ring 114 is attached to a rotatable plate 120 that is attached to and rotationally driven by a shaft 122 having a drive hub 125. The other mounting ring 114 is attached to a workpiece carrier rotor 132 which has a vertical support bracket 116. The laminated elastomeric tube 128, the mounting rings 114, the rotatable plate 120 and the workpiece carrier rotor 132 together form a sealed chamber 118 which can be pressurized or have a vacuum applied to.

When an abrading pressure 121 is applied through the hollow shaft 122 and to the sealed chamber 118, a pressure force 126 is applied to the laminated elastomeric tube 128 vertical wall 129 and a pressure force 130 is applied to the top surface of the workpiece carrier rotor 132 where the pressure 130 is applied to a workpiece (not shown) as it contacts a moving platen (not shown) flat abrading surface. The pressure 130 tends to stretch the laminated elastomeric tube 128 in a direction along the vertical axis 127 of the drive shaft 122. The pressure 121 also produces a pressure force 126 that acts radially against the vertical wall 117 of the laminated elastomeric tube 128 which tends to make the vertical wall 117 to distort radially outward in a horizontal direction.

A slide-pin 119 is attached to a pin bracket that is attached to a workpiece carrier rotor 132 which allows a slide pin arm 124 that is attached to a shaft drive hub 125 that is attached to a drive shaft 122. Rotation of the drive shaft 122 rotates the workpiece carrier rotor 132 as the at least one slide pin arm 124 is stiff in a circumferential direction about the axis 127 of the drive shaft 122 but are very flexible in a direction along the axis 127 of the drive shaft 122. When the applied pressure 121 moves the workpiece carrier rotor 132 down the vertical axis 127, the at least one slide-pin 119 is moves vertically but remains in sliding contact with the slide pin arm 124.

Figure 9:
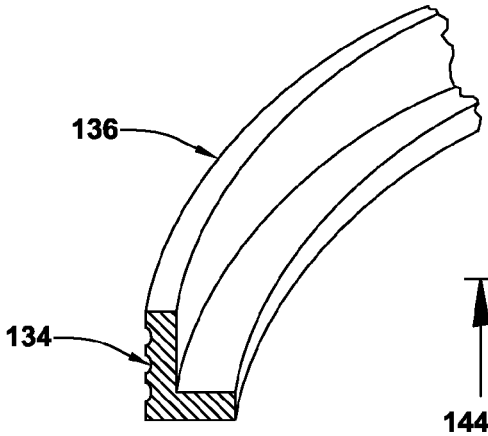
FIG. 9 is an isometric view of an annular elastomeric tube mounting bracket.

FIG. 9 is an isometric view of an annular elastomeric tube mounting bracket. An annular mounting bracket 136 has annular grooves 134 on the vertical wall of the horizontal bracket 136. These grooves 134 allow a flexible elastomeric tube (not shown) to be attached with an annular-wound woven strand or thread or wire where the flexible elastomeric tube can be attached to a rotatable plate (not shown) or a workpiece carrier rotor (not shown).

Figure 9A:
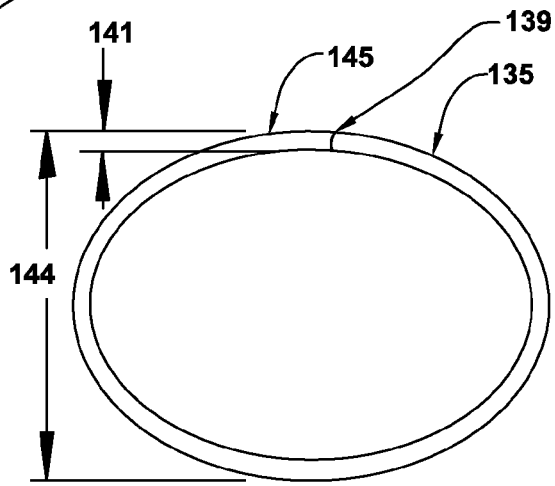
FIG. 9A is an isometric view of a continuous-loop wire ring that is rigid in a radial direction.

FIG. 9A is an isometric view of a continuous-loop wire ring that is rigid in a radial direction. A wire ring 135 that is constructed from a wire 145 has an outer diameter 144 and a cross sectional diameter 141 and has a wire ring 135 butt joint 139 where the butt joint 139 can be a welded joint, a melt-fused joint or an adhesive-jointed joint. The wire ring 135 outer diameters 144 range in size from 0.5 inches to 40 inches (1.27 to 102 cm) or more and the wire ring 135 cross sectional diameters 141 range in size from 0.001 inches to 0.125 inches (0.0025 to 0.317 cm) or more. The wire 145 construction materials include steel, stainless steel, other metals, carbon, carbon fiber, natural material, polymers, composite materials, adhesive-impregnated fibers and ceramics. The cross sectional shape of the wire 145 can be circular, square, rectangular, oval or other shapes such as U-shaped.

Figure 10:
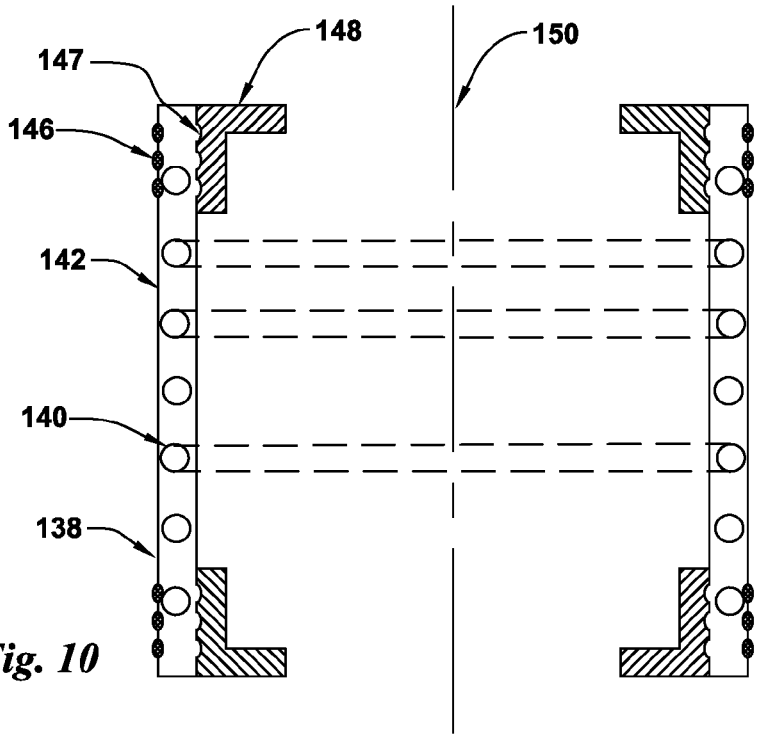
FIG. 10 is a cross section view of an elastomeric tube and mounting bracket.

FIG. 10 is a cross section view of an elastomeric tube and mounting bracket. A flexible elastomeric tube 142 having a vertical tube wall 138 and a vertical longitudinal axis 150 also has an attached annular mounting bracket 148 that has annular grooves 147 on the vertical wall of the horizontal bracket 148. These grooves 147 allow the flexible elastomeric tube 142 to be attached with an annular-wound woven strand or thread or wire 146 that is wound tightly around the circumference of the mounting bracket 148 in the location of the annular grooves 147 to attach the flexible elastomeric tube 142 to the attached annular mounting bracket 148. A portion of the flexible elastomeric tube 142 vertical tube wall 138 is pressed into the annular grooves 147 which effectively locks the flexible elastomeric tube 142 to the annular mounting bracket 148.

The flexible elastomeric tube 142 has a number of imbedded independent continuous-wire hoops that are located along the axis 150 of the elastomeric tube 142 which provides stiffness to the flexible elastomeric tube 142 in a radial direction from the axis 150 but which allows substantial flexibility of the flexible elastomeric tube 142 in a direction along the elastomeric tube 142 axis 150.

Figure 10A:
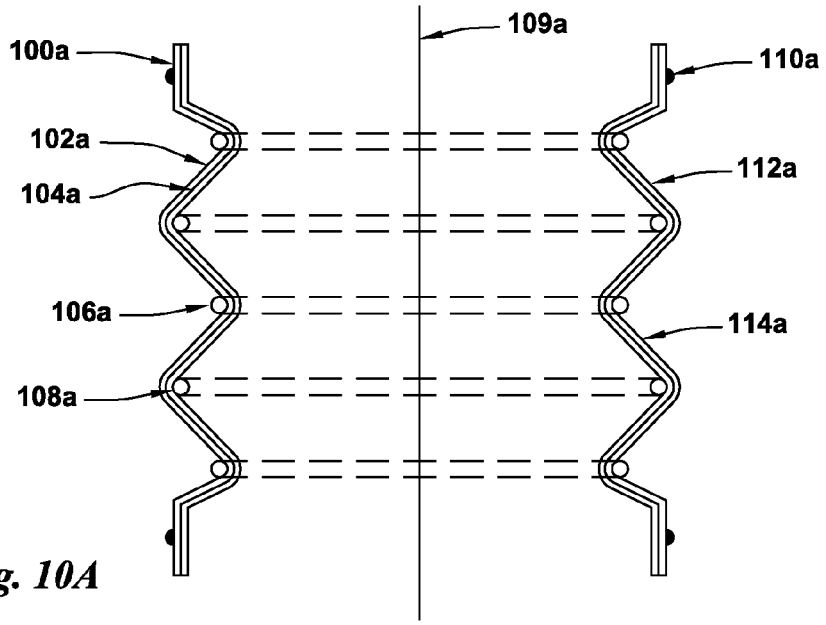
FIG. 10A is a cross section view of an elastomeric tube with closed-loop wires.

FIG. 10A is a cross section view of a flexible elastomeric tube with closed-loop wires. A flexible elastomeric tube 112*a* is shown with a laminated construction of an outer elastomer layer 102*a* and an inner elastomer layer 104*a* where the two layers 102*a* and 104*a* are bonded together with the use of different bonding techniques including heat, solvents and adhesives. The elastomeric tube 112*a* can also have a single-wall construction or have more than the two laminated layers 102*a* and 104*a*. The elastomeric tube 112*a* has a longitudinal axis 109*a* where the elastomeric tube 112*a* can be flexed along the longitudinal axis 109*a* where there are annular pleats 114*a* formed along the longitudinal length of the elastomeric tube 112*a*. The annular pleats 112*a* are formed by the use of alternating sets of closed-loop wires 106*a* and 108*a* where the closed-loop wires 106*a* have a smaller loop-diameter than the closed-loop wires 108*a*.

The closed-loop wires 106*a* and 108*a* are bonded to the elastomeric tube 112*a* laminated layers 102*a* and 104*a* where the closed-loop wires 106*a* and 108*a* provide radial stiffness but axial flexibility to the flexible elastomeric tube 112*a* when the flexible elastomeric tube 112*a* is subjected to pressures that act on either the inside or outside diameters of the elastomeric tube 112*a* or vacuum negative pressures act on either the inside or outside diameters of the elastomeric tube 112*a*. Use of the closed-loop wires 106*a* and 108*a* that are bonded to the elastomeric tube 112*a* nominally prevents the annular pleats 112*a* of the flexible elastomeric tube 112*a* from moving substantial radial distances from the longitudinal axis 109*a* as the internal portion of the elastomeric tube 112*a* is sequentially subjected to positive pressures and vacuum-induced negative pressures.

The closed-loop wires 106*a* and 108*a* can be sandwiched between the laminated layers 102*a* and 104*a* or they can be molded-in the wall of the elastomeric tube 112*a*. The flexible elastomeric tube 112*a* has a cylindrical-shaped end 100*a* which allows the elastomeric tube 112*a* to be attached to a mounting ring (not shown) by tension-wrapping a thread 110*a* around the circumference of the cylindrical-shaped end 100*a* to attach it to the ring. The flexible elastomeric tube 112*a* is nominally impervious and can be used to form a sealed pressure chamber.

Figure 10B:
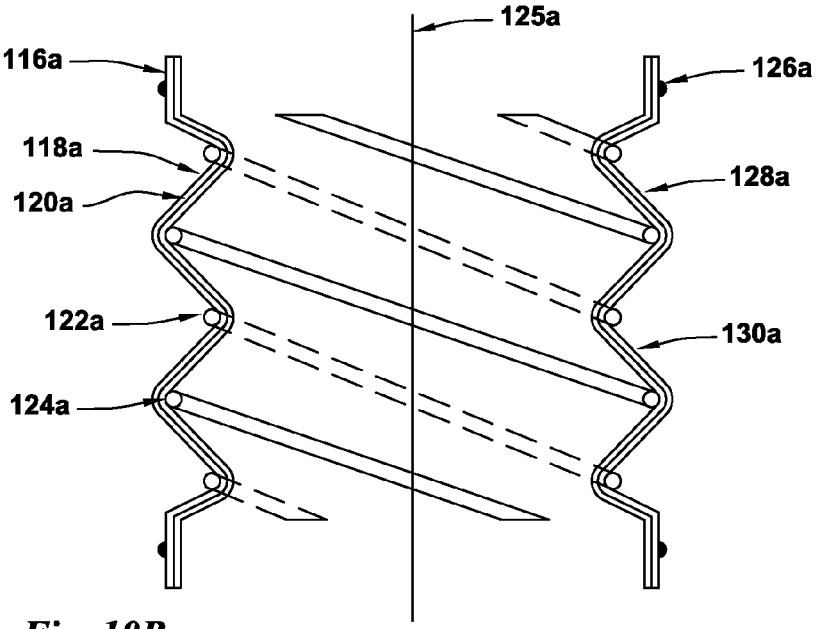
FIG. 10B is a cross section view of an elastomeric tube with serpentine-coiled wires.

FIG. 10B is a cross section view of an elastomeric tube with serpentine-coiled wires. A flexible elastomeric tube 128*a* is shown with a laminated construction of an outer elastomer layer 118*a* and an inner elastomer layer 120*a* where the two layers 118*a* and 120*a* are bonded together with the use of different bonding techniques including heat, solvents and adhesives. The elastomeric tube 128*a* can also have a single-wall construction or have more than the two laminated layers 118*a* and 120*a*. The elastomeric tube 128*a* has a longitudinal axis 125*a* where the elastomeric tube 128*a* can be flexed along the longitudinal axis 125*a* where there are annular pleats 130*a* formed along the longitudinal length of the elastomeric tube 128*a*. The annular pleats 128*a* are formed by the use of two coiled serpentine-shaped single-strand wire springs 122*a* and 124*a* where the wire coil 122*a* has a smaller loop-diameter than the wire coil 124*a*.

The wire coils 122*a* and 124*a* are bonded to the elastomeric tube 128*a* laminated layers 118*a* and 120*a* where the wire coils 122*a* and 124*a* provide radial stiffness but axial flexibility to the flexible elastomeric tube 128*a* when the flexible elastomeric tube 128*a* is subjected to pressures that act on either the inside or outside diameters of the elastomeric tube 128*a* or vacuum negative pressures act on either the inside or outside diameters of the elastomeric tube 128*a*. Use of the wire coils 122*a* and 124*a* that are bonded to the elastomeric tube 128*a* nominally prevents the annular pleats 128*a* of the flexible elastomeric tube 128*a* from moving substantial radial distances from the longitudinal axis 125*a* as the internal portion of the elastomeric tube 128*a* is sequentially subjected to positive pressures and vacuum-induced negative pressures.

The wire coils 122*a* and 124*a* can be sandwiched between the laminated layers 118*a* and 120*a* or they can be molded-in the wall of the elastomeric tube 128*a*. The flexible elastomeric tube 128*a* has a cylindrical-shaped end 116*a* which allows the elastomeric tube 128*a* to be attached to a mounting ring (not shown) by tension-wrapping a thread 126*a* around the circumference of the cylindrical-shaped end 116*a* to attach it to the ring. The flexible elastomeric tube 128*a* is nominally impervious and can be used to form a sealed pressure chamber.

Figure 10C:
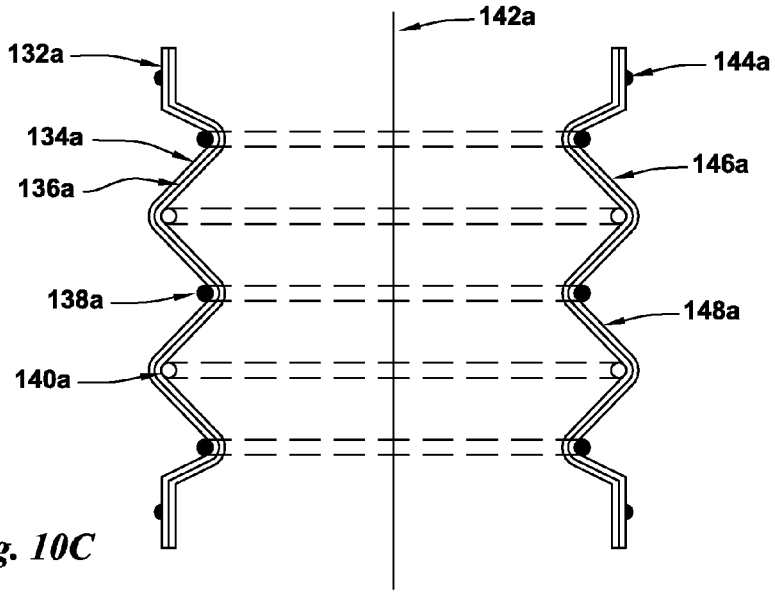
FIG. 10C is a cross section view of an elastomeric tube with closed-loop wires and threads.

FIG. 10C is a cross section view of an elastomeric tube with closed-loop wires and threads. A flexible elastomeric tube 146*a* is shown with a laminated construction of an outer elastomer layer 134*a* and an inner elastomer layer 136*a* where the two layers 134*a* and 136*a* are bonded together with the use of different bonding techniques including heat, solvents and adhesives. The elastomeric tube 146*a* can also have a single-wall construction or have more than the two laminated layers 134*a* and 136*a*. The elastomeric tube 146*a* has a longitudinal axis 142*a* where the elastomeric tube 146*a* can be flexed along the longitudinal axis 142*a* where there are annular pleats 148*a* formed along the longitudinal length of the elastomeric tube 146*a*. The annular pleats 146*a* are formed by the use of alternating sets of closed-loop wires 138*a* and tension-wound bands of thread 138*a* 140*a* where the a tension-wound bands of thread 138*a* have a smaller loop-diameter than the closed-loop wires 140*a*.

The closed-loop wires 140*a* and the tension-wound bands of thread 138*a* are bonded to the elastomeric tube 146*a* laminated layers 134*a* and 136*a* where the closed-loop wires 140*a* and the tension-wound bands of thread 138*a* provide radial stiffness but axial flexibility to the flexible elastomeric tube 146*a*. When the flexible elastomeric tube 146*a* is subjected to pressures that act on the inside diameter of the elastomeric tube 146*a* the closed-loop wires 140*a* provide radial stiffness to the flexible elastomeric tube 146*a*.

Use of the closed-loop wires 138*a* and the tension-wound bands of thread 138*a* 140*a* that are bonded to the elastomeric tube 146*a* nominally prevents the annular pleats 146*a* of the flexible elastomeric tube 146*a* from moving substantial radial distances from the longitudinal axis 142*a* as the internal portion of the elastomeric tube 146*a* is sequentially subjected to positive pressures and vacuum-induced negative pressures.

The closed-loop wires 138*a* and 140*a* can be sandwiched between the laminated layers 134*a* and 136*a* or they can be molded-in the wall of the elastomeric tube 146*a*. The tension-wound band of thread 138*a* is wound onto the outer diameter of the flexible elastomeric tube 164*a*. The flexible elastomeric tube 146*a* has a cylindrical-shaped end 132*a* which allows the elastomeric tube 146*a* to be attached to a mounting ring (not shown) by tension-wrapping a thread 144*a* around the circumference of the cylindrical-shaped end 132*a* to attach it to the ring. The flexible elastomeric tube 146*a* is nominally impervious and can be used to form a sealed pressure chamber.

Figure 10D:
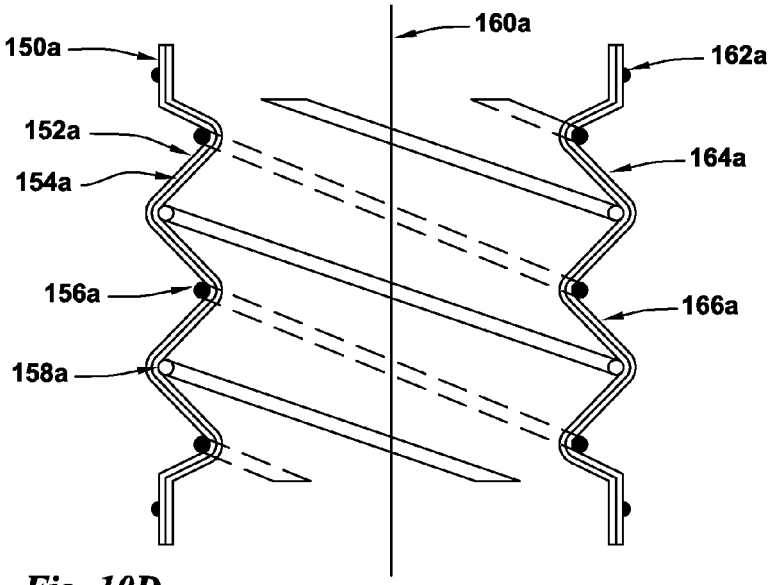
FIG. 10D is a cross section view of an elastomeric tube with coiled wires and threads.

FIG. 10D is a cross section view of an elastomeric tube with coiled wires and threads. A flexible elastomeric tube 164*a* is shown with a laminated construction of an outer elastomer layer 152*a* and an inner elastomer layer 154*a* where the two layers 152*a* and 154*a* are bonded together with the use of different bonding techniques including heat, solvents and adhesives. The elastomeric tube 164*a* can also have a single-wall construction or have more than the two laminated layers 152*a* and 154*a*. The elastomeric tube 164*a* has a longitudinal axis 160*a* where the elastomeric tube 164*a* can be flexed along the longitudinal axis 160*a* where there are annular pleats 166*a* formed along the longitudinal length of the elastomeric tube 164*a*. The annular pleats 164*a* are formed by the use of a coiled serpentine-shaped single-strand wire spring 158*a* and a tension-wound band of thread 156*a* where the tension-wound band of thread 156*a* has a smaller hoop-diameter than the single-strand wire spring 158*a*.

The single-strand wire spring 158*a* and the tension-wound band of thread 156*a* are bonded to the elastomeric tube 164*a* laminated layers 152*a* and 154*a* where the single-strand wire spring 158*a* and the tension-wound band of thread 156*a* provide radial stiffness but axial flexibility to the flexible elastomeric tube 164*a*. When the flexible elastomeric tube 164*a* is subjected to pressures that act on the inside diameter of the elastomeric tube 164*a* the single-strand wire spring 158*a* provides radial stiffness to the flexible elastomeric tube 164*a*.

Use of the single-strand wire spring 158*a* and the tension-wound band of thread 156*a* nominally prevents the annular pleats 164*a* of the flexible elastomeric tube 164*a* from moving substantial radial distances from the longitudinal axis 160*a* as the internal portion of the elastomeric tube 164*a* is sequentially subjected to positive pressures and vacuum-induced negative pressures.

The single-strand wire spring 158*a* can be sandwiched between the laminated layers 152*a* and 154*a* or they can be molded-in the wall of the elastomeric tube 164*a*. The tension-wound band of thread 156*a* is wound onto the outer diameter of the flexible elastomeric tube 164*a*. The flexible elastomeric tube 164*a* has a cylindrical-shaped end 150*a* which allows the elastomeric tube 164*a* to be attached to a mounting ring (not shown) by tension-wrapping a thread 162*a* around the circumference of the cylindrical-shaped end 150*a* to attach it to the ring. The flexible elastomeric tube 164*a* is nominally impervious and can be used to form a sealed pressure chamber.

Figure 10E:
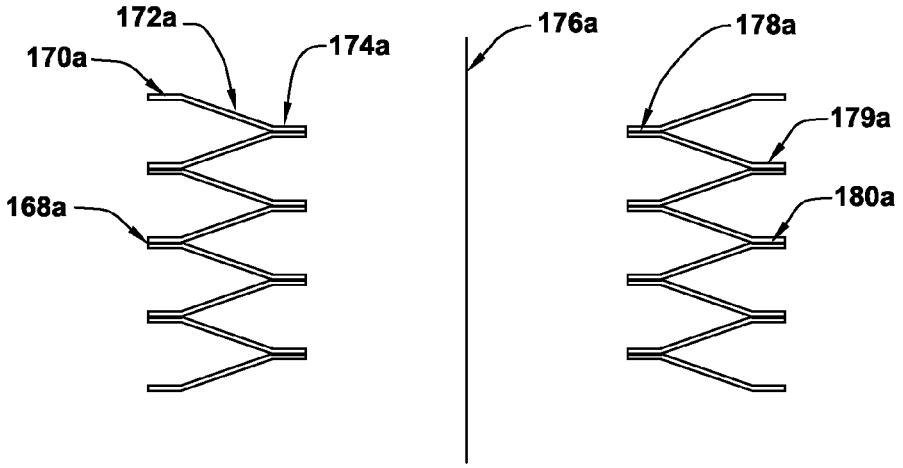
FIG. 10E is a cross section view of an elastomeric tube with bonded annular disks.

FIG. 10E is a cross section view of an elastomeric tube with bonded annular disks. A flexible elastomer tube 170*a* has a number of annular elastomeric disks 168*a* that are attached to each other at the inner annular portions 174*a* and the outer annular portions 179*a* by annular bands of adhesive 178*a* and 180*a*. The annular disks 168*a* are nominally flat but they are shown here as distorted out-of-plane where the flexible elastomer tube 170*a* is extended along the flexible elastomer tube 170*a* tube axis 176*a*. Most of the axial flexing of the elastomer tube 170*a* tube occurs in the central annular portion 172*a* of the annular disks 168*a*.

The annular disks 168*a* can be cut out of sheets of flat elastomer material where the elastomer materials comprises silicone rubber, room temperature vulcanizing (RTV) silicone rubber, natural rubber, synthetic rubber, thermoset polyurethane, thermoplastic polyurethane TPU), polymers, composite materials, polymer-impregnated woven cloths, sealed fiber materials and laminated sheets of combinations of these materials. The thickness of the annular disks 168*a* can range from 0.003 to 0.375 inches (0.007 to 0.952 cm). The outer diameter of the flexible elastomer tube 170*a* can have a range of sizes from 0.5 inches to 40 inches (1.27 to 102 cm) or more, depending on the size of the abrading system (not shown) they are used on.

Some localized stretching of the annular disk material 168*a* occurs when the flexible elastomer tube 170*a* is extended along the flexible elastomer tube 170*a* tube axis 176*a*. However, most of the distortion of the individual annular disks 168*a* that is required to provide the desired axial flexing of the elastomer tube 170*a* tube occurs in the central annular portion 172*a* of the annular disks 168*a*. Here, the inner or outer annular edges of the individual annular disks 168*a* inner annular portions 174*a* and the outer annular portions 179*a* are simply flexed out-of-plane with very little stretching of the annular disks 168*a* material. Typically, very little structural stress is generated in the annular disk 168*a* material and in the adhesive joints 178*a* and 180*a* when the limited excursion-distance axial flexing of the elastomer tube 170*a* tube occurs.

The elastomer materials are nominally-impervious to fluids where the elastomeric tube 170*a* can be sealed and subjected to internal and external pressures and vacuum negative pressure with minimal fluid leakage. When abrading pressures or vacuum are applied to the elastomer tube sealed chamber, the resultant structural stresses that occur in the annular disk 168*a* material and in the adhesive joints 178*a* and 180*a* are well below allowable stresses for the annular disk 168*a* materials and for the adhesive joints 178*a* and 180*a*.

The adhesives 178*a* and 180*a* comprise adhesive materials including cyanoacrylates, combinations of activator-primers with cyanoacrylates, polyurethane adhesives, epoxy adhesives and a Loctite® Brand Plastics Bonding System kit of a cyanoacrylate adhesive "Activator and Glue" available from the Henkel Corporation, Rocky Hill, Conn. The annular disk elastomer disks 168*a* materials can also be bonded together and the elastomer disks 168*a* can also be bonded to elastomer tube 170*a* mounting rings or collars (not shown) with solvents, heat and other sources of energy.

Figure 10F:
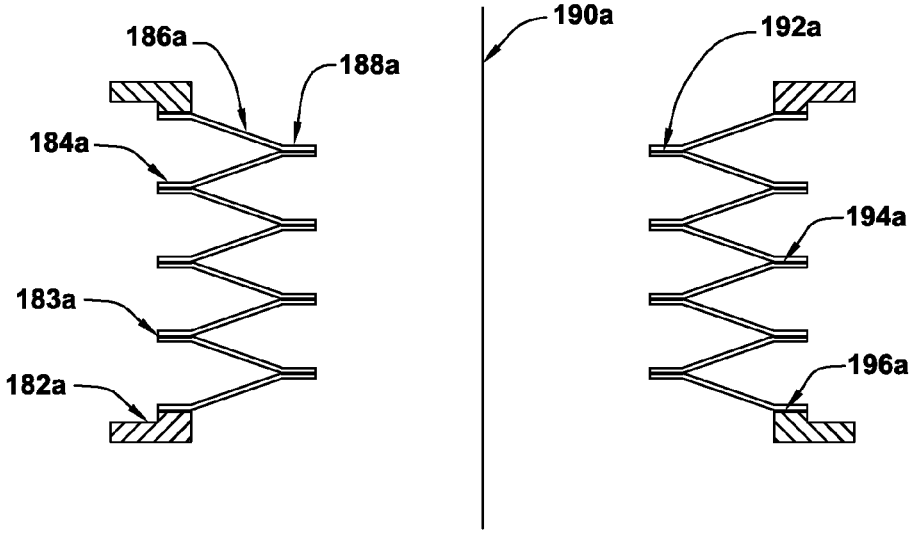
FIG. 10F is a cross section view of an elastomeric-disk tube with annular mounting collars.

FIG. 10F is a cross section view of an elastomeric-disk tube with annular mounting collars. A flexible elastomeric tube 183*a* having a vertical longitudinal axis 190*a* also has an attached annular mounting bracket 182*a* that is bonded to the flexible elastomeric tube 183*a* with an adhesive 196*a*. The elastomer tube 183*a* has a number of flexible annular elastomeric disks 186*a* that are attached to each other at the inner annular portions 188*a* and the outer annular portions 184*a* by annular bands of adhesive 192*a* and 194*a*. The annular disks 186*a* are nominally flat but they are shown here as distorted out-of-plane where the flexible elastomer tube 183*a* is extended along the tube axis 190*a*.

The nominally horizontal inner annular portions 188*a* and the outer annular portions 184*a* of the annular elastomeric disks 186*a* provides structural stiffness to the flexible elastomeric tube 183*a* in a radial direction from the axis 190*a* but they allow substantial flexibility of the flexible elastomeric tube 186*a* in a direction along the elastomeric tube 186*a* axis 190*a*. Due to the radial stiffness of the inner annular portions 188*a* and the outer annular portions 184*a* of the annular elastomeric disks 186*a* there is minimal radial flexing of the flexible elastomeric tube 183*a* when the flexible elastomeric tube 183*a* is subjected to pressures that act on either the inside or outside diameters of the elastomeric tube 183*a* or vacuum negative pressures act on either the inside or outside diameters of the elastomeric tube 183*a*.

Figure 10G:
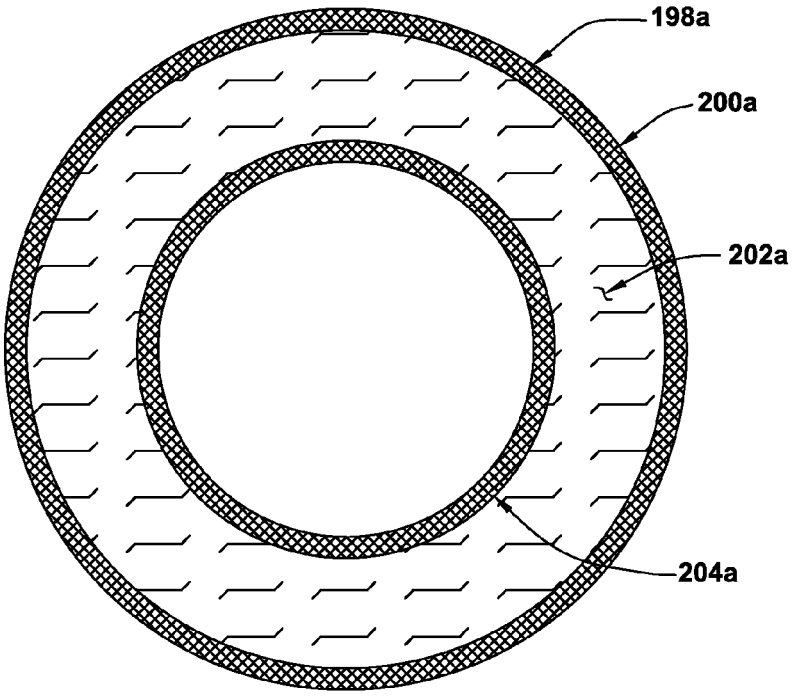
FIG. 10G is a top view of an elastomeric disk with annular adhesive bands for disk bonding.

FIG. 10G is a top view of an elastomeric disk with annular adhesive bands for disk bonding. The flexible annular elastomeric disk 198*a* has an adhesive coated outer annular band 200*a* and an adhesive coated inner annular band 204*a* where the center annular portion 202*a* of the flexible annular elastomeric disk 198*a* is free from adhesive.

Figure 10H:
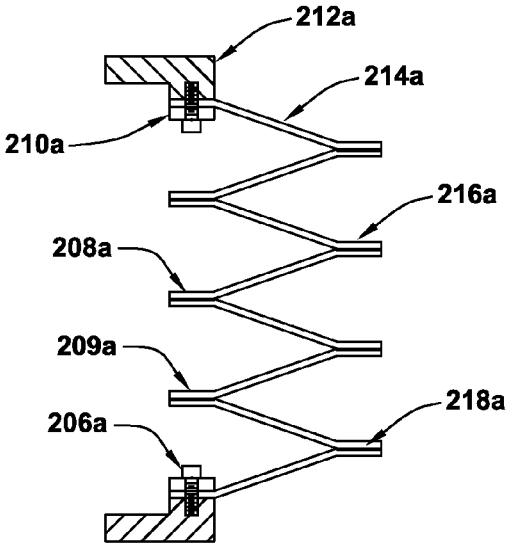
FIG. 10H is a cross section view of an elastomeric-disk tube with annular disk-clamp collars.

FIG. 10H is a cross section view of one edge of an elastomeric-disk tube with annular disk-clamp collars. A flexible elastomeric tube 208*a* has annular mounting brackets 212*a* that are attached to the flexible elastomeric tube 208*a* with annular clamps 210*a* and fasteners 206*a*. The elastomer tube 208*a* has a number of flexible annular elastomeric disks 214*a* that are attached to each other at the inner annular portions 216*a* and the outer annular portions 209*a* by annular bands of adhesive 218*a*. The annular disks 214*a* are nominally flat but they are shown here as distorted out-of-plane where the flexible elastomer tube 208*a* is extended along the tube longitudinal axis.

Figure 10I:
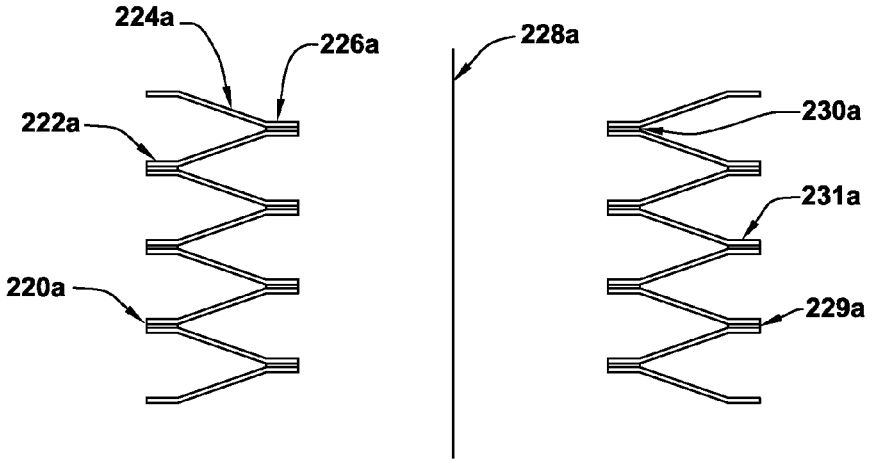
FIG. 10I is a cross section view of an elastomeric tube with flat-metal support rings.

FIG. 10I is a cross section view of an elastomeric tube with flat-metal support rings. A flexible elastomeric tube 220*a* has annular metal, polymer or composite material radial reinforcing rings 229*a*, 230*a* that are attached to the flexible elastomeric tube 220*a* with adhesives. The annular reinforcing rings 229*a*, 230*a* can have a thickness that ranges from 0.002 to 0.375 inches (0.05 to 9.52 mm) but are preferred to have a range of from 0.005 to 0.025 inches (0.127 to 0.635 mm). The elastomer tube 220*a* has a number of flexible annular elastomeric disks 224*a* that are attached to each other and the radial reinforcing rings 229*a*, 230*a* at the inner annular portions 226*a* and the outer annular portions 222*a* by annular bands of adhesive 231*a*. The annular disks 224*a* are nominally flat but they are shown here as distorted out-of-plane where the flexible elastomer tube 220*a* is extended along the tube axis 228*a*.

The reinforcing rings 229*a*, 230*a* that are bonded to the elastomeric tube 220*a* provide radial stiffness but axial flexibility to the flexible elastomeric tube 230*a*. When the flexible elastomeric tube 230*a* is subjected to pressures that act on the inside diameter of the elastomeric tube 230*a* the reinforcing rings 229*a*, 230*a* provide radial stiffness to the flexible elastomeric tube 230*a*.

Figure 10J:
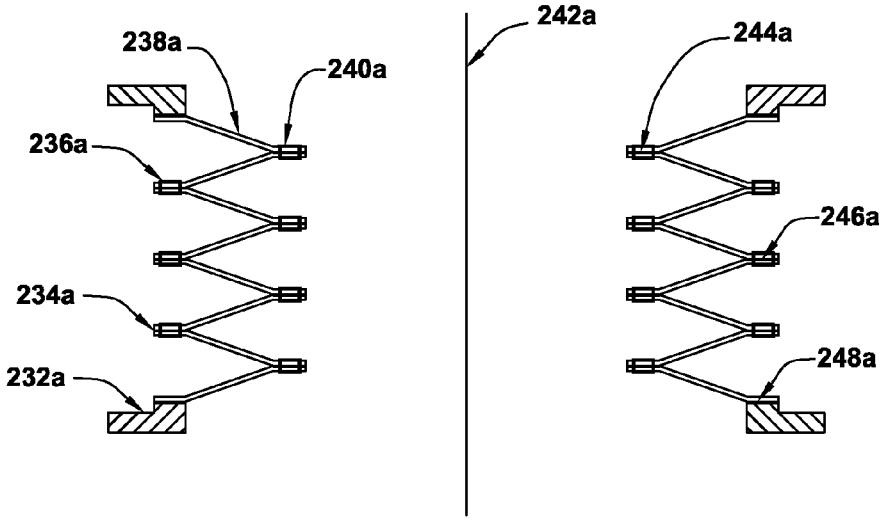
FIG. 10J is a cross section view of a sewn or stapled elastomeric tube and mounting bracket.

FIG. 10J is a cross section view of a sewn or stapled elastomeric tube and mounting bracket. A flexible elastomeric tube 234*a* having a vertical longitudinal axis 242*a* also has attached annular mounting brackets 232*a* that are bonded to the flexible elastomeric tube 234*a* with an adhesive 248*a*. The elastomer tube 234*a* has a number of flexible annular elastomeric disks 238*a* that are attached to each other at the inner annular portions 240*a* and the outer annular portions 236*a* by sewn thread or staples 244*a*, 246*a* with or without the use of adhesive. Sealants can also be used to seal through-holes that extend through the two thicknesses of the flexible annular elastomeric disks 238*a* when they are sewn or stapled together. The annular disks 238*a* are nominally flat but they are shown here as distorted out-of-plane where the flexible elastomer tube 234*a* is extended along the tube axis 242*a*.

Figure 10K:
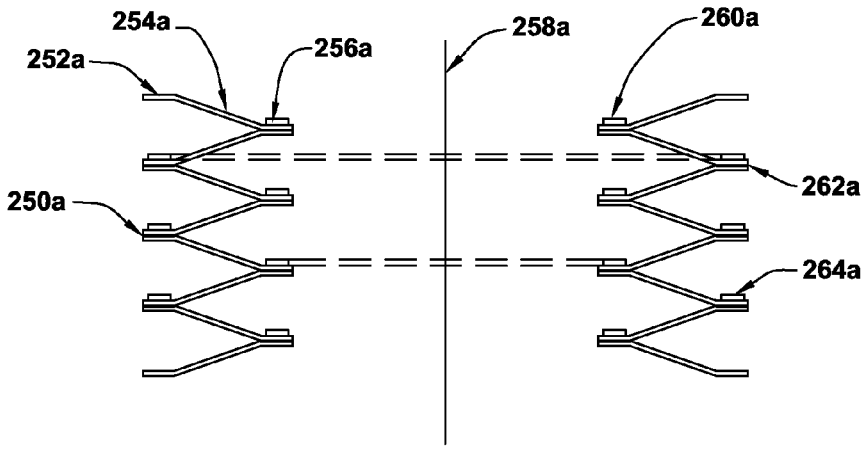
FIG. 10K is a cross section view of an elastomeric tube with attached annular support rings.

FIG. 10K is a cross section view of an elastomeric tube with attached annular flat-surfaced support rings. A flexible elastomeric tube 250*a* has annular metal, polymer or composite material radial flat-surfaced closed-hoop type reinforcing rings 260*a*, 264*a* that are attached to the flexible elastomeric tube 250*a* with adhesives or are bonded with solvents or heat. The elastomer tube 250*a* has a number of flexible annular elastomeric disks 254*a* that are attached together with adhesives 262*a* or with solvents or with heat to each other and are attached with adhesives, solvents or heat to the radial reinforcing rings 260*a*, 264*a* at the inner annular portions 256*a* and the outer annular portions 252*a*. The annular disks 254*a* are nominally flat but they are shown here as distorted out-of-plane where the flexible elastomer tube 250*a* is extended along the tube axis 258*a*.

The reinforcing rings 260*a*, 264*a* that are attached to the elastomeric tube 250*a* provide radial stiffness but axial flexibility to the flexible elastomeric tube 250*a*. When the flexible elastomeric tube 250*a* is subjected to pressures that act on the inside or outside diameter of the elastomeric tube 250*a* the reinforcing rings 260*a*, 264*a* provide radial stiffness to the flexible elastomeric tube 250*a*.

Figure 10L:
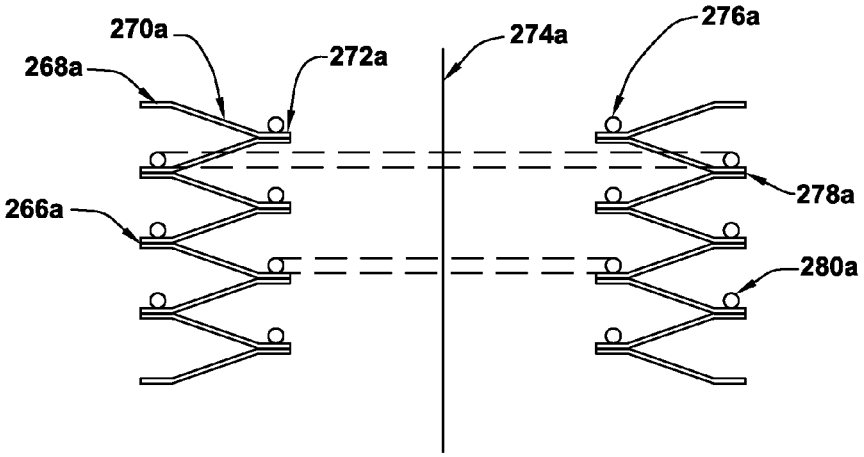
FIG. 10Ll is a cross section view of an elastomeric tube with attached circular support rings.

FIG. 10Ll is a cross section view of an elastomeric tube with attached circular support rings. A flexible elastomeric tube 266*a* has metal, polymer or composite material radial circular cross section closed-hoop type reinforcing wire rings 276*a*, 280*a* that are attached to the flexible elastomeric tube 266*a* with adhesives or are bonded with solvents or heat. The elastomer tube 266*a* has a number of flexible annular elastomeric disks 270*a* that are attached together with adhesives 278*a* or with solvents or with heat to each other and are attached with adhesives, solvents or heat to the radial reinforcing rings 276*a*, 280*a* at the inner annular portions 272*a* and the outer annular portions 268*a*. The annular disks 270*a* are nominally flat but they are shown here as distorted out-of-plane where the flexible elastomer tube 266*a* is extended along the tube axis 274*a*.

The reinforcing rings 276*a*, 280*a* that are attached to the elastomeric tube 266*a* provide radial stiffness but axial flexibility to the flexible elastomeric tube 266*a*. When the flexible elastomeric tube 266*a* is subjected to pressures that act on the inside or outside diameter of the elastomeric tube 266*a* the reinforcing rings 276*a*, 280*a* provide radial stiffness to the flexible elastomeric tube 266*a*.

Figure 11:
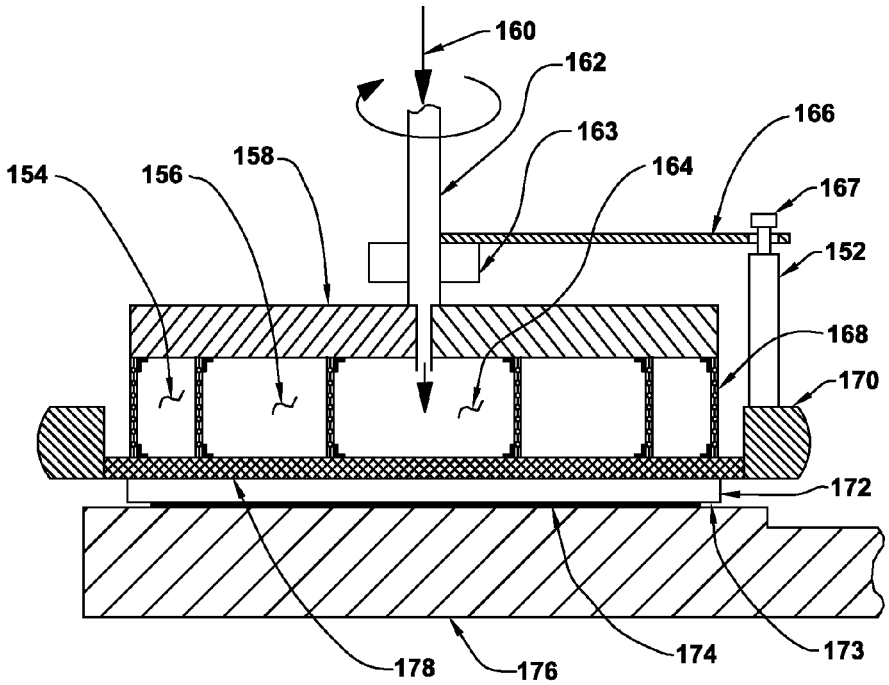
FIG. 11 is a cross section view of a drive pin carrier with multiple pressure chambers

FIG. 11 is a cross section view of a sliding drive pin workpiece carrier with multiple pressure chambers. A flat-surfaced workpiece 172 is attached to a nominally-horizontal floating workpiece carrier rotor 170 that is rotationally driven by a sliding pin arm device 166 that is attached to a drive hub 163 that is attached to a hollow drive shaft 162. The ends of the pin arm 166 are in sliding contact with a sliding pin 167 that is attached to a bracket 152 that is attached to the workpiece carrier rotor 170. Annular flexible reinforced elastomeric tubes 168 are attached on one end to the central flexible bottom portion 178 of the workpiece carrier rotor 170 and are attached at the opposed end to the drive plate 158.

The workpiece 172 is attached to the central flexible bottom portion 178 of the workpiece carrier rotor 170 by vacuum, low-tack adhesives or adhesive-bonding provided by water films that mutually wet the surfaces of both the workpiece 172 and the central flexible bottom portion 178 of the workpiece carrier rotor 170. Single or multiple workpieces 172 can be attached to the flexible bottom portion 178 of the workpiece carrier rotor 170.

Pressurized air or another fluid such as water 160 or vacuum is supplied through the hollow drive shaft 162 that has fluid passages which allows multiple pressurized air or another fluid such as water 18 to fill the independent sealed pressure chambers 154, 156 and 163 that are formed by the sealed annular flexible elastomer tube-section devices 168. Different controlled fluid 160 pressures are present in each of the independent annular or circular sealed chambers 154, 156 and 163 to provide uniform abrading action across the full flat abraded surface 173 of the workpiece 172 that is in abrading contact with the abrasive 174 coating on the rotary platen 176. When the sealed pressure chambers 154, 156 and 163 are pressurized by a fluid, the sealed annular flexible elastomer tube-section devices 168 expand or contract vertically and the sliding pin 167 also moves upward or downward in a vertical direction but stays in sliding contact with the sliding pin arm device 166.

Vacuum or pressure can be supplied independently to the annular or circular sealed chambers 154, 156 and 163 to provide attachment of workpieces 172 to the central flexible bottom portion 178 of the workpiece carrier rotor 170 or a combination of vacuum or pressures may be used to optimize the uniform abrading of the abraded surface of the workpieces 172.

Figure 12:
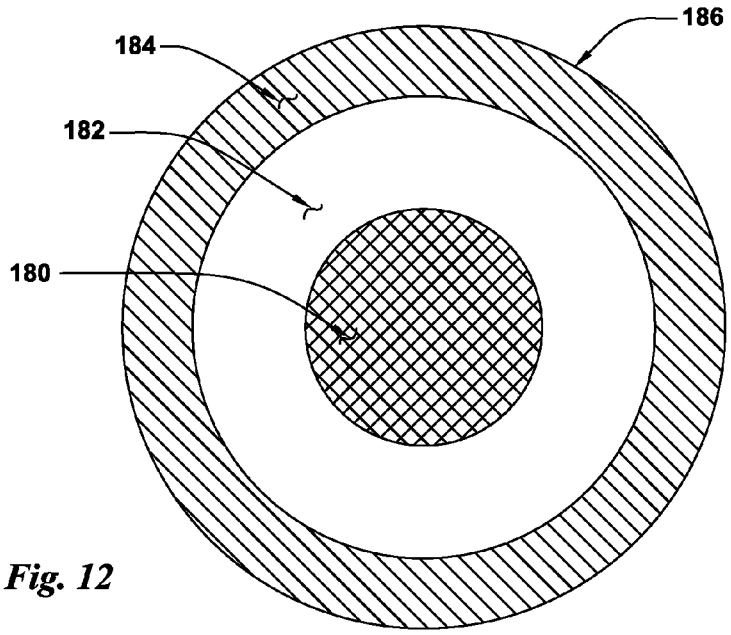
FIG. 12 is a top view of a drive pin workpiece carrier with multiple pressure chambers.

FIG. 12 is a top view of a sliding drive pin workpiece carrier with multiple pressure chambers. A flexible-bottom workpiece holder 186 of the has an annular outer abrading pressure zone 184, an annular inner abrading pressure zone 182 and a circular inner abrading pressure zone 180. The abrading pressure is independently controlled in each of the three zones 184, 182 and 180. The device shown here has three independent pressure zones but other device embodiments can have five or more independent pressure zones.

Figure 13:
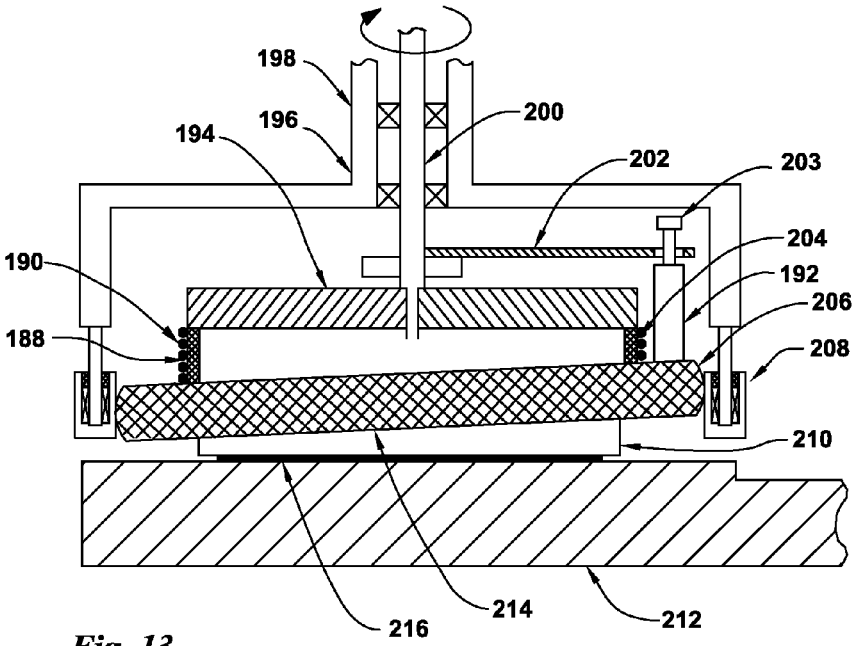
FIG. 13 is a cross section view of a drive pin workpiece carrier with an angled workpiece.

FIG. 13 is a cross section view of a sliding drive pin workpiece carrier with an angled workpiece. A workpiece abrading carrier head device 198 has a floating workpiece carrier rotor 206 and a carrier housing 196. A flat-surfaced workpiece 210 having an angled-surface shape is attached to the nominally-horizontal floating workpiece carrier rotor 206 that is rotationally driven by a sliding drive pin device 202 that is attached to a drive shaft 200. The at least one drive pin 203 is attached to a bracket 192 that is attached to the workpiece carrier rotor 206. An annular flexible reinforced elastomeric tube 190 having reinforcing wires 188 is attached on one end to the workpiece carrier rotor 206 and is attached at the opposed end to the drive plate 194. The angled-surface workpiece 210 is attached to the workpiece carrier rotor 206 by vacuum, low-tack adhesives or adhesive-bonding provided by water films that mutually wet the surfaces of both the workpiece 210 and the workpiece carrier rotor 206.

Rolling contact of the workpiece carrier rotor 206 outer periphery with a set of multiple stationary roller idlers 208 that are precisely located at prescribed positions assures that the workpiece carrier rotor 206 rotation axis is coincident with the hollow drive shaft 200 rotation axis. The stationary roller idlers 208 are mounted at positions on the carrier housing 196 where the diameters of the stationary roller idlers 208 and the diameters of the workpiece carrier rotors 206 are considered in the design and fabrication of the workpiece carrier head 198 to provide that the workpiece carrier rotor 206 rotation axis is precisely coincident with the hollow drive shaft 200 rotation axis.

When the angled-surface workpiece 210 is attached to the workpiece carrier rotor 206 the annular flexible reinforced elastomeric tube 190 is compressed vertically into a shape 204 by the increased thickness on that side portion of the angled-surface workpiece 210 that is attached to the flat-surfaced workpiece carrier rotor 206. The drive pin 202 is moved upward to compensate for the upward motion of the workpiece carrier rotor 206 as the workpiece carrier rotor 206 and the bracket 192 that are rotated by the drive shaft 200. Flexing of the annular flexible reinforced elastomeric tube 190 and the vertical, and horizontal, movement of the drive pin 203 allow the abraded surface of the angled-surface workpiece 210 to remain in flat-surfaced abrading contact with the abrasive 216 coating on the rotary platen 212 as the surface workpiece 210 is rotated.

Figure 14:
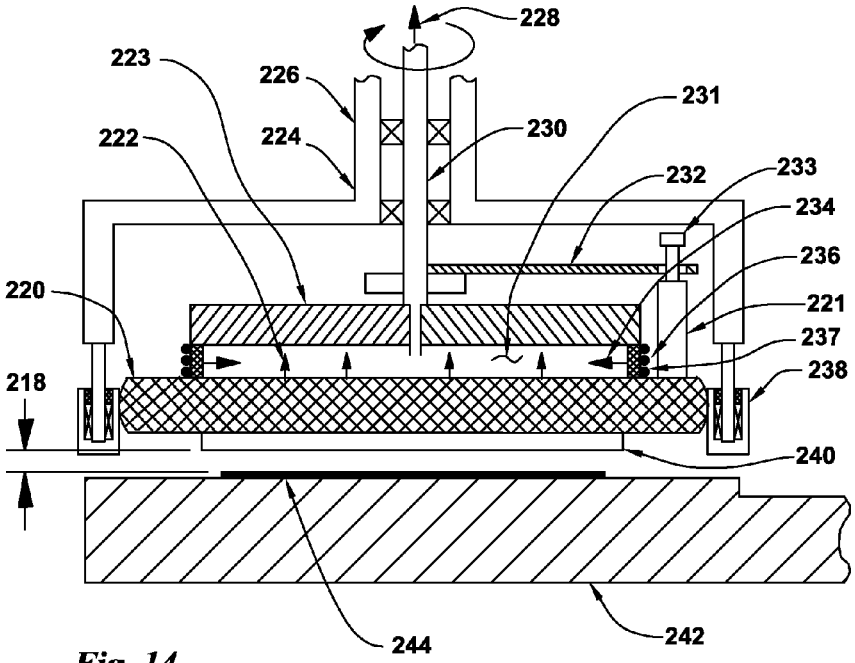
FIG. 14 is a cross section view of a drive pin workpiece carrier with a raised workpiece.

FIG. 14 is a cross section view of a sliding drive pin workpiece carrier with a raised workpiece. A workpiece abrading carrier head device 226 has a floating workpiece carrier rotor 220 and a carrier housing 224. A flat-surfaced workpiece 240 is attached to the nominally-horizontal floating workpiece carrier rotor 220 that is rotationally driven by a sliding drive pin arm 232 that is attached to a drive shaft 230. The drive pin 233 is attached to a bracket 221 that is attached to the workpiece carrier rotor 220. An annular flexible reinforced elastomeric tube 236 having reinforcing wires 237 is attached on one end to the workpiece carrier rotor 220 and is attached at the opposed end to the drive plate 223. The workpiece 240 is attached to the workpiece carrier rotor 220 by vacuum, low-tack adhesives or adhesive-bonding provided by water films that mutually wet the surfaces of both the workpiece 240 and the workpiece carrier rotor 220.

Rolling contact of the workpiece carrier rotor 220 outer periphery with a set of multiple stationary roller idlers 238 that are precisely located at prescribed positions assures that the workpiece carrier rotor 220 rotation axis is coincident with the hollow drive shaft 230 rotation axis. The stationary roller idlers 238 are mounted at positions on the carrier housing 224 where the diameters of the stationary roller idlers 238 and the diameters of the workpiece carrier rotors 220 are considered in the design and fabrication of the workpiece carrier head 226 to provide that the workpiece carrier rotor 220 rotation axis is precisely coincident with the hollow drive shaft 230 rotation axis.

When vacuum 228 is applied to the vacuum chamber 231, the workpiece carrier rotor 220 is raised and the workpiece 240 is raised a distance 218 from the abrasive 244 coating on the rotary platen 242 and the annular flexible reinforced elastomeric tube 236 is compressed vertically. Also, the drive pin 233 is deflected upward to compensate for the upward motion of the workpiece carrier rotor 220 as the workpiece carrier rotor 220 and the drive pin arm 232 are rotated by the drive shaft 230.

Vacuum 228 can be applied very quickly to the sealed chamber 231 with the use of a vacuum surge tank (not shown) that generates a large lifting force pressure 222 to quickly raise the workpiece 240 from contact with the abrasive 244 coating on the rotary platen 242. This fast action rising of the workpieces 240 is desirable to quickly interrupt an abrading process even when the workpiece 240 and the workpiece carrier rotor 220 are rotating at high speeds. The vacuum 228 that is applied to the vacuum chamber 231 also creates a vacuum force 234 that acts in a inward-radial direction on the annular flexible reinforced elastomeric tube 236 where the elastomeric tube 236 radially-rigid reinforcing wires 237 minimize the radial distortion of the flexible reinforced elastomeric tube 236. The vacuum 228 can provide a vacuum negative pressure 222 of from 0.1 to 14.7 psi.

Figure 15:
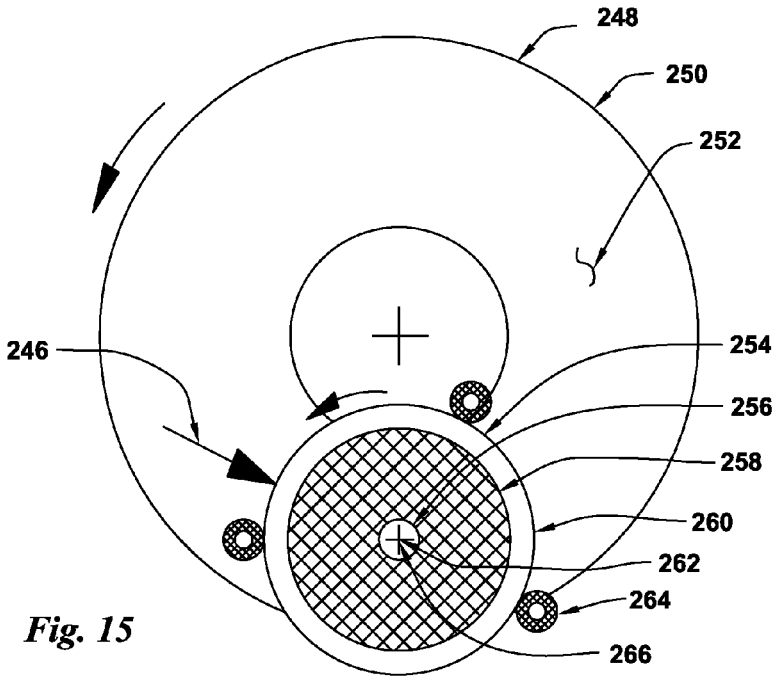
FIG. 15 is a top view of a slide-pin driven floating workpiece carrier used for lapping.

FIG. 15 is a top view of a slide-pin driven floating workpiece carrier used for lapping or polishing semiconductor wafers or other workpiece substrates. A stationary workpiece carrier head (not shown) has a flat-surfaced workpiece 258 that is attached to a floating workpiece carrier rotor 260 that is rotationally driven by a sliding drive pin (not shown) that is driven by a rotary drive shaft 256 that is attached to the stationary workpiece carrier head. The floating workpiece cylindrical-shaped carrier rotor 260 having a carrier rotor outer diameter 254 is in rolling-contact with three stationary-position rotatable roller idlers 264 that create and maintain the center of rotation 266 of the carrier rotor 260 as it rotates and is subjected to abrading forces 246. The center of rotation 266 of the carrier rotor 260 must be coincident with the axis of rotation 262 of the carrier rotor 260 hollow drive shaft (not shown). An abrasive disk 248 that has an annular band of abrasive 252 is attached to a rotating platen 250.

Figure 16:
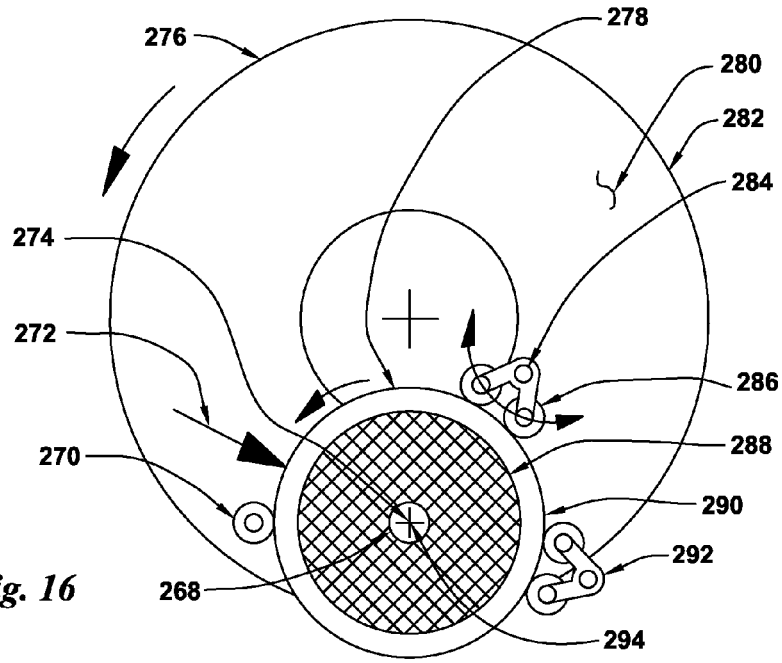
FIG. 16 is a top view of a sliding drive-pin driven floating carrier that is supported by idlers.

FIG. 16 is a top view of a sliding drive-pin driven floating carrier that is supported by idlers. A stationary workpiece carrier head (not shown) has a flat-surfaced workpiece 288 that is attached to a floating workpiece carrier rotor 290 that is rotationally driven by a sliding pin device (not shown) that is driven by a rotary drive shaft 268 that is attached to the stationary workpiece carrier head. The floating workpiece cylindrical-shaped carrier rotor 290 having a carrier rotor outer diameter 278 is in rolling-contact with multiple stationary-position rotatable roller idlers 270, 286 where idlers 286 have a pivot point 284 that provide equal-sharing of the reaction forces applied to the idlers 286 that are necessary to counteract the abrading force 272 on the workpiece 288 and to create and maintain the center of rotation 274 of the carrier rotor 290 as it rotates and is subjected to abrading forces 272.

The center of rotation 274 of the carrier rotor 290 must be coincident with the axis of rotation 294 of the carrier rotor 290 hollow drive shaft (not shown). An abrasive disk 282 that has an annular band of abrasive 280 is attached to a rotating platen 276. A dual set of idlers 286 is mounted on a pivot arm 292 having a pivot arm rotation center 284 that allows both idlers 286 to contact the outer periphery of the carrier rotor 290 where both idlers 286 share the restraining force load on the carrier rotor that is imposed by the abrading force 272 on the workpiece 288 that is transmitted to the carrier rotor 290 because the workpiece 288 is attached to the carrier rotor 290.

Figure 16A:
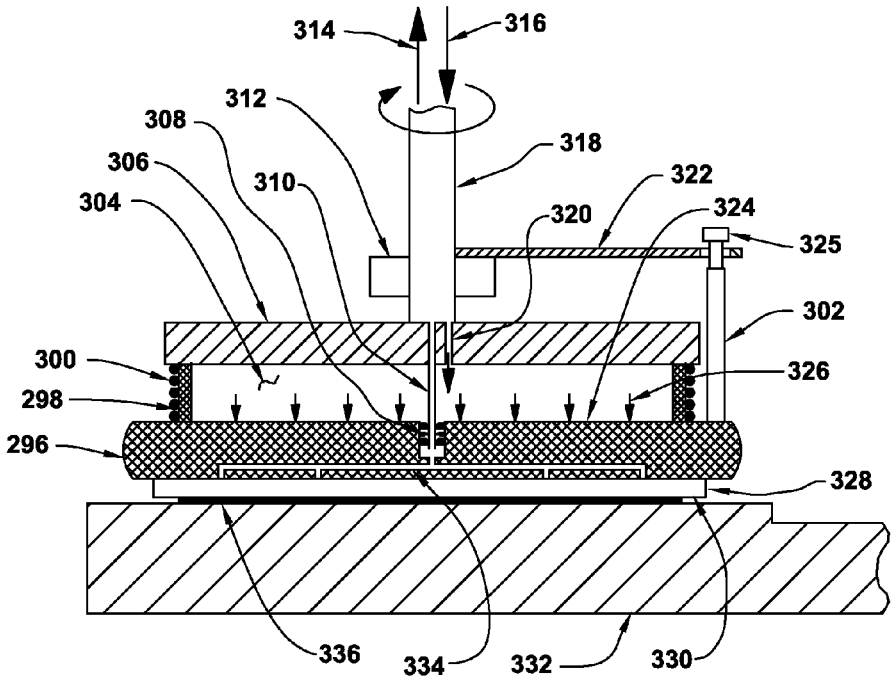
FIG. 16A is a cross section view of a slide-pin carrier having vacuum attached workpieces.

FIG. 16A is a cross section view of a sliding pin driven floating workpiece carrier having vacuum attached workpieces. A flat-surfaced workpiece 328 is attached to a floating workpiece carrier rotor 296 that is rotationally driven by an annular bracket 302 that is attached to a slide pin arm 322 that is attached to a hollow drive shaft 318. A nominally-horizontal drive plate 306 is attached to the hollow drive shaft 318 that is supported by bearings (not shown) that are supported by a stationary carrier housing (not shown) where the carrier housing can be raised and lowered in a vertical direction. A flexible coiled wire 300 reinforced elastomeric tube 298 is attached to a drive plate 306 is also attached to the workpiece carrier rotor 296 that is rotationally driven by the hollow drive shaft 318.

Pressurized air or another fluid such as water 316 is supplied through the hollow drive shaft 318 that has a fluid passage 320 that allows pressurized air or another fluid such as water 319 to enter the sealed chamber 304 that is formed by the sealed flexible elastomeric tube 298, the drive plate 306 and the workpiece carrier rotor 296. The controlled pressure of the fluid 319 present in the sealed chamber 304 provides uniform abrading pressure 326 across the full top surface 324 of the carrier rotor 296 where the uniform abrading pressure 326 pressure is directly transferred to the workpiece 328 abraded surface 330 that is in abrading contact with the abrasive 336 coating on the rotary platen 332.

Vacuum 314 is routed through the hollow drive shaft 318 and through the flexible tube 310 that slides in the flexible tube slideable seal 308 that is attached to the workpiece rotor 324 and provides vacuum 314 to the vacuum passageways 334 that provide attachment of semiconductor wafers or workpieces 328 to the workpiece rotor 296. The workpiece 328 and the workpiece carrier rotor 296 can be moved vertically and tilted as they are rotated while the vacuum 314 is maintained to keep the workpiece 328 attached to the workpiece rotor 296 because of the sliding action of the flexible tube 310 that slides in the flexible tube slideable seal 308.

Figure 17:
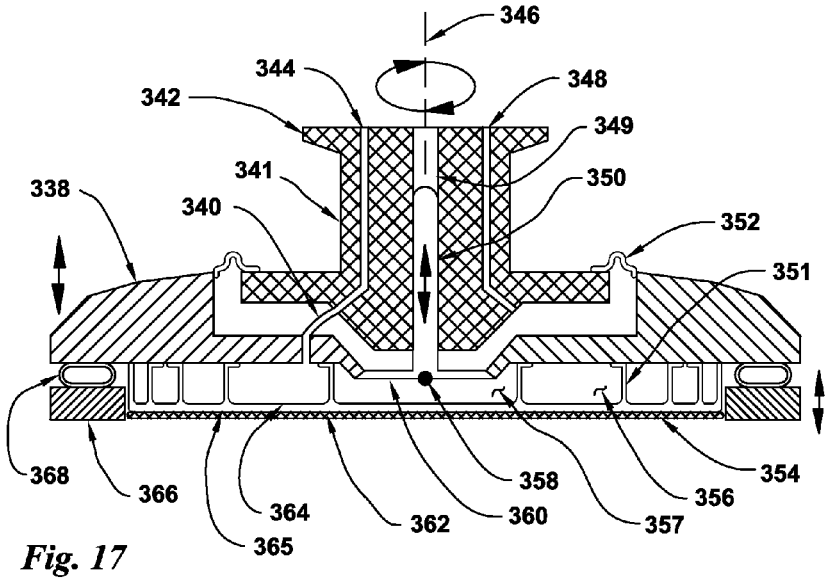
Fig. 17 Prior Art
FIG. 17 is a cross section view of a prior art pneumatic bladder type of wafer carrier.

FIG. 17 is a cross section view of a conventional prior art pneumatic bladder type of wafer carrier. A rotatable wafer carrier head 341 having a wafer carrier hub 342 is attached to the rotatable head (not shown) of a polishing machine tool (not shown) where the carrier hub 342 is loosely attached with flexible joint device 352 and a rigid slide-pin 350 to a rigid carrier plate 338. The cylindrical rigid slide-pin 350 can move along a cylindrical hole 349 in the carrier hub 342 which allows the rigid carrier plate 338 to move axially along the hole 349 where the movement of the carrier plate 338 is relative to the carrier hub 342. The rigid slide-pin 350 is attached to a flexible diaphragm 360 that is attached to carrier plate 338 which allows the carrier plate 338 to be spherically rotated about a rotation point 358 relative to the rotatable carrier hub 342 that is remains aligned with its rotational axis 346.

A sealed flexible elastomeric diaphragm device 364 has a number of individual annular sealed pressure chambers 356 having flexible elastomeric chamber walls 351 and a circular center chamber 357 where the air pressure can be independently adjusted for each of the individual chambers 356, 357 to provide different abrading pressures to a wafer workpiece 354 that is attached to the wafer mounting surface 365 of the elastomeric diaphragm 364. A wafer 354 carrier annular back-up ring 366 provides containment of the wafer 354 within the rotating but stationary-positioned wafer carrier head 341 as the wafer 354 abraded surface 362 is subjected to abrasion-friction forces by the moving abrasive coated platen (not shown). An air-pressure annular bladder 368 applies controlled contact pressure of the wafer 354 carrier annular back-up ring 366 with the platen abrasive coating surface. Controlled-pressure air is supplied from air inlet passageways 344 and 396 in the carrier hub 342 to each of the multiple flexible pressure chambers 356, 357 by flexible tubes 340.

When CMP polishing of wafers takes place, a resilient porous CMP pad is saturated with a liquid loose-abrasive slurry mixture and is held in moving contact with the flat-surfaced semiconductor wafers to remove a small amount of excess deposited material from the top surface of the wafers. The wafers are held by a wafer carrier head that rotates as the wafer is held in abrading contact with the CMP pad that is attached to a rotating rigid platen. Both the carrier head and the pad are rotated at the same slow speeds.

The pneumatic-chamber wafer carrier heads typically are constructed with a flexible elastomer membrane that supports a wafer where five individual annular chambers allow the abrading pressure to be varied across the radial surface of the wafer. The rotating carrier head has a rigid hub and a floating wafer carrier plate that has a "spherical" center of rotation where the wafer is held in flat-surfaced abrading contact with a moving resilient CMP pad. A rigid wafer retaining ring that contacts the edge of the wafer is used to resist the abrading forces applied to the wafer by the moving pad.

Figure 18:
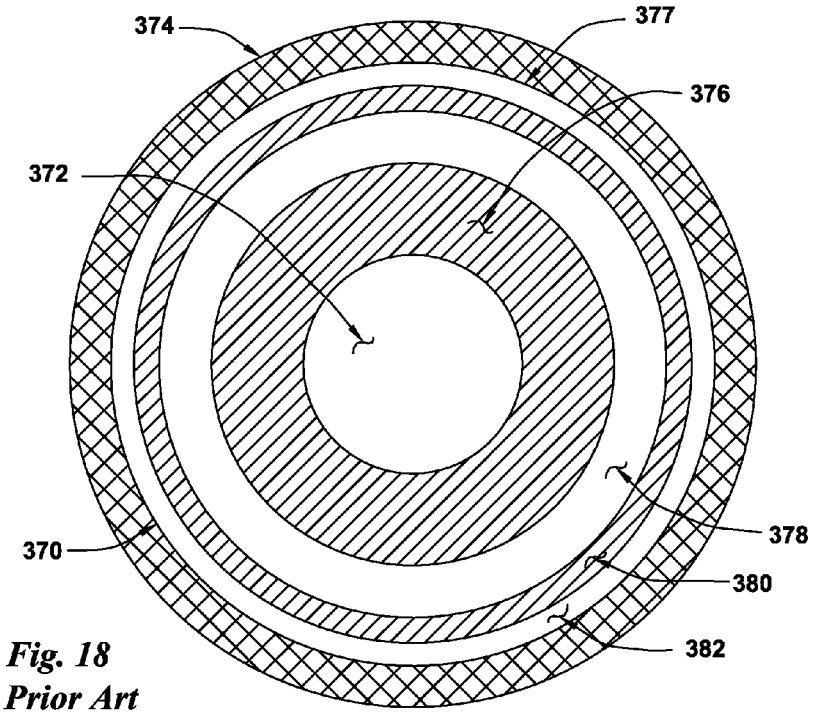
Fig. 18 Prior Art
FIG. 18 is a bottom view of a prior art pneumatic bladder type of wafer carrier.

FIG. 18 is a bottom view of a conventional prior art pneumatic bladder type of wafer carrier. A wafer carrier head 374 having an continuous nominally-flat surface elastomeric diaphragm 377 is shown having multiple annular pneumatic pressure chamber areas 376, 378, 380, 382 and one circular center pressure chamber area 372. The wafer carrier head 374 can have more or less than five individual pressure chambers. A wafer carrier head 374 annular back-up ring 370 provides containment of the wafer (not shown) within the wafer carrier head 374 as the wafer (not shown) that is attached to the continuous nominally-flat surface of the elastomeric diaphragm device 377 is subjected to abrasive friction forces. Here, the semiconductor wafer substrate is loosely attached to a flexible continuous-surface of a membrane that is attached to the rigid portion of the substrate carrier. Multiple pneumatic air-pressure chambers that exist between the substrate mounting surface of the membrane and the rigid portion of the substrate carrier are an integral part of the carrier membrane.

Each of the five annular pneumatic chambers shown here can be individually pressurized to provide different abrading pressures to different annular portions of the wafer substrate. These different localized abrading pressures are provided to compensate for the non-uniform abrading action that occurs with this wafer polishing system.

The flexible semiconductor wafer is extremely flat on both opposed surfaces. Attachment of the wafer to the carrier membrane is accomplished by pushing the very flexible membrane against the flat backside surface of a water-wetted wafer to drive out all of the air and excess water that exists between the wafer and the membrane. The absence of an air film in this wafer-surface contact are provides an effective suction-attachment of the wafer to the carrier membrane surface. Sometimes localized "vacuum pockets" are used to enhance the attachment of the wafer to the flexible flat-surfaced membrane.

Each of the five annular pressure chambers expand vertically when pressurized. The bottom surfaces of each of these chambers move independently from their adjacent annular chambers. By having different pressures in each annular ring-chamber, the individual chamber bottom surfaces are not in a common plane if the wafer is not held in flat-surfaced abrading contact with a rigid abrasive surface. If the abrasive surface is rigid, then the bottom surfaces of all of the five annular rings will be in a common plane. However, when the abrasive surface is supported by a resilient pad, each individual pressure chamber will distort the abraded wafer where the full wafer surface is not in a common plane. Resilient support pads are used both for CMP pad polishing and for fixed-abrasive web polishing.

Because of the basic design of the flexible membrane wafer carrier head that has five annular zones, each annular abrading pressure-controlled zone provides an "average" pressure for that annular segment. This constant or average pressure that exist across the radial width of that annular pressure chamber does not accurately compensate for the non-linear wear rate that actually occurs across the radial width of that annular band area of the wafer surface.

Overall, this flexible membrane wafer substrate carrier head is relatively effective for CMP pad polishing of wafers. Use of it with resilient CMP pads require that the whole system be operated at very low speeds, typically at 30 rpm. However, the use of this carrier head also causes many problems results in non-uniform material removal across the full surface of a wafer.

Figure 19:
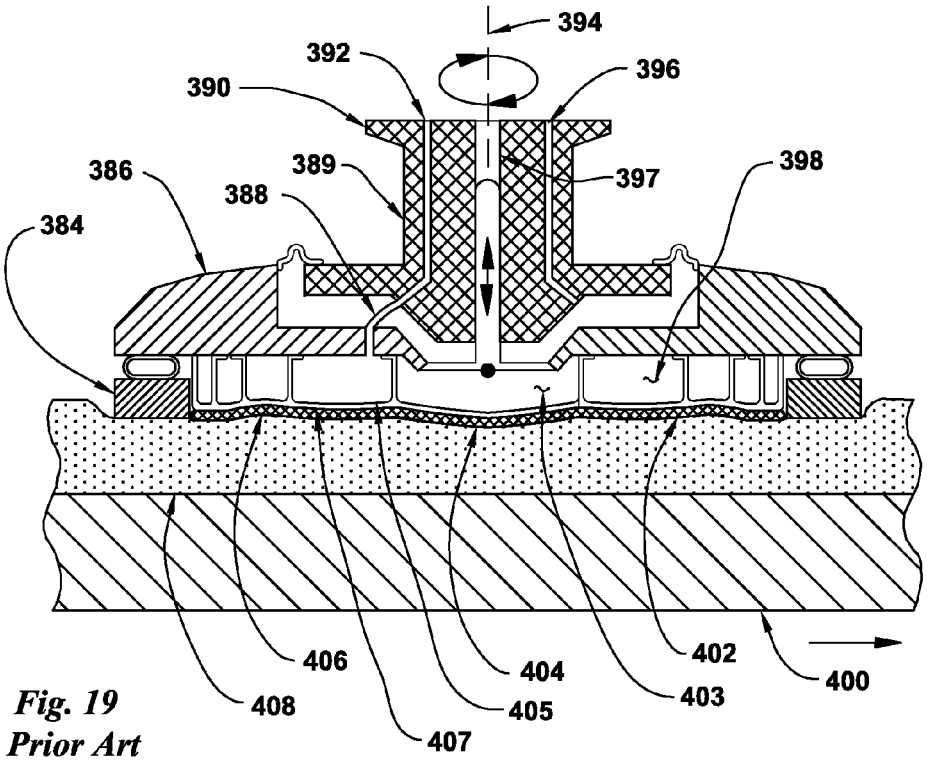
Fig. 19 Prior Art
FIG. 19 is a cross section view of a prior art bladder wafer carrier with a distorted bottom.

FIG. 19 is a cross section view of a prior art pneumatic bladder type of wafer carrier with a distorted bottom surface. A rotatable wafer carrier head 389 having a wafer carrier hub 390 is attached to the rotatable head (not shown) of a wafer polishing machine tool (not shown) where the carrier hub 390 is loosely attached with flexible joint devices and a rigid slide-pin to a rigid carrier plate 386. The cylindrical rigid slide-pin can move along a cylindrical hole 397 in the carrier hub 390 which allows the rigid carrier plate 386 to move axially along the hole 397 where the movement of the carrier plate 386 is relative to the carrier hub 390. The rigid slide-pin is attached to a flexible diaphragm that is attached to carrier plate 386 which allows the carrier plate 386 to be spherically rotated about a rotation point relative to the rotatable carrier hub 390 that is remains aligned with its rotational axis 394.

A sealed flexible elastomeric diaphragm device 405 having a nominally-flat but flexible wafer 402 mounting surface 407 has a number of individual annular sealed pressure chambers 398 and a circular center chamber 403 where the air pressure can be independently adjusted for each of the individual chambers 398, 403 to provide different abrading pressures to a wafer workpiece 402 that is attached to the wafer mounting surface 407 of the elastomeric diaphragm 405. A wafer 402 carrier annular back-up ring 384 provides containment of the wafer 402 within the rotating but stationary-positioned wafer carrier head 389 as the wafer 402 abraded surface 406 is subjected to abrasion-friction forces by the moving abrasive coated platen (not shown). An air-pressure annular bladder applies controlled contact pressure of the wafer 402 carrier annular back-up ring 384 with the platen abrasive coating surface. Controlled-pressure air is supplied from air inlet passageways 392 and 396 in the carrier hub 390 to each of the multiple flexible pressure chambers 398, 403 by flexible tubes 388.

When air, or other fluids such as water, pressures are applied to the individual sealed pressure chambers 398, 403, the flexible bottom wafer mounting surface 407 of the elastomeric diaphragm 405 is deflected different amounts in the individual annular or circular bottom areas of the sealed pressure chambers 398, 403 where the nominally-flat but flexible wafer 402 is distorted into a non-flat condition as shown by 404 as the wafer 402 is pushed downward into the flexible and resilient CMP pad 408 which is supported by a rigid rotatable platen 400.

When the multi-zone wafer carrier is used to polish wafer surfaces with a resilient CMP abrasive slurry saturated polishing pad, the individual annular rings push different annular portions of the wafer into the resilient pad. Each of the wafer carrier air-pressure chambers exerts a different pressure on the wafer to provide uniform material removal across the full surface of the wafer. Typically the circular center of the wafer carrier flexible diaphragm has the highest pressure. This high-pressure center-area distorts the whole thickness of the wafer as it is forced deeper into the resilient CMP wafer pad. Adjacent annular pressure zones independently distort other portions of the wafer.

Here, the wafer body is substantially distorted out-of-plane by the independent annual pressure chambers. However, the elastomer membrane that is used to attach the wafer to the rotating wafer carrier is flexible enough to allow the individual pressure chambers to flex the wafer while still maintaining the attachment of the wafer to the membrane. As the wafer body is distorted, the distorted and moving resilient CMP pad is thick enough to allow this out-of-plane distortion to take place while providing polishing action on the wafer surface.

When a wafer carrier pressure chamber is expanded downward, the chamber flexible wall pushes a portion of the wafer down into the depths of the resilient CMP pad. The resilient CMP pad is compressible and acts as an equivalent series of compression springs. The more that a spring is compressed, the higher the resultant force is. The compression of a spring is defined as F=KX where F is the spring force, K is the spring constant and X is the distance that the end of the spring is deflected.

The CMP resilient pads have a stiffness that resists wafers being forced into the depths of the pads. Each pad has a spring constant that is typically linear. In order to develop a higher abrading pressure at a localized region of the flat surface of a wafer, it is necessary to move that portion of the wafer down into the depth of the compressible CMP pad. The more that the wafer is moved downward to compresses the pad, the higher the resultant abrading force in that localized area of the wafer. If the spring-like pad is not compressed, the required wafer abrading forces are not developed.

Due to non-uniform localized abrading speeds on the wafer surface, and other causes such as distorted resilient pads, it is necessary to compress the CMP pad different amounts at different radial areas of the wafer. However, the multi-zone pressure chamber wafer carrier head has abrupt chamber-bottom membrane deflection discontinuities at the annular joints that exist between adjacent chambers having different chamber pressures. Undesirable wafer abrading pressure discontinuities exist at these membrane deflection discontinuity annular ring-like areas.

Often, wafers that are polished using the pneumatic wafer carrier heads are bowed. These bowed wafers can be attached to the flexible elastomeric membranes of the carrier heads. However, in a free-state, these bowed wafers will be first attached to the center-portion of the carrier head. Here, the outer periphery of the bowed wafer contacts the CMP pad surface before the wafer center does. Pressing the wafer into forced contact with the CMP pad allows more of the wafer surface to be in abrading contact with the pad. Using higher fluid pressures in the circular center of the carrier head chamber forces this center portion of the bowed wafer into the pad to allow uniform abrading and material removal across this center portion of the surface of the wafer. There is no defined planar reference surface for abrading the surface of the wafer.

Figure 20:
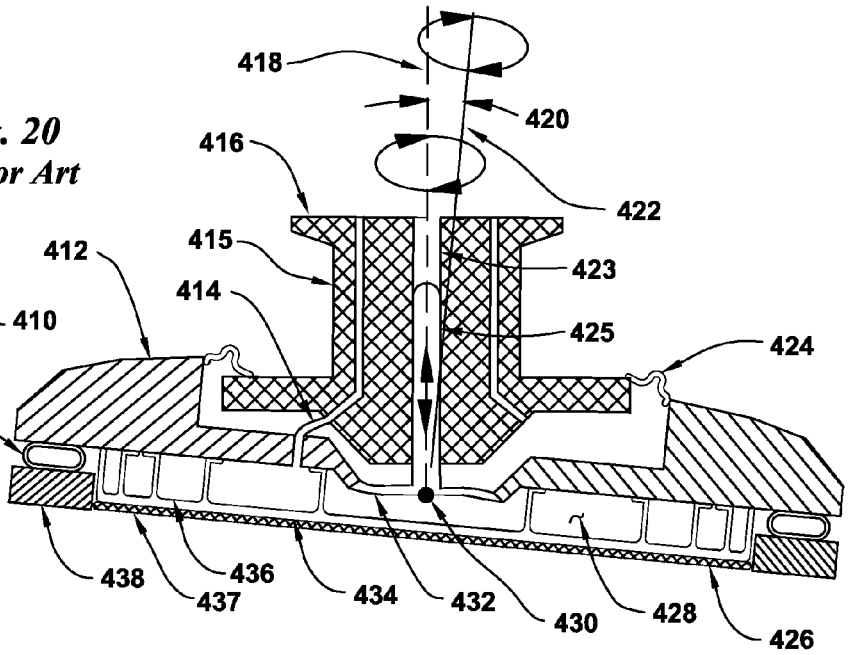
Fig. 20 Prior Art
FIG. 20 is a cross section view of a prior art bladder type of wafer carrier with a tilted wafer.

FIG. 20 is a cross section view of a prior art pneumatic bladder type of wafer carrier head with a tilted wafer carrier. The pneumatic-chamber carrier head is made up of two internal parts to allow "spherical-action" motion of the floating annular plate type of substrate carrier that is supported by a rotating carrier hub. The floating substrate carrier plate is attached to the rotating drive hub by a flexible elastomeric or a flexible metal diaphragm at the top portion of the hub. This upper elastomeric diaphragm allows approximate-spherical motion of the substrate carrier to provide flat-surfaced contact of the wafer substrate with the "flat" but indented resilient CMP pad. The CM pad is saturated with a liquid abrasive slurry mixture.

To keep the substrate nominally centered with the rotating carrier drive hub, a stiff (or flexible) post is attached to a flexible annular portion of the rigid substrate carrier structure. This circular centering-post fits in a cylindrical sliding-bearing receptacle-tube that is attached to the rotatable hub along the hub rotation axis. When misalignment of the polishing tool (machine) components occurs or large lateral friction abrading forces tilt the carrier head, the flexible centering post tends to slide vertically along the length of the carrier head rotation axis. This post-sliding action and out-of-plane distortion of the annular diaphragm that is attached to the base of the centering posts together provide the required "spherical-action" motion of the rigid carrier plate. In this way, the surface of the wafer substrate is held in flat-surfaced contact with the nominal-flatness of the CMP pad as the carrier head rotates.

Here, the "spherical action" motion of the substrate carrier depends upon the localized distortion of the structural member of the carrier head. This includes diaphragm-bending of the flexible annular base portion of the rigid substrate carrier which the center-post shaft is attached to. All of these carrier head components are continuously flexed upon each rotation of the carrier head which often requires that the wafer substrate carrier head is typically operated at very slow operating speeds of only 30 rpm.

A rotatable wafer carrier head 415 having a wafer carrier hub 416 is attached to the rotatable head (not shown) of a polishing machine tool (not shown) where the carrier hub 416 is loosely attached with flexible joint device 424 and a rigid slide-pin 425 to a rigid carrier plate 412. The cylindrical rigid slide-pin 425 can move along a cylindrical hole 423 in the carrier hub 416 which allows the rigid carrier plate 412 to move axially along the hole 423 where the movement of the carrier plate 412 is relative to the carrier hub 416. The rigid slide-pin 425 is attached to a flexible diaphragm 432 that is attached to the carrier plate 412 which allows the carrier plate 412 to be spherically rotated about a rotation point 430 relative to the rotatable carrier hub 416 that is remains aligned with its rotational axis 346.

The carrier plate 412 is shown spherically rotated about a rotation point 430 relative to the rotatable carrier hub 416 where the slide-pin axis 418 is at a tilt-angle 420 with an axis 422 that is perpendicular with the wafer 426 abraded surface 434 and where the carrier plate 412 and the wafer 426 are shown here to rotate about the axis 422. The flexible diaphragm 432 that is attached to the carrier plate 412 is distorted when the carrier plate 412 is spherically rotated about a rotation point 430 relative to the rotatable carrier hub 416.

A sealed flexible elastomeric diaphragm device 436 has a number of individual annular sealed pressure chambers 428 and a circular center chamber where the air pressure can be independently adjusted for each of the individual chambers 428 to provide different abrading pressures to a wafer workpiece 426 that is attached to the wafer mounting surface 437 of the elastomeric diaphragm 436. A wafer 426 carrier annular back-up ring 438 provides containment of the wafer 426 within the rotating but stationary-positioned wafer carrier head 415 as the wafer 426 abraded surface 434 is subjected to abrasion-friction forces by the moving abrasive coated platen (not shown). An air-pressure annular bladder 410 applies controlled contact pressure of the wafer 426 carrier annular back-up ring 438 with the platen abrasive coating surface. Controlled-pressure air is supplied from air inlet passageways in the carrier hub 416 to each of the multiple flexible pressure chambers 428 by flexible tubes 414.

The pneumatic abrading pressures that are applied during CMP polishing procedures range from 1 to 8 psi. The downward pressures that are applied by the wafer retaining ring to push-down the resilient CMP pad prior to it contacting the leading edge of the wafer are often much higher than the nominal abrading forces applied to the wafer. For a 300 mm (12 inch) diameter semiconductor wafer substrate, that has a surface area of 113 sq. inches, an abrading force of 4 psi is often applied for polishing with a resilient CMP pad. The resultant downward abrading force on the wafer substrate is 4×113=452 lbs. An abrading force of 2 psi results in a downward force of 226 lbs.

The coefficient of friction between a resilient pad and a wafer substrate can vary between 0.5 and 2.0. Here, the wafer is plunged into the depths of the resilient CMP pad. A lateral force is applied to the wafer substrate along the wafer flat surface that is a multiple of the coefficient of friction and the applied downward abrading force. If the downward force is 452 lbs and the coefficient of friction is 0.5, then the lateral force is 226 lbs. If the downward force is 452 lbs and the coefficient of friction is 2.0, then the lateral force is 904 lbs. If a 2 psi downward force is 226 lbs and the coefficient of friction is 2.0, then the lateral force is 452 lbs.

When this lateral force of 226 to 904 lbs is applied to the wafer, it tends to drive the wafer against the rigid outer wafer retaining ring of the wafer carrier head. Great care is taken not to damage or chip the fragile, very thin and expensive semiconductor wafer due to this wafer-edge contact. This wafer edge-contact position changes continually along the periphery of the wafer during every revolution of the carrier head. Also, the overall structure of the carrier head is subjected to this same lateral force that can range from 226 to 904 lbs.

All the head internal components tend to tilt and distort when the head is subjected to the very large friction forces caused by forced-contact with the moving abrasive surface. The plastic components that the pneumatic head is constructed from have a stiffness that is a very small fraction of the stiffness of same-sized metal components. This is especially the case for the very flexible elastomeric diaphragm materials that are used to attach the wafers to the carrier head. These plastic and elastomeric components tend to bend and distort substantial amounts when they are subjected to these large lateral abrading friction forces.

The equivalent-vacuum attachment of a water-wetted wafer, plus the coefficient-of-friction surface characteristics of the elastomer membrane, are sufficient to successfully maintain the attachment of the wafer to the membrane even when the wafer is subjected to the large lateral friction-caused abrading forces. However, to maintain the attachment of the wafer to the membrane, it is necessary that the flexible elastomer membrane is distorted laterally by the friction forces to where the outer periphery edge of the wafer is shifted laterally to contact the wall of the rigid wafer substrate retainer ring. Because the thin wafer is constructed form a very rigid silicon material, it is very stiff in a direction along the flat surface of the wafer.

The rigid wafer outer periphery edge is continually pushed against the substrate retainer ring to resist the very large lateral abrading forces. This allows the wafer to remain attached to the flexible elastomer diaphragm flat surface because the very weak diaphragm flat surface is also pushed laterally by the abrading friction forces. Most of the lateral abrading friction forces are resisted by the body of the wafer and a small amount is resisted by the elastomer bladder-type diaphragm. Contact of the wafer edge with the retainer ring continually moves along the wafer periphery upon each revolution of the wafer carrier head.

Figure 21:
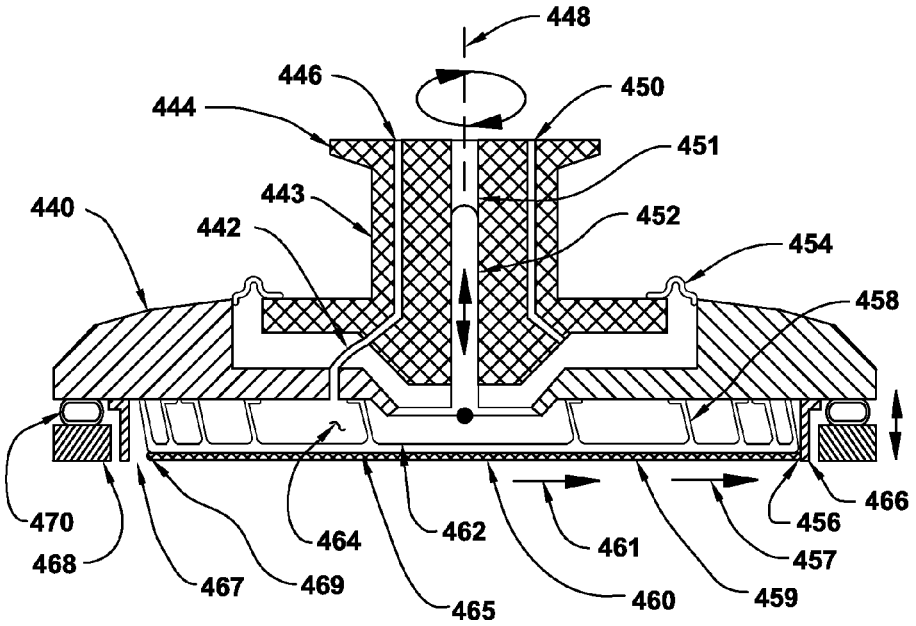
Fig. 21 Prior Art
FIG. 21 is a cross section view of a prior art bladder wafer carrier with a distorted bladder.

FIG. 21 is a cross section view of a conventional prior art pneumatic bladder type of wafer carrier where the bladder is distorted laterally by abrading friction forces. A rotatable wafer carrier head 443 having a wafer carrier hub 444 is attached to the rotatable head (not shown) of a polishing machine tool (not shown) where the carrier hub 444 is loosely attached with flexible joint device 454 and a rigid slide-pin 452 to a rigid carrier plate 440. The cylindrical rigid slide-pin 452 can move along a cylindrical hole in the carrier hub 444 which allows the rigid carrier plate 440 to move axially along the hole axis 448 which is also the rotational axis 448 of the carrier head 443 where the movement of the carrier plate 440 is relative to the carrier hub 444. The rigid slide-pin 452 is attached to a flexible diaphragm that is attached to carrier plate 440 which allows the carrier plate 440 to be spherically rotated about a rotation point relative to the rotatable carrier hub 444 that is remains aligned with its rotational axis 448.

A sealed flexible elastomeric diaphragm device 462 has a number of individual annular sealed pressure chambers 464 and a circular center chamber where the air pressure can be independently adjusted for each of the individual chambers 464 to provide different abrading pressures to a wafer workpiece 460 that is attached to the wafer mounting surface 465 of the elastomeric diaphragm 462. A wafer 460 carrier annular back-up ring 468 provides containment of the wafer 460 within the rotating but stationary-positioned wafer carrier head 443 as the wafer 460 abraded surface 459 is subjected to abrasion-friction forces 461 by the moving abrasive coated platen (not shown). An air-pressure annular bladder 470 applies controlled contact pressure of the wafer 460 carrier annular back-up ring 468 with the platen abrasive coating surface. Controlled-pressure air is supplied from air inlet passageways 446 and 450 in the carrier hub 444 to each of the multiple flexible pressure chambers 464 by flexible tubes 442.

The abrading friction forces 461 act on the wafer 460 abraded surface 459 in a direction 457 that the platen abrasive coating moves where the forces 461 act on the sealed flexible elastomeric diaphragm device 462 which translates the wafer mounting surface 465 of the elastomeric diaphragm 462 and the wafer 460 where the peripheral edge 469 of the wafer 460 is forced at a location 456 against the rigid wafer retaining ring 466 that is attached to the carrier plate 440. The flexible elastomeric chamber walls 458 of the sealed flexible elastomeric diaphragm device 462 are distorted from their non-force stressed original shapes that exist when the abrading forces 461 are not present. When the wafer 460 is moved into contact with the rigid wafer retaining ring 466 at a location 456, a corresponding gap 467 exists between the peripheral edge 456 of the wafer 460 and the rigid wafer retaining ring 466 in a location that is diagonally across the abraded surface 459 from the location 456 where the wafer 460 is in forced contact with the rigid wafer retaining ring 466. The forced contact of the wafer 460 moves along the peripheral edge 456 of the wafer 460 as the wafer 460 and the wafer carrier head 443 is rotated while the wafer 460 is in abrading contact with the rotating platen abrasive coating.

Semiconductor wafers that are fabricated are intentionally made quite thick during the deposition process to allow handling during CMP polishing procedures and for the sequential surface deposition steps. Often, 40 or 50 deposition layers are made to a wafer during the wafer fabrication process. Each deposition layer thickness can be a few angstroms thick but after 4 or 5 deposition steps it is necessary to polish the surface of the wafer to remove excess deposition materials and to re-establish the global flatness of the wafer surface. Use of the resilient CMP pads to perform this wafer polishing procedure is the most common method of polishing used. After all of the deposition and polishing steps have been completed, the wafer is backside-ground to reduce the overall thickness of the wafer and the individual semiconductor devices.

When a flat-surfaced vacuum-chuck workholder having an attached wafer is pressed down into the surface-depths of a resilient CMP pad, the pad surface is distorted in the area that is directly adjacent to the outer periphery of the wafer. Here, the moving resilient pad is compressed as it is held in abrading contact with the flat surfaced wafer. The compressed CMP pad assumes a flat profile where it contacts the central portion of the circular wafer. However, the localized portion of the moving resilient CMP pad that comes into contact with the outer periphery of the rotating wafer becomes distorted. This CMP pad distortion tends to produce undesirable above-average material removal at the wafer periphery. This uneven abrading action results in non-flat wafers.

Large diameter 300 mm (12 inch) wafers being polished typically have a thickness of 0.030 inches (0.076 cm) to provide enough strength and stiffness for handling in the semiconductor fabrication process. These wafers are repetitively subjected to polishing to remove excess metal and insulating materials that are deposited on the surfaces to form the semiconductor circuits. Because the silicon wafers are brittle, and the force-contact area continually moves around the circumference of the wafer as the wafer carrier head is rotated, the wafer edge tends to be chipped or cracked by the contact of the rigid wafer with the rigid or semi-rigid wafer retainer ring.

When the multi-chamber flexible substrate-mounting elastomer material membrane is subjected to the very large 200 to 400 lb lateral abrading forces, the whole flexible membrane tends to move laterally along the direction of the applied abrading forces. These abrading forces originate from the rotating CMP pad so they are always in the same direction relative to the rotating wafer and carrier head. These abrading forces tend to drive the whole flexible membrane to the "far" downstream side of the carrier head, away from the leading edge of the carrier head that faces upstream relative to the moving CMP pad.

However, as the pneumatic carrier head rotates, these applied lateral abrading forces contact a "new" portion of the wafer flexible membrane. Here, the membrane experiences a continuing radial excursion that occurs during each revolution of the carrier head. Localized distortions of portions of the substrate membrane occur particularly at the areas of the circular wafer substrate that is nominally restrained by the carrier rigid wafer retaining ring that is attached to the carrier head and surrounds the wafer substrate membrane.

Because the carrier head presses the wafer down into the surface-depths of the rotating resilient CMP pad, the moving pad tends to distort and crumple at the leading edge of the wafer. This pad distortion tends to cause extra-wear of the wafer at the outer periphery of the wafer flat surface. To compensate for this ripple-effect of the crumpled and moving pad, an independent rigid annular carrier ring is attached at the carrier head to locally press down the indented CMP pad just before it contacts the wafer periphery. Here, the localized pad-compression caused by the outer carrier ring is typically 1 psi greater than the abrading pressure that is applied to the wafer substrate. Typically the abrading pressure that is applied across the surface of the wafer is about 2 psi and sometimes ranges up to 8 psi. The applied pressure of the pad compression ring is 1, or even much more, psi greater than that of the typical nominal wafer surface abrading pressure.

Figure 22:
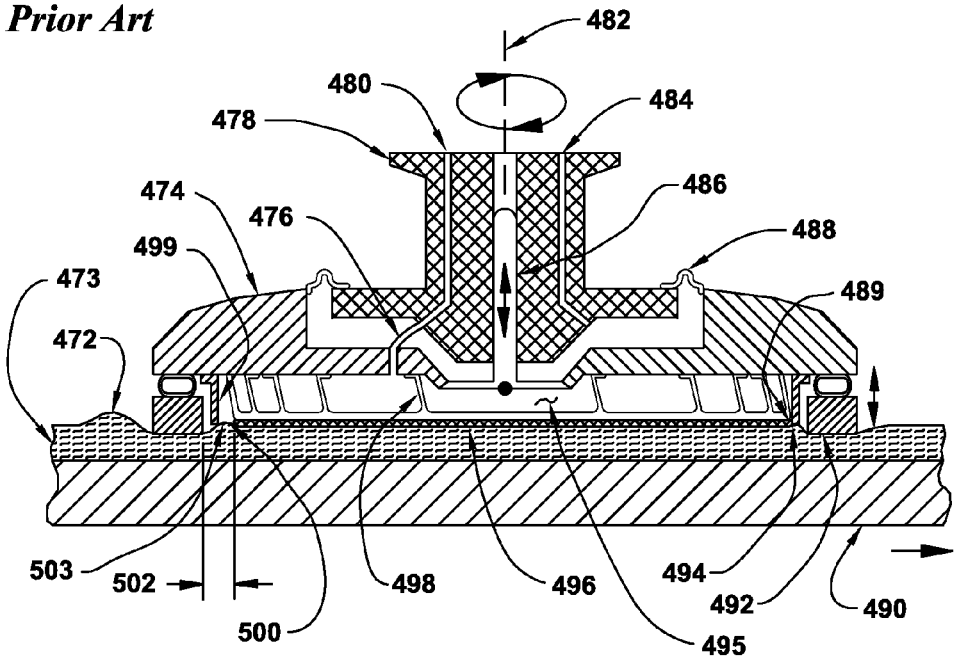
Fig. 22 Prior Art
FIG. 22 is a cross section view of a prior art carrier distorted by abrading friction forces.

FIG. 22 is a cross section view of a conventional prior art pneumatic bladder type of wafer carrier where the bladder is distorted laterally by abrading friction forces that are imposed by a moving CMP abrasive pad. A rotatable wafer carrier head 443 having a wafer carrier hub 478 is attached to the rotatable head (not shown) of a polishing machine tool (not shown) where the carrier hub 478 is loosely attached with flexible joint device 488 and a rigid slide-pin 486 to a rigid carrier plate 474. The cylindrical rigid slide-pin 486 can move along a cylindrical hole in the carrier hub 478 which allows the rigid carrier plate 474 to move axially along the hole axis 482 which is also the rotational axis 482 of the carrier head 443 where the movement of the carrier plate 474 is relative to the carrier hub 478. The rigid slide-pin 486 is attached to a flexible diaphragm that is attached to carrier plate 474 which allows the carrier plate 474 to be spherically rotated about a rotation point relative to the rotatable carrier hub 478 that is remains aligned with its rotational axis 482.

A sealed flexible elastomeric diaphragm device has a number of individual annular sealed pressure chambers 495 and a circular center chamber where the air pressure can be independently adjusted for each of the individual chambers 495 to provide different abrading pressures to a wafer workpiece 496 that is attached to the wafer mounting surface of the elastomeric diaphragm. A wafer 496 carrier annular back-up ring 492 provides containment of the wafer 496 within the rotating but stationary-positioned wafer carrier head as the wafer 496 abraded surface 459 is subjected to abrasion-friction forces by the moving abrasive coated platen 490. An air-pressure annular bladder applies controlled contact pressure of the wafer 496 carrier annular back-up ring 492 with the platen 490 abrasive CMP pad 473 surface where the CMP pad 473 is attached to the platen 490 surface. Controlled-pressure air is supplied from air inlet passageways 480 and 484 in the carrier hub 478 to each of the multiple flexible pressure chambers 495 by flexible tubes 476.

The abrading friction forces act on the wafer 496 abraded surface in a direction that the platen 490 abrasive CMP pad 473 moves where the forces act on the sealed flexible elastomeric diaphragm device which translates the wafer mounting surface of the elastomeric diaphragm and the wafer 496 where the peripheral edge 489 of the wafer 496 is forced at a location 494 against the rigid wafer retaining ring 499 that is attached to the carrier plate 474. The flexible elastomeric chamber walls 498 of the sealed flexible elastomeric diaphragm device are distorted from their non-force stressed original shapes that exist when the abrading forces are not present.

When the wafer 496 is moved into contact with the rigid wafer retaining ring 499 at a location 494, a corresponding gap 467 exists between the peripheral edge 494 of the wafer 496 and the rigid wafer retaining ring 499 in a location that is diagonally across the abraded surface from the location 494 where the wafer 496 is in forced contact with the rigid wafer retaining ring 499. The forced contact of the wafer 496 moves along the peripheral edge 494 of the wafer 496 as the wafer 496 and the wafer carrier head 443 is rotated while the wafer 496 is in abrading contact with the rotating platen abrasive CMP pad 473. There is a gap distance 502 between the wafer 496 peripheral edge 489 and the wafer 496 carrier annular back-up ring 492 at the location that is diagonally across the abraded surface from the location 494 where the wafer 496 is in forced contact with the rigid wafer retaining ring 499 where the CMP pad 473 has a top surface distortion 503 in the gap distance 502 due to the wafer 496 being forced into the surface depths of the CMP pad 473. Another CMP pad surface distortion 472 exists upstream of the wafer 496 carrier annular back-up ring 492 as the moving CMP pad 473 is forced against the wafer 496 carrier annular back-up ring 492.

The effect of the pneumatic carrier head CMP pad compression ring is helpful but over-wear still occurs at the outer periphery of the wafer. To compensate for this, two separate, but closely adjacent, annular pressure chambers are made a part of the flexible substrate membrane. The localized pressure in each of these chamber zones is controlled independently to correct for the uneven abrading wear there caused by the distorted resilient CMP pad.

The resilient CMP pad has significant surface distortions at the leading edge of the wafer where the moving pad contacts the wafer. Lateral abrading friction surface forces push the wafer and the carrier head flexible wafer-attachment membrane away form the wafer retaining ring at this wafer leading edge location. The movement of the wafer away from the wafer retaining ring at this location produces a gap between the wafer leading edge and the retaining ring. The surface of the compressed resilient CMP pad tends to distort in this gap which creates extra-high abrading pressures at the leading edge of the wafer. These high abrading pressures at the outer periphery of the wafer tends to produce over-wear of the wafer in this annular peripheral region. Almost all wafers that are polished with the resilient CMP abrasive slurry pads have non-flat outer periphery bands that are highly undesirable, due to this pad distortion effect.

The wafer carrier heads have rigid wafer carrier plate that has a spherical center of rotation that is offset a distance from the abraded surface of the wafer. When the wafer is polished, the large abrading lateral friction force acts along the abraded surface of the wafer. This friction force can range from 200 to 900 lbs. Because the friction force is applied at an offset pivot distance from the spherical center of rotation, this friction force tends to tilt the wafer as it is being polished. Tilting the wafer as it is being abraded can cause the wafer to have an undesirable non-flat surface.

This same "spherical-action" motion of the rigid carrier head plate occurs when this wafer carrier head is used to CMP polish wafers that contact the flat abrasive surface of a fixed-abrasive raised-island web that is supported by a flat-surfaced rotation platen. Because the centering post is used to transmit the large lateral friction force to the carrier drive hub (the flexible elastomer top diaphragms are very weak), the centering post must be large enough and stiff enough to transmit these large lateral abrading friction forces. Also, it is necessary for the centering post to slide along the axis of the carrier drive hub to allow the substrate carrier to move vertically to provide translation for making and separating abrading contact of the substrate with the CMP pad.

Air or water pressure can be applied to different parts of a pneumatic wafer carrier head. The overall "global" total abrading force on a wafer can be controlled by applying fluid pressure to the rigid carrier plate. This carrier plate supports the flexible wafer attachment membrane. Then regional annular chambers of the flexible wafer membrane can be independently pressurized to apply different abrading pressures to different radial portions of the wafer. These independent pneumatic chambers expand and contract in reaction to the air pressure applied to each one. Each of the annular abrading pressure-controlled zones provides an "average" pressure for that annular segment to compensate for the non-linear wear rate that occurs in the annular band area of the wafer surface.

The very inner circular portion of the wafer typically experiences a very low abrading wear rate. This occurs often because of the localized very slow abrading speed that exists at the center portion of a rotating wafer. To compensate for the slow abrading rate at the center of the wafer, a circular pressurized chamber in the wafer substrate membrane is used to apply an extra-high abrading force at the center of the wafer. This higher pressure compensates for the low abrading speed with the result that uniform material removal is provided at the center of the wafer.

Separation of a wafer from the flexible membrane after the wafer polishing has been completed can be difficult because of the adhesion of the water-wetted wafer to the flexible membrane. To help wafer separation, special low friction coatings can be applied to the membrane flat surface to diminish the wafer-adhesion effect of the smooth-surfaced membrane elastomer material. Expansion of individual annular pressure chambers is often used to distort localized portions of the bottom flat surface of the wafer membrane enough that the rigid flat-surfaced wafer is separated from the membrane.

When higher localized abrading pressures are applied at the center of the wafer to equalize wafer-surface material removal, this increased pressure tends to cause overheating of the center portion of a wafer. Higher abrading pressures cause more abrading-friction heating of that portion of the wafer. This over-heating of the wafer center also raises the temperature of the annular portion of the rotating CMP pad that contacts the high-temperature center portion of the wafer. Thermal scans of the rotating CMP pad that is being subjected to abrading with this type of wafer carrier head shows a distinct annular band of the pad having high temperature which correspond to the location of the rotating wafer as it is held in abrading contact with the rotating pad.

Heat transfer across the full surface of the pad is quite ineffective in reducing the temperature differential across the radial width of the rotating pad. Due to the characteristics of the pad system, the porous foam resilient pad is relatively thick and acts as an insulator. This prevents heat generated on the pad exposed surface from being transferred to the rotary rigid metal platen that the pad is mounted on.

Also, very small quantities of fresh, new, and cool, liquid abrasive slurry mixture are applied to the rotating pad surface. This added slurry liquid does little to cool the pad hot-spot annular areas because the cool slurry is applied uniformly across the radial width of the pad as it rotates. Here, the hot annular band on the pad remains at a higher temperature than adjacent annular areas of the pad that are subjected to lower abrading pressures by the annular-segmented wafer carrier head. These low-pressure annular areas of the pad experience less abrading friction where less friction heat is generated and these annular areas of the pad run cooler than the high abrading pressure areas of the pad.

To reach equilibrium material removal conditions for wafer polishing due to annular temperature gradients across the radial width of the pad, it is often necessary to process up to 100 wafers to reach this equilibrium. The pressure settings for the individual annular zones are different at the start-up of a wafer polishing tool (machine) operation after the polishing tool has been at rest for some time. After many wafers are continually processed in sequence, thermal equilibrium of the pad (and wafer) is reached and the zoned pressure settings are stabilized.

These pneumatic wafer carrier heads are also used with a fixed-abrasive web that is stretched across the flat surface of a rotating platen. Both the carrier head and the abrasive web are typically rotated at the same speeds.

Because of the extreme difficulty of providing and maintaining precision alignment substrate carrier wafer mounting surface and a flat-surfaced abrading surface, resilient support pads are used for both fixed-abrasive web systems and the CMP pad loose-abrasive polishing systems. In the case of the CMP pad, the resilient pad provides global support across the full surface of the wafer. The resilient CMP pad also provides localized support of the abrasive media to compensate for out-of-plane defects on the wafer surface and for out-of-plane defects of the CMP pad itself.

In the case of the fixed-abrasive island-type web, a resilient pad is positioned between a non-precision flat (more than 0.0001 inches or 0.254 microns) semi-rigid but yet flexible plastic (polycarbonate) web support plate and the flat surface of a rigid rotatable platen. This semi-rigid 0.030 inch (0.0762 cm) thick polycarbonate web-support plate does not provide localized support of the abrasive web to compensate for out-of-plane defects on the wafer surface and for out-of-plane surface defects of the polycarbonate support plate itself. However, the resilient CMP pad does provide global support across the full surface of the wafer.

The pneumatic wafer carrier heads also cause significant localized distortion of the fixed-abrasive webs as the rotating carrier head traverses across the surface of the web. The resilient pad that supports the polycarbonate web-support plate is very flexible and subject to localized distortion by the very large abrading forces applied by the carrier head.

Also, the polycarbonate support plate does not have the capability to be maintained in a precision-flat condition over a long period of time. As a plastic material, the thin polycarbonate plate will tend to assume localized distortions caused by deflections from high-force (100 to 300 lb) contact with rotating carrier head as the platen that supports the abrasive-web device rotates. As the carrier head "travels" across the surface of the polycarbonate plate, that localized portion of the plate is distorted as it is pressed down into the depths of the resilient CMP during each revolution of the abrasive-web support platen.

Further, the use of different annular zones of the carrier head can result in different localized distortions of the polycarbonate web-support plate. All plastic materials such as polycarbonate and a resilient foam CMP pad have a hysteresis damping-effect where it takes some time for a plastic material to recover it original shape after it has been distorted. This means that some recovery time is required for a plastic web-support plate to assume its original localized flatness after the carrier head has passed that location. The abrading speed of this abrasive-web system is highly limited, in part, by this dimensional hysteresis-recovery consideration.

The conventional pneumatic-chamber wafer carrier heads that are in widespread use have a number of disadvantages. These pneumatic-chamber wafer carrier head devices depend on the body of the silicon wafers to resist essentially all of the abrading friction forces that are applied to the flat abraded surface of the wafer by forcing the circular wafer peripheral edge into running contact with a circular rigid wafer retainer ring that surrounds the wafer.

By comparison, the wafer carrier heads described here prevent running contact of the wafer edge with a rigid body as the wafer is rotated. Instead, a circular wafer workpiece is attached and temporarily bonded to the flat surface of a circular rigid wafer carrier rotor disk. The outer periphery of the circular carrier rotor contacts a set of multiple stationary roller idlers as the carrier rotor and the attached wafer rotate during an abrading procedure. The abrading forces that are applied to the rotating wafer abraded surface are transmitted by the adhesive-type bond of the wafer to the wafer carrier rotor which transmits these abrading forces to the stationary roller idlers. The temporary bond of the wafer to the wafer carrier can be accomplished with the use of vacuum or a low-tack adhesive. There is no motion of the wafer substrate workpiece relative to the flat surface of the wafer carrier rotor during the abrading procedures as the wafer is structurally bonded to the wafer carrier rotor during the time of the abrading procedure. After the wafer surface abrading procedure is completed, the wafer is separated form the wafer carrier surface.

The flexible elastomer diaphragm wafer holder is designed to be weak or compliant with little stiffness in a lateral direction that is parallel to the wafer abraded surface. When the typical large abrading forces are applied to the wafer that is attached to the elastomer diaphragm, these friction forces distort the diaphragm by moving the lower portion of the diaphragm laterally. Here, the silicon semiconductor wafer that is very rigid in the direction parallel to the abraded surface of the wafer is used as the supporting member that minimizes the distortion of the elastomer wafer carrier diaphragm. However, most all of the lateral friction forces that are applied to the wafer are resisted when the circular rigid wafer peripheral edge contacts the rigid circular wafer retaining ring at a single point on the wafer peripheral edge.

The abrading friction forces are consistently aligned in the same direction relative to the abrading machine as they originate on the abraded surface of the rotary platen as it rotates. However, the wafer also rotates independently as this constant-direction friction force is imposed on it. Because the "stationary" fixed-position wafer rotates, the friction force is continually applied in a different direction relative to a specific location on the wafer. Rotation of the wafer results in the wafer peripheral edge being contacted at a single-point position that "moves" around the periphery of the wafer. This single-point contact moves around the full circumference of the wafer for each revolution of the wafer.

The wafer outside diameters are smaller than the inside diameters of the rigid wafer retaining rings to allow the wafers to be inserted into the retaining ring at the start of a wafer lapping or polishing procedure. Because the wafers are smaller than the retaining rings, there is a gap between the wafer outside periphery edge and the retaining ring at a position that is diagonally across the wafer abraded surface from the point where the wafer is driven against the retainer ring by the abrading friction force.

Rotation of the abraded wafer results in the wafer actively moving laterally where the rigid but fragile silicon wafer edge is driven to impact the rigid wafer retaining ring. This wafer impact action often results in chipping of the wafer edge. Also, this wafer impact action tends to produce uneven wear of the inside diameter of the rigid retainer ring. In order to sustain this wafer-edge impact action without wafer damage, the wafer thickness must be made sufficiently thick to provide sufficient strength and stiffness to resist the very large and changing abrading friction forces. Typically the wafers have a thickness of 0.030 inches (0.76 mm) to provide the required thickness of the wafer and to minimize chipping of the fragile wafer edge. After a wafer is fully processed to provide the semiconductor circuits, the wafers are typically back-side ground down to a wafer thickness of less than 0.005 inches (0.127 mm).

The lateral abrading friction forces for a 12 inch (300 mm) diameter wafer can easily exceed 500 lbs during a wafer polishing procedure. Most of this large friction force is resisted by the wafer edge that impacts the rigid wafer retainer ring.

The pneumatic elastomer diaphragm carrier head is typically operated very slowly at speeds of approximately 30 rpm. In order to provide sufficient abrading action wafer material removal rates, large abrading pressures are used. However, when high-speed lapping or polishing is done using raised-island abrasive disks on the wafer abrading system described here, the abrading speeds are high but the abrading pressures are very low. The low abrading pressure results in low abrading friction forces that are applied to the wafer abraded surfaces during a wafer lapping or polishing procedure. Lower abrading friction forces results in lesser wafer bonding forces that are required to maintain attachment of the wafers to the wafer carrier heads.

With the elastomeric diaphragm wafer carrier head, wafers do not have to be attached with substantial bonding strength to the surface of the bottom flat surface of the elastomeric diaphragm because essentially all of the abrading friction forces are resisted by the rigid wafer peripheral edge being forced against the rigid wafer retainer ring. There is little requirement for these abrading forces to be transferred to the very flexible and compliant wafer carrier diaphragm. In the present wafer lapping or polishing system, the wafer must be attached or adhesively bonded to the rigid circular rotatable wafer attachment plate or wafer carrier rotor with substantial wafer bonding strength where the rotor is held in a fixed wafer-rotational position by running rolling contact of the rotating wafer with stationary roller idlers mounted on the stationary wafer carrier rotor housing.

Vacuum can be used very effectively to temporarily bond the wafers to the flat surfaces of the wafer rotor carriers with substantial wafer bonding strength. For example, a vacuum induced wafer hold-down attachment force typically exceeds 1,000 lbs when using only 10 psig of vacuum on a 12 inch (300 mm) wafer that has over 100 square inches of surface area. With the system here, the wafer must be structurally bonded to the wafer carrier rotor to prevent movement of the wafer relative to the surface of the wafer rotor when large abrading forces are imposed on the wafer abraded surface.

By comparison, wafers can be "casually attached" to an elastomer diaphragm type wafer carrier having a elastomeric flat wafer mounting surface simply by using water as a wafer bonding agent. All the abrading friction forces that are applied to the wafer are resisted by the rigid wafer itself as the wafer peripheral edge contacts the rigid wafer retaining ring. The elastomeric diaphragm is very flexible in the direction of the plane of the wafer abraded surface so little bonding force is required to keep the wafer successfully bonded to the surface of the flexible elastomeric diaphragm. Here, the elastomeric device distorts to allow the diaphragm bottom flat wafer-mounting surface to simply move along with the attached wafer toward the wafer retainer ring as the wafer rotates. The wafer water-adhesion of the wafer to the diaphragm bottom flat wafer-mounting surface only has to be strong enough to distort the flexible and weak elastomeric diaphragm device as the abrading friction continually moves the wafer into point contact with the wafer retaining ring.

When a rigid wafer rotor is used, the wafer attachment surface of the rotor is preferred to be flat within 0.0001 inches (2.5 microns) to assure that the uniform abrading of a wafer surface takes place when it is abraded by a rigid abrading surface.

Single or multiple individual workpieces such as small-sized wafers or other workpieces including lapped or polished optical devices or mechanical sealing devices can be adhesively attached to a flexible polymer or metal backing sheet. This flexible sheet backing can then be attached with substantial bonding force to the rotatable workpiece rotor with vacuum. These flexible adhesive backing sheets can be easily separated from the rotor after the lapping or polishing is completed by peeling-away the flexible attachment sheet from the individual workpieces.

There are a number of different embodiments of spherical-action rotary workholder devices that offer great simplicity and flexibility for lapping or polishing operations. They can also be used effectively to provide very substantial increases of production speeds as compared to conventional systems used for lapping, polishing and abrading operations. Substantial cost savings are experienced by using these air bearing carriers that allow these abrading processes to be successfully speeded-up.

The flexibility of the conventional elastomeric pneumatic-chamber wafer carrier heads have a substantial disadvantage in that the vertical walls of the elastomeric chambers are very weak in a lateral or horizontal direction that is perpendicular to the vertical chamber walls. The abrading pressures and vacuum that are applied to these sealed chambers are typically very small, in part, to avoid very substantial lateral or horizontal deflections of the relatively tall but thin weak elastomer walls. Often, these applied abrading pressures range from 1 to 2 psi and the negative pressures of vacuum are also limited. These elastomeric chamber walls do not have support devices that effectively limit their lateral distortions due to abrading pressures or applied vacuum negative pressures.

It is very desirable to have higher abrading pressures that can range up to 10 psi or more to provide higher rates of material removal by abrading which are directly proportional to the applied abrading pressures as formulated by Preston's abrading equation which is well known in the abrasive industry. It is also highly desirable to have higher vacuum negative pressures to provide fast-response withdrawal of a workpiece from a fast-moving abrasive surface during certain abrading procedure events. The sealed abrading-chamber wire-reinforced elastomeric tubes described here that are flexible axially along the length of the tubes but provide radial stiffness of the tubes to resist substantial lateral distortion of the elastomeric tubes allow the use of high chamber abrading pressures and high levels of vacuum.

Figure 23:
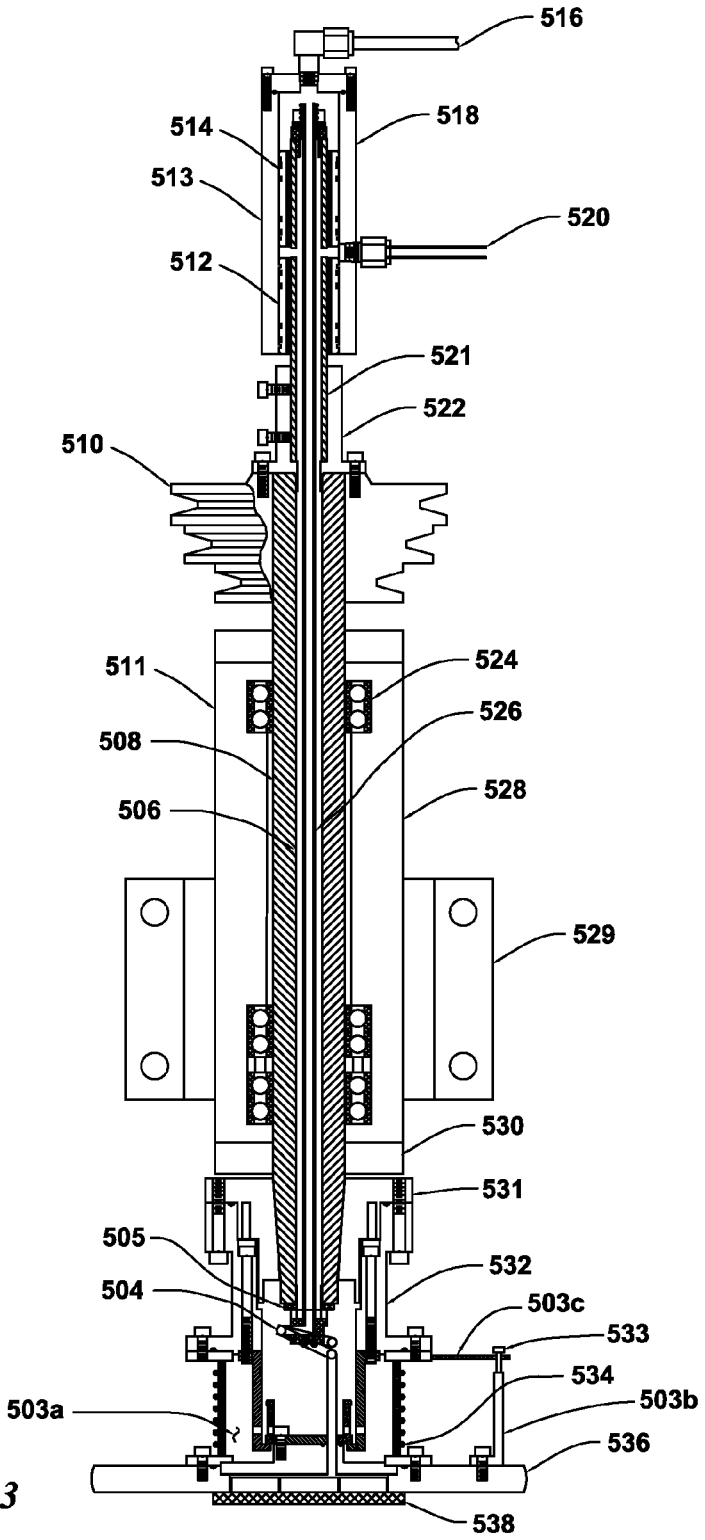
FIG. 23 is a cross section view of a slide pin carrier supported by a driven spindle.

FIG. 23 is a cross section view of a sliding pin annular flexible reinforced elastomeric tube floating workpiece carrier that is supported by a driven spindle. The workpiece rotor 536 has an outer diameter having a spherical-shaped surface that is supported laterally (horizontally) by idlers (not shown). The workpiece rotor 536 has a vacuum-attached workpiece 538 and the rotor 536 is attached to a rotary workpiece carrier housing 532 by a sliding pin drive arm 503*c* that is in sliding contact with a sliding pin 533 that is attached to a sliding pin bracket 503*b* that is attached to the workpiece rotor 536 where the sliding pin 533 moves in a vertical direction along the axis of the rotary spindle 511 rotary spindle shaft 508. The sliding pin drive device 503*c* is stiff in a tangential direction relative to the axis of the rotary spindle 511 rotary spindle shaft 508 where the sliding pin drive device 503*c* provides rotation of the workpiece rotor 536.

The cylindrical cartridge-type spindle 511 that is supported by a clamp-type device 529 has a V-belt pulley 510 attached to the spindle shaft 508 where the spindle shaft 508 rotates the rotary carrier housing 532 and the flexible reinforced elastomeric tube 534 that is attached to the spindle drive shaft 508. The flexible reinforced elastomeric tube 534 flexes in a vertical direction along the axis of the rotary spindle 511 rotary spindle shaft 508. The spindle 511 v-belt pulley 510 is driven by a drive motor (not shown) and rotary drive torque is transmitted to the floating workpiece carrier rotor 536 by the sliding pin drive device 503*c*.

Vacuum is supplied to the spindle 511 at the stationary hollow tube 516 that is supported by the air bearing housing 518 where the vacuum applied at the vacuum tube 516 is routed through a hollow tube 526 to a pneumatic adapter device 505 which supplies vacuum through a flexible tube 504 to the floating workpiece carrier rotor 536 to attach the workpiece 538 to the carrier rotor 536. Air bearings 512, 514 are supported by an air bearing housing 513 which surround a precision-diameter hollow shaft 521 that is supported by a shaft mounting device 522 that is attached to the drive pulley 510. A gap space is present between the two axially mounted air bearings 512 and 514 to allow pressurized air supplied by the tubing 520 to enter radial port holes in the hollow air bearing shaft 521 to transmit the controlled-pressure air through the annular passage between the vacuum tube 526 and the spindle shaft 508 internal through-hole 506. The hollow shaft 521, the air bearings 512 and 514 and the air bearing housing 513 act together as a friction-free non-contacting high speed multi-port rotary union 518.

The pressurized air supplied by the tubing 520 is routed through the annular passageway to the pneumatic adapter device 505 where this pressurized air enters the sealed reinforced elastomeric tube chamber 503*a* to provide abrading pressure which forces the workpiece 538 against an abrasive surface (not shown) on a rotary platen (not shown). When air pressure is applied to the reinforced elastomeric tube chamber 503*a*, the flexible elastomeric tube device 534 is flexed downward to move the workpiece 538 downward in a vertical direction along the rotation axis of the rotary spindle 511 rotary spindle shaft 508 that is supported be bearings 524 attached to the spindle housing 528. Vacuum can also be applied at the tubing 520 to develop a negative pressure in the sealed elastomeric tube chamber 503*a* to collapse the elastomeric tube device 534 in a vertical direction to raise the workpiece 538 away from abrading contact with the platen abrasive surface.

The spindle 511 is shown as a cartridge-type spindle which is a standard commercially available unit that can be provided by a number of vendors including GMN USA of Farmington, Conn. A rectangular block-type spindle 511 having the same spindle moving components can also be provided by a number of vendors including Gilman USA of Grafton, Wis. The spindles 511 can be belt driven units or they can have integral drive motors. Spindles 511 can have flat-surfaced moving spindle end plate 530 or the spindle 511 can have drive shafts 508 with internal or external tapered shaft ends that can be used to attach the floating elastomeric tube workpiece carrier head 531.

An important fail-safe feature of this floating elastomeric tube workpiece carrier head 531 is that it can be operated at high rotational speeds exceeding 3,000 rpm without danger even in the event of failure of supporting components such as the elastomeric tube device 534 or the loss of the workpiece rotor 536 outer diameter lateral (horizontal) lateral support by the supporting idlers. In the event of failure of these devices, all of the moving internal components of the carrier head 531 are contained within the structurally robust rotary carrier housing 532. Another safety feature is that the sliding pin 533 that is in sliding contact with the sliding pin drive arm 503*c* prevents free rotation of the workpiece carrier head 531 relative to the workpiece carrier head 531 where vacuum presence is assured to maintain the attachment of the workpiece 538 to the workpiece carrier head 531.

Because the internal structural components of the workpiece carrier head 531 are constructed with intentional small gap spaces between adjacent components, these components would shift radially these small gap distances before they become restrained from further radial motion as the workpiece carrier head 531 is rotated at low or high speeds. This slight off-set radial shifting of the components such as the workpiece carrier rotor 536 and the workpiece 538 will cause an unbalance of the rotating workpiece carrier head 531. This unbalance will result in a vibration of the rotating workpiece carrier head 531 which imposes dynamic forces on the spindle 511. However, the spindle 511 has a very robust structural design, as shown by the use of multiple spindle shaft 508 rotary bearings 524, and the spindle 511 is easily suitable to sustain these rotating workpiece carrier head 531 vibrations that will diminish rapidly as the spindle speed is diminished by emergency-stop dynamic braking of the spindle 511 drive motor.

The small gaps between the internal components of the workpiece carrier head 531 are jus large enough to allow the free-floatation of the elastomeric tube device 534 workpiece carrier rotor 536 and the workpiece 538 but are small enough that large vibrations will not be caused in the remote-occurrence event of failure of the components of the floating workpiece carrier head 531.

Figure 24:
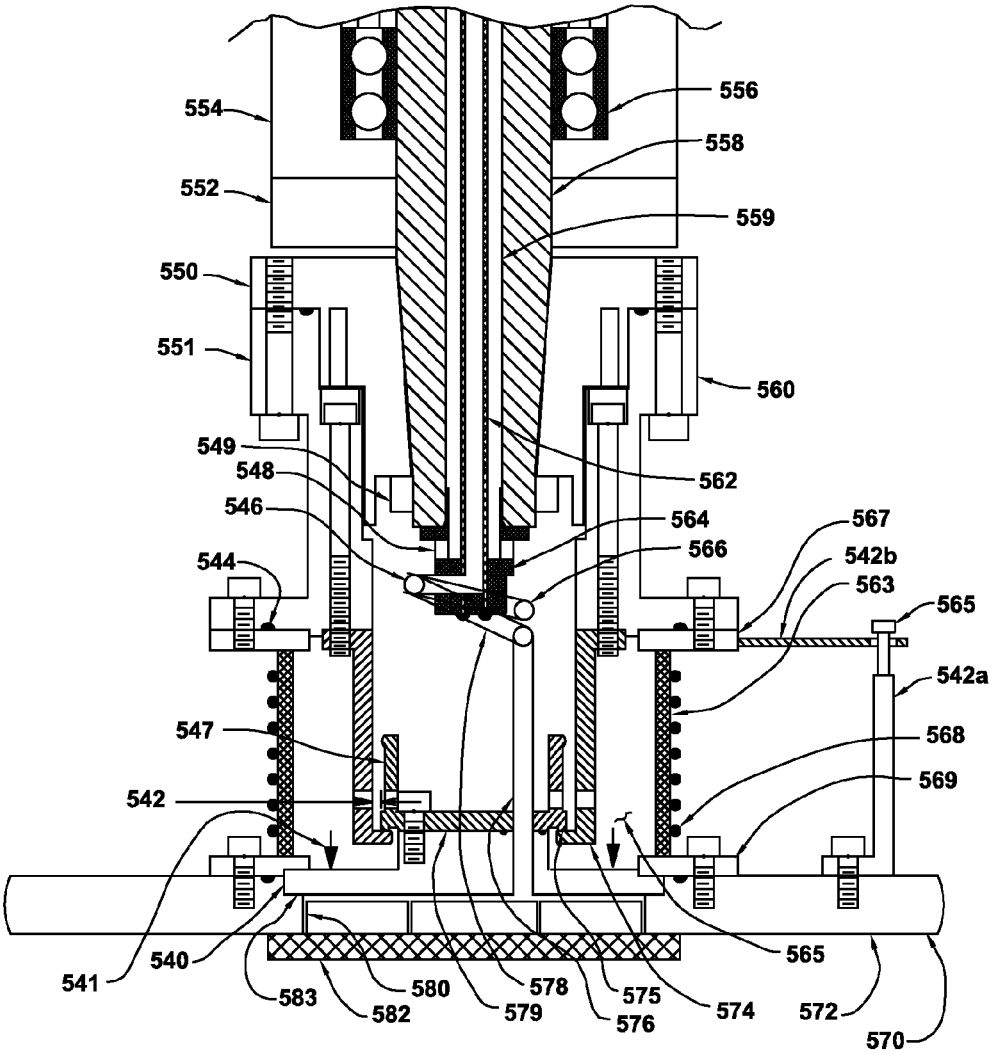
FIG. 24 is a cross section view of a slide pin workholder that is restrained vertically.

FIG. 24 is a cross section view of a slide pin floating workpiece carrier that is restrained vertically. The workpiece rotor 570 has an outer diameter having a spherical-shaped surface that is supported laterally (horizontally) by idlers (not shown). The workpiece rotor 570 having a precision-flat workpiece mounting surface 572 has a vacuum-attached workpiece 582 and the rotor 570 is attached to a rotary workpiece carrier housing 560 by a elastomeric tube device 568 having reinforcing wires 563 that flexes in a vertical direction along the axis of the rotary spindle 554 rotary spindle shaft 558. The precision-flat workpiece mounting surface 572 is typically flat to within 0.0001 inches (0.254 microns) but the flatness of the surface 572 can range from 0.005 inches to 0.00001 inches (127 to 0.254 microns) across the full area of the surface 572.

The workpiece rotor 536 has a vacuum-attached workpiece 538 and the rotor 536 is attached to a rotary workpiece carrier housing 532 by a sliding pin drive arm 503*c* that is in sliding contact with a sliding pin 533 that is attached to a sliding pin bracket 503*b* that is attached to the workpiece rotor 536 where the sliding pin 533 moves in a vertical direction along the axis of the rotary spindle 511 rotary spindle shaft 508. The workpiece carrier rotor 570 has a vacuum-attached workpiece 582 and the rotor 570 is attached to a rotary workpiece carrier housing 560 by a sliding pin drive arm 542*b* that is in sliding contact with a sliding pin 565 that is attached to a sliding pin bracket 542*a* that is attached to the workpiece carrier rotor 570 where the sliding pin 565 moves in a vertical direction along the rotary axis of the rotary spindle 554 rotary spindle shaft 558.

Controlled-pressurized air is routed through the annular passageway between the metal or polymer vacuum tube 562 and the spindle shaft 558 internal through-hole 559 to the pneumatic adapter device 564 where this pressurized air enters the sealed elastomeric tube chamber 565 to provide abrading pressure which forces the workpiece 582 against an abrasive surface (not shown) on a rotary platen (not shown). When air pressure is applied to the elastomeric tube chamber 565, the flexible elastomeric tube device 568 is flexed downward to move the workpiece 582 downward in a vertical direction along the rotation axis of the rotary spindle 554 rotary spindle shaft 558 that is supported by the bearings 556 attached to the spindle 554.

Vacuum can also be applied within the annular passageway between the metal or polymer vacuum tube 562 and the spindle shaft 558 internal through-hole 559 to develop a negative pressure in the sealed elastomeric tube chamber 565 to collapse the elastomeric tube device 568 in a vertical direction to raise the workpiece 582 away from abrading contact with the platen abrasive surface. The spindle 554 has a moving spindle end plate 552.

The cylindrical spindle 554 spindle shaft 558 shown here has an attached housing 550 which is attached to the end of the spindle shaft 558 with a threaded nut 549. Other rotary spindles 554 can have different spindle 554 shapes and configurations such as a block-type spindle (not shown) and different configuration spindle shaft 558 attached housings 550 such as flange-type housings 550 that are an integral part of the spindle shaft 558. The flexible elastomeric tube device 568 has an upper attached annular flange 567 and an lower attached flange 569 where the upper attached annular flange 567 is attached to the rotary workpiece carrier housing 560 and the lower attached flange 569 is attached to the workpiece rotor 570.

The workpiece 582 is attached with vacuum or by water-wetted adhesion or by low-tack adhesives to the workpiece rotor 570 flat mounting surface 572. Vacuum is supplied through vacuum passageways 580 that are present in the workpiece rotor 570 which is attached to a rotor top-plate 540 that can be attached with adhesive 583 or with fasteners (not shown) to the rotor 570 to provide maximum structural stiffness to the workpiece rotor 570. The rotor top-plate 540 has a vacuum pipe fitting 576 which supports a flexile coil-segment polymer, nylon, or polyurethane tube 578 which is also attached to the pneumatic adapter device 564 vacuum pipe fitting 546 which is connected to the spindle shaft 558 vacuum tube 562. The travelling end of the flexile polymer tube 578 is shown in a "down" position and is also shown in an "up" position 566 where the tube 578 flexes along the axis of the spindle shaft 558 as the elastomeric tube device 568 is flexed along the axis of the spindle shaft 558.

The flexile polymer tube 578 also flexes in a radial direction perpendicular to the axis of the spindle shaft 558 as the workpiece flexible carrier head 551 typically is rotated at high speeds. All of the structural stresses in the flexile polymer tube 578 caused by the limited-motion axial and radial flexing of the flexile polymer tube 578 are very low which provides long fatigue lives to the tubing during the abrading operation of the workpiece carrier head 551. The coiled segments of the flexile polymer tube 578 can be provided by cutting out segments from standard coiled-polymer tubing that is in common use or the coiled segments of the flexile polymer tube 578 can be provided by the FreelinWade company of McMinnville, Oreg.

Use of the coiled polymer tubing 578 eliminates the use of nominally straight segments of flexible hollow tubing and the associated use of the required sealed tube-end holder apparatus (not shown) where the tubing has to slide in the sealed tube-end holder apparatus each time that the elastomeric tube device 568 is flexed along the axis of the spindle shaft 558. Maintenance of the sliding vacuum seal by use of the non-sliding coiled vacuum tubing seal device is eliminated.

Pressurized air enters the sealed elastomeric tube chamber 565 through the pneumatic adapter device 564 that has open passageways 548 to provide abrading pressure forces 541 that act against the workpiece rotor 570 and the attached workpiece 582. to force it in a downward direction against a stop device. A displacement control device 579 has an annular wall 547 that acts in conjunction with the annular excursion control device 574 and the rotary workpiece carrier housing 560 to limit the lateral or horizontal excursion distance 542 of the workpiece rotor 570 relative to the rotary workpiece carrier housing 560 during the rotational abrading operation of the workpiece carrier head 551. The displacement control device 579 annular wall 547 limits the tilting of the workpiece rotor 570 relative to the rotary workpiece carrier housing 560 during the rotational abrading operation of the workpiece carrier head 551 when a workpiece 582 having non-parallel surfaces is abraded. When the workpiece rotor 570 moves more than the lateral or horizontal excursion distance 542 of the workpiece rotor 570 relative to the rotary workpiece carrier housing 560, the annular excursion control device 574 is contacted and the motion of the workpiece rotor 570 is fully restrained. The resultant rotary unbalance of the workpiece carrier head 551 caused by this off-set radial motion of the workpiece rotor 570 and the attached workpiece 582 is minimized by this small offset excursion distance 542. The small offset horizontal excursion distance 542 that is measured perpendicular to the axis of the spindle shaft 558 ranges from 0.005 inches to 0.750 inches (0.127 to 1.905 cm) where the preferred distance 542 ranges from 0.010 to 0.050 inches (0.025 to 0.127 cm).

When the pressurized air enters the sealed elastomeric tube chamber 565 to provide abrading pressure forces 541 that act against the workpiece rotor 570 and the attached workpiece 582, this pressure force 541 is distributed uniformly over the whole bottom area located on the upward face of the workpiece carrier rotor 570 that is contained within the elastomeric tube chamber 565. The pressure force 541 urges the workpiece carrier rotor 570 in a downward direction against a vertical stop device 574. This vertical stop device 574 also acts as an annular excursion control device 574. The workpiece carrier rotor 570 is shown stopped in a downward vertical direction where the displacement control device 579 contacts the vertical stop device 574 which limits the excursion of the workpiece carrier rotor 570 in a vertical direction.

Figure 25:
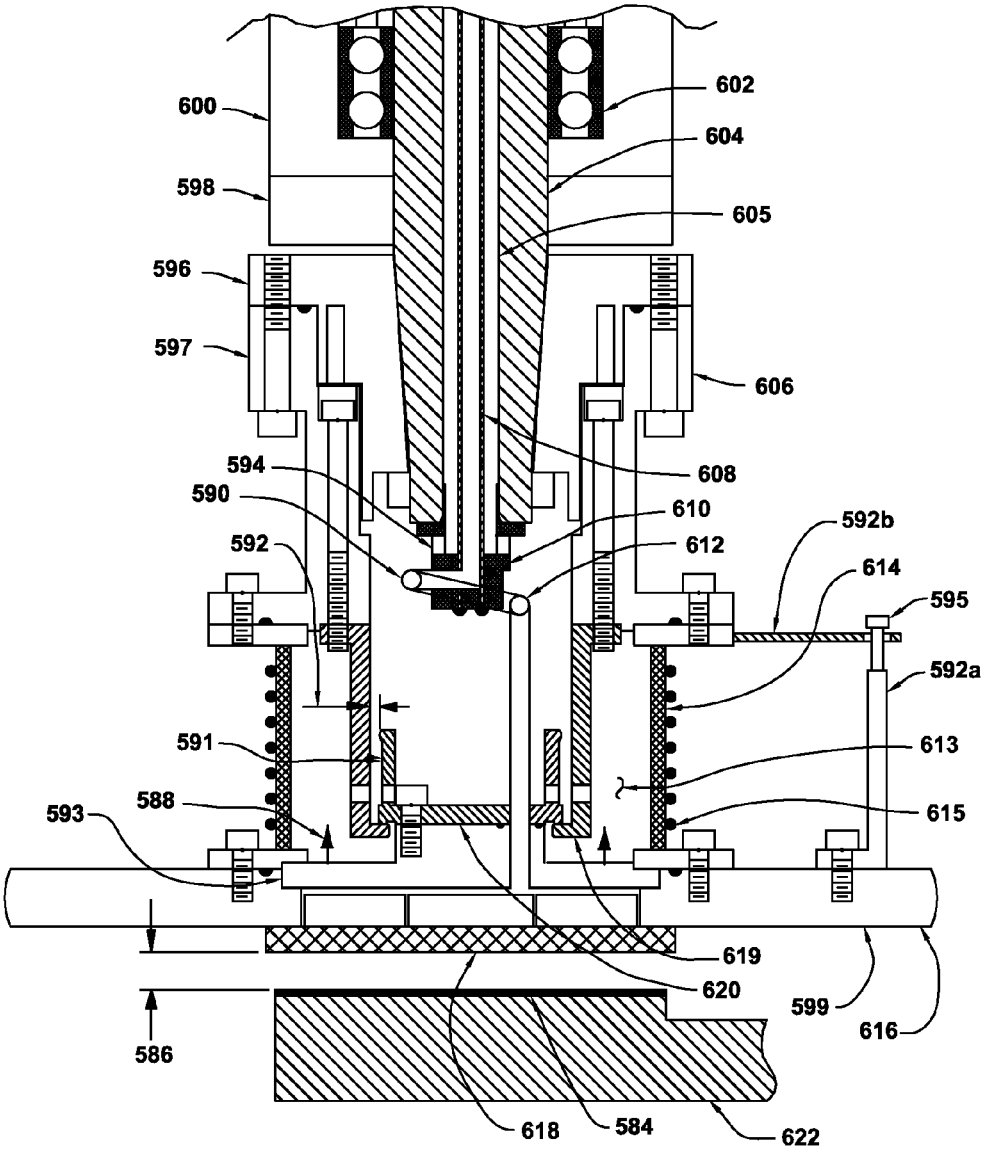
FIG. 25 is a cross section view of a slide-pin workpiece carrier raised from abrasive.

FIG. 25 is a cross section view of a slide-pin floating workpiece carrier that is raised away from an abrasive surface. The cylindrical spindle 600 spindle shaft 604 is supported by bearings 602 where the spindle 600 has a rotatable end plate 598 and a spindle flange hub 596 is attached to the spindle 600. A rigid vacuum tube 608 is attached to a pneumatic adapter device 610 to provide vacuum to a flexible polymer tube 612 that is attached to a tube fitting 590 that is attached to the pneumatic adapter device 610. The flexible vacuum tube 612 is also attached to the workpiece rotor 616 to attach the workpiece 618 to the workpiece rotor 616. The pneumatic adapter device 610 has a port hole opening 594 to provide pressure or vacuum to the sealed elastomeric tube chamber 613.

Controlled-pressurized air, or vacuum, is routed through the annular passageway between the rigid metal or polymer vacuum tube 608 and the spindle shaft 604 internal through-hole 605 to the pneumatic adapter device 610 where this pressurized air enters the sealed elastomeric tube chamber 613 to provide abrading pressure which forces the workpiece 618 against an abrasive surface 584 on a rotary platen 622. When air pressure is applied to the elastomeric tube chamber 613, the flexible elastomeric tube device 614 is flexed downward to move the workpiece 618 downward in a vertical direction along the rotation axis of the rotary spindle 600 rotary spindle shaft 604 until and as the workpiece 618 contacts the abrasive 584.

Vacuum can also be applied within the annular passageway between the metal or polymer vacuum tube 608 and the spindle shaft 604 internal through-hole 605 to develop a negative pressure in the sealed elastomeric tube chamber 613 to collapse the elastomeric tube device 614 in a vertical direction to raise the workpiece 618 away from abrading contact with the platen 622 abrasive surface 584. The workpiece 618 is drawn up a distance 586 from the abrasive 584 surface. The separation distance 586 can range from 0.010 inches to 0.500 inches (0.025 to 1.27 cm) or more. The workpiece 618 can be drawn up rapidly because vacuum can be applied rapidly in the elastomeric tube 614 chamber 613 with the use of a vacuum surge tank (not shown) that supplies vacuum with the use of an electrically-activated solenoid valve (not shown).

Because the vacuum provides a negative pressure that can exceed 10 lbs per square inch and the workpiece rotor 616 has a surface area that typically exceeds 10 square inches, the vacuum force 588 that raises the workpiece rotor 616 and workpiece 618 can easily exceed 100 lbs for even a small-sized workpiece rotor 616 that has a diameter of only 4 inches (10.1 cm). At any time that it is desired to quickly raise the workpiece 618 away from abrading contact with the abrasive 584, the vacuum can be quickly applied to the elastomeric tube 614 chamber 613 by a control system that activates solenoid valves that regulate the pressure and vacuum in the elastomeric tube 614 chamber 613.

The workpiece rotor 536 has a vacuum-attached workpiece 538 and the rotor 536 is attached to a rotary workpiece carrier housing 532 by a sliding pin drive arm 503*c* that is in sliding contact with a sliding pin 533 that is attached to a sliding pin bracket 503*b* that is attached to the workpiece rotor 536 where the sliding pin 533 moves in a vertical direction along the axis of the rotary spindle 511 rotary spindle shaft 508.

The workpiece rotor 616 has a vacuum-attached workpiece 618 and the rotor 616 is attached to a rotary workpiece carrier housing 606 by a sliding pin drive arm 592*b* that is in sliding contact with a sliding pin 595 that is attached to a sliding pin bracket 592*a* that is attached to the workpiece rotor 616 where the sliding pin 595 moves in a vertical direction along the axis of the rotary spindle 600 rotary spindle shaft 604.

A tilting control device 620 annular wall 591 shown here acts in conjunction with the rotary workpiece carrier housing 606 to limit the tilting of the workpiece rotor 616 relative to the rotary workpiece carrier housing 606 during the rotational abrading operation of the floating workpiece carrier head 597 to a specified amount when a workpiece 618 having non-parallel surfaces is abraded. When the workpiece rotor 616 tilts and reduces the distance 592 more than the original lateral or horizontal excursion distance 592 of the workpiece rotor 616 relative to the rotary workpiece carrier housing 606, the annular tilting control device 620 wall 591 contacts the rotary workpiece carrier housing 606. Here, further tilting of the workpiece rotor 616 is fully prevented and the specified and allowable tilt angle of the workpiece rotor 616 is not exceeded. The gap distance 582 of the tilting control device 620 annular wall 591 can be used to limit the sideways lateral or horizontal excursion motion of the workpiece rotor 616 in addition to limiting the tilting of the nominally-horizontal workpiece rotor 616 through a tilt angle that is measured from the precision-flat workpiece mounting surface 599 of the workpiece rotor 616 relative to a horizontal plane.

The rotatable workpiece carrier plate 616 that is attached to the flexible rotatable elastomeric tube spring device 614 can be tilted over a selected tilt-excursion angle that ranges from 0.1 degrees to a maximum of 30 degrees until selected structural components such as the tilting control device 620 annular wall 591 that are attached to the rotatable workpiece rotor carrier plate 616 contacts the rotary workpiece carrier housing 606 to limit the tilting of the workpiece rotor 616. The preferred range of the tilt-excursion angle ranges from 5 degrees to a 30 degrees. The cylindrical spindle 600 spindle shaft 604 is supported by bearings 602 where the spindle 600 has a rotatable end plate 598 and a spindle flange hub 596 is attached to the spindle 600.

The floating workpiece carrier head 597 can also be converted to a rigid non-floating workpiece carrier head 597 by simply applying vacuum to the sealed elastomeric tube chamber 613 to develop a negative pressure in the sealed elastomeric tube chamber 613 to collapse the elastomeric tube device 614 in a upward vertical direction. Here the workpiece rotor 616 and the adhesively attached or fastener (not shown) attached rotor top-plate 593 is forced by the vacuum upward against the annular excursion control device 603 at the annular contact area 619 which forced-contact action converts the floating workpiece carrier head 597 to a rigid non-floating workpiece carrier head 597. A configuration option here is for the contact area 619 to be configured to provide three-point flat-surfaced or three-point spherical debris self-cleaning surfaces of contact rather than the annular continuous flat-surfaced contact area 619, as shown. The components of the floating workpiece carrier head 597 can be designed and manufactured where the precision-flat workpiece mounting surface 599 of the workpiece rotor 616 is precisely perpendicular to the rotation axis of the rotary spindle 600 rotary spindle shaft 604. This rigid non-floating workpiece carrier head 597 can be used to abrade opposed flat surfaces on workpieces 618 that are precisely parallel to each other.

Figure 26:
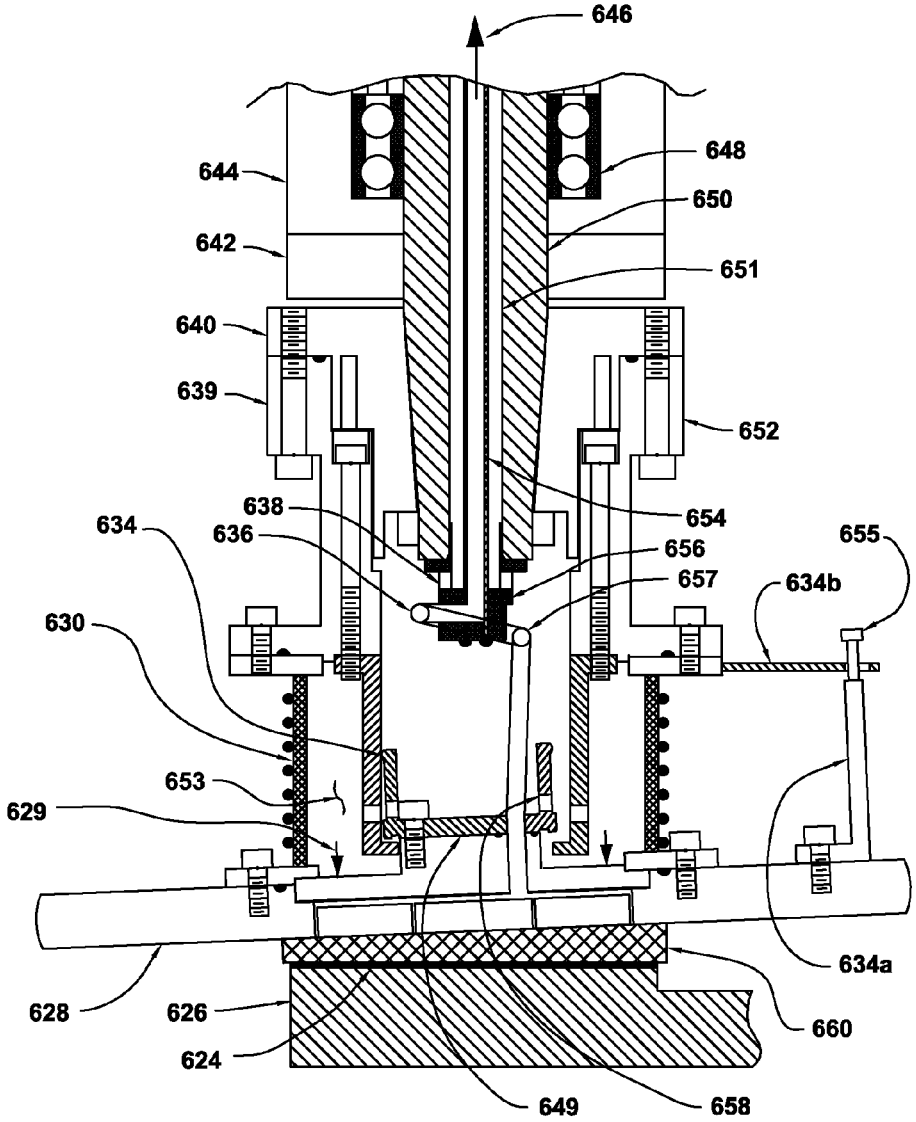
FIG. 26 is a cross section view of a slide-pin workpiece carrier tilted by a workpiece.

FIG. 26 is a cross section view of a slide-pin floating workpiece carrier that is tilted by a workpiece having non-parallel surfaces. The cylindrical spindle 644 spindle shaft 650 is supported by bearings 648 where the spindle 644 has a rotatable end plate 642 and a spindle flange hub 640 is attached to the spindle 644 spindle shaft 650. A rigid vacuum tube 654 is attached to a pneumatic adapter device 656 to provide vacuum 646 to a flexible polymer tube 657 that is attached to a tube fitting 636 that is attached to the pneumatic adapter device 656. The flexible vacuum tube 657 is also attached to the floating workpiece rotor 628 to attach the workpiece 660 having non-parallel surfaces to the workpiece rotor 628. The pneumatic adapter device 656 has a port-hole opening 638 to provide pressure or vacuum to the sealed elastomeric tube chamber 653.

Controlled-pressurized air is routed through the annular passageway between the rigid metal or polymer vacuum tube 654 and the spindle shaft 650 internal through-hole 651 to the pneumatic adapter device 656 where this pressurized air enters the sealed elastomeric tube chamber 653 to provide abrading pressure 629 which forces the non-parallel surfaced workpiece 660 against an abrasive surface 624 on a rotary platen 626. When air pressure is applied to the elastomeric tube chamber 653, the flexible elastomeric tube device 630 is flexed downward to move the workpiece 660 downward in a vertical direction along the rotation axis of the rotary spindle 644 rotary spindle shaft 650 until and as the workpiece 660 contacts the abrasive 624. Here the non-parallel surfaced workpiece 660 that is held in flat-faced contact with the flat abrasive surface 624 causes the workpiece rotor 628 to tilt.

The workpiece carrier rotor 628 has a vacuum-attached workpiece 660 and the carrier rotor 628 is attached to a rotary workpiece carrier housing 652 by a sliding pin drive arm 634*b* that is in sliding contact with a sliding pin 655 that is attached to a sliding pin bracket 634*a* that is attached to the workpiece carrier rotor 628 where the sliding pin 655 moves in a vertical direction along the rotation axis of the rotary spindle 644 rotary spindle shaft 650. Because the workpiece 660 has non-parallel opposed surfaces, the workpiece 660 tilts the workpiece carrier rotor 628.

A tilting control device 649 annular wall 634 shown here acts in conjunction with the rotary workpiece carrier housing 652 to limit the tilting of the workpiece rotor 628 relative to the rotary workpiece carrier housing 652 during the rotational abrading operation of the workpiece carrier head 639 to a specified amount when a workpiece 660 having non-parallel surfaces is abraded. When the workpiece rotor 628 tilts, the annular tilting control device 649 annular wall 634 contacts the rotary workpiece carrier housing 652 at the contact point 634. Here, additional tilting of the workpiece rotor 628 is fully prevented and the specified and allowable tilt angle of the workpiece rotor 628 is not exceeded.

All of the component parts of the floating workpiece carrier head 639 are designed and manufactured to be robust and structurally strong so that they easily resist the abrading forces that are applied to the floating workpiece carrier head 639 during abrading operations. These components are all manufactured from materials that resist the coolant water, CMP fluids and the abrading debris that is present in these abrading and polishing operations. The floating workpiece carrier head 639 devices are particularly well suited for polishing semiconductor wafers and for back-grinding these wafers at very high abrading speeds compared to the very low speeds of convention abrading systems presently being used for these applications. Often, the abrading speeds and piece part productivity are increased by a factor of 10 with this floating workpiece carrier head 639 abrading system.

Figure 27:
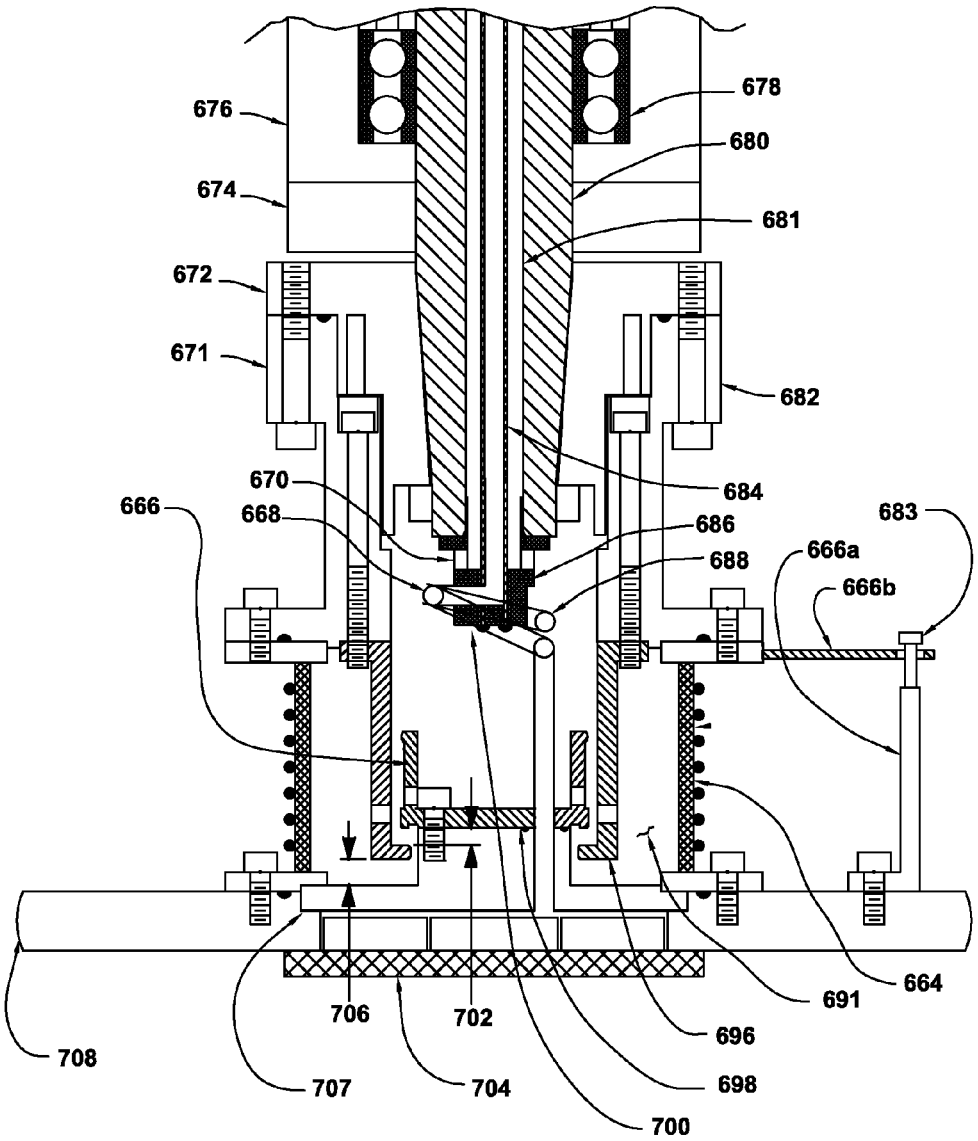
FIG. 27 is a cross section view of a slide-pin workpiece carrier in a neutral position.

FIG. 27 is a cross section view of a slide-pin floating workpiece carrier that is positioned in a neutral free-floating location. The cylindrical spindle 676 spindle shaft 680 is supported by bearings 678 where the spindle 676 has a rotatable end plate 674 and a spindle flange hub 672 is attached to the spindle 676 spindle shaft 680. A rigid vacuum tube 684 is attached to a pneumatic adapter device 686 to provide vacuum to a flexible circular-segment polymer tube 688 that is attached to a tube fitting 668 that is attached to the pneumatic adapter device 686. The flexible vacuum tube 688 is also attached to the floating workpiece rotor 708 to provide vacuum to attach the workpiece 704 to the workpiece rotor 708. The pneumatic adapter device 686 has a port-hole opening 670 to provide pressure or vacuum to the sealed elastomeric tube chamber 691.

Controlled-pressurized air is routed through the annular passageway between the rigid metal or polymer vacuum tube 684 and the spindle shaft 680 internal through-hole 681 to the pneumatic adapter device 686 where this pressurized air enters the sealed elastomeric tube chamber 691 to provide abrading pressure which forces the workpiece 704 against an abrasive surface (not shown) that is coated on a flat-surfaced rotary platen (not shown). When air pressure is applied to the elastomeric tube chamber 691, the flexible elastomeric tube device 664 is flexed downward to move the workpiece 704 downward in a vertical direction along the rotation axis of the rotary spindle 676 rotary spindle shaft 680 until, and as, the workpiece 704 contacts the flat abrasive surface. The workpiece rotor 708 has a spherical-shaped outer diameter 708 that is contacted by stationary rotary idlers (not shown) that hold the rotating workpiece rotor 708 in place as the workpiece rotor 708 rotates.

The workpiece carrier rotor 708 has a vacuum-attached workpiece 704 and the rotor 708 is attached to a rotary workpiece carrier housing 682 by a sliding pin drive arm **666*b* that is in sliding contact with a sliding pin 683 that is attached to a sliding pin bracket 666*a* that is attached to the workpiece carrier rotor 708 where the sliding pin 683 moves in a vertical direction along the rotation axis of the rotary spindle 676 rotary spindle shaft 680**.

There is a vertical upward excursion distance 706 where the workpiece rotor 708 and the workpiece 704 are free to travel or float up and down vertically before the workpiece rotor 708 and the adhesively attached or fastener (not shown) rotor top-plate 707 is forced against the annular excursion control device 696. There is also a vertical downward excursion distance 702 where the workpiece rotor 708 and the workpiece 704 are free to travel or float vertically before the workpiece rotor 708, the attached rotor top-plate 707 and the attached combination translate and the vertical excursion control device 698 is forced vertically downward against the annular excursion control device 696. The vertical upward excursion distance 706 and the vertical downward excursion distance 702 together provide a total workpiece rotor 708 and the workpiece 704 vertical excursion travel distance that can range from 0.005 inches to 1.5 inches (0.0127 to 3.81 cm) or more where the preferred total vertical excursion distance ranges from 0.125 inches to a maximum of 0.500 inches (0.317 to 1.27 cm).

A floating workpiece rotor 708 excursion control device 698 acts in conjunction with the rotary workpiece carrier housing 682 to limit the lateral or horizontal excursion of the workpiece rotor 708 and the workpiece 704 relative to the rotary workpiece carrier housing 682 during the rotational abrading operation of the workpiece carrier head 671. Here, the lateral, sideways or horizontal motion of the workpiece rotor 708 and the workpiece 704 is confined and restrained when the excursion control device 698 is forced horizontally against the annular excursion control device 696 at the contact point 690.

Figure 28:
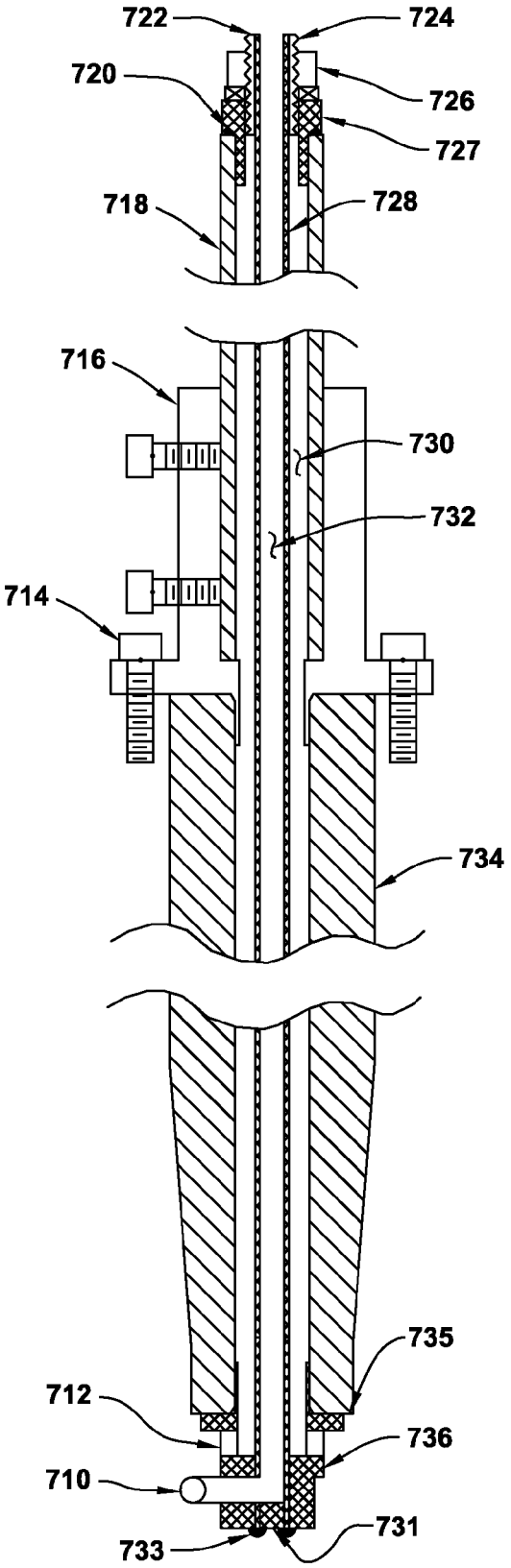
FIG. 28 is a cross section view of a spindle shaft and an air bearing rotary union shaft.

FIG. 28 is a cross section view of a spindle shaft and an air bearing rotary union shaft. A cylindrical spindle shaft 734 has a pneumatic adapter device 736 that has a port-hole opening 712 that provides pressure or vacuum to a sealed floating workholder elastomeric tube chamber (not shown). The pneumatic adapter device 736 also is supplied vacuum through a rigid hollow metal tube 728 that is attached by welds 733 to the pneumatic adapter device 736 and where a plug 731 is used to seal the end of the metal tube 728.

The upper end of the vacuum tube 728 extends through the end of an end-cap device 727 that is centered in an air bearing hollow metal tube 718 that is supported by a circular bracket mount 716 which is attached to a spindle V-belt drive pulley (not shown) that is attached to a rotary spindle shaft (not shown) by fasteners 714. The end of the stiff metal vacuum tube 727 has a threaded hollow fastener 724 that is attached to the vacuum tube 728 with structural adhesives, by brazing or by silver-soldering the tube 728 and threaded hollow fastener 724 to be concentric with each other. A threaded nut 726 engages the threaded end of the hollow fastener 724 that is nominally flush with the upper free end of the vacuum tube 728. Here, the fastener nut 726 is tightened to create tension along the length of the vacuum tube 728 as the attached pneumatic adapter device 736 is butted against the spindle shaft end 734. An O-ring 720 is used to seal the joint between the end cap device 727 and the hollow air bearing tube 718.

Figure 29:
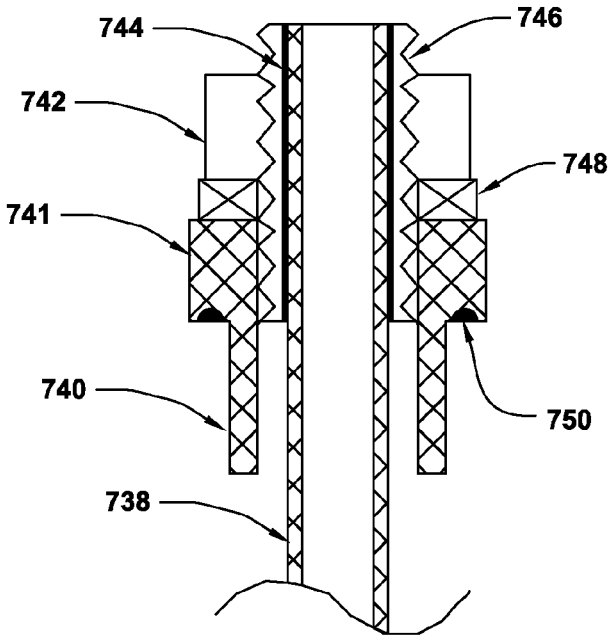
FIG. 29 is a cross section view of a spindle shaft vacuum tube end-cap device.

FIG. 29 is a cross section view of a spindle shaft vacuum tube end-cap device. The upper end of a metal vacuum tube 738 extends through the end of an end cap device 741. The end of the stiff metal vacuum tube 738 has a threaded hollow fastener 746 that is attached to the tube 738 with structural adhesives, by brazing or by silver-soldering 744 the tube 738 and threaded hollow fastener 746 together to be concentric with each other. A threaded nut 742 engages the threaded end of the hollow fastener 746 that is nominally flush with the upper free end of the vacuum tube 738. An O-ring 750 is used to seal the joint between the end cap device 741 and a hollow air bearing tube (not shown). A flexible Belleville spring washer or a convention metal or non-metal washer 748 can be positioned between the nut 742 and the end cap device 741.

Figure 30:
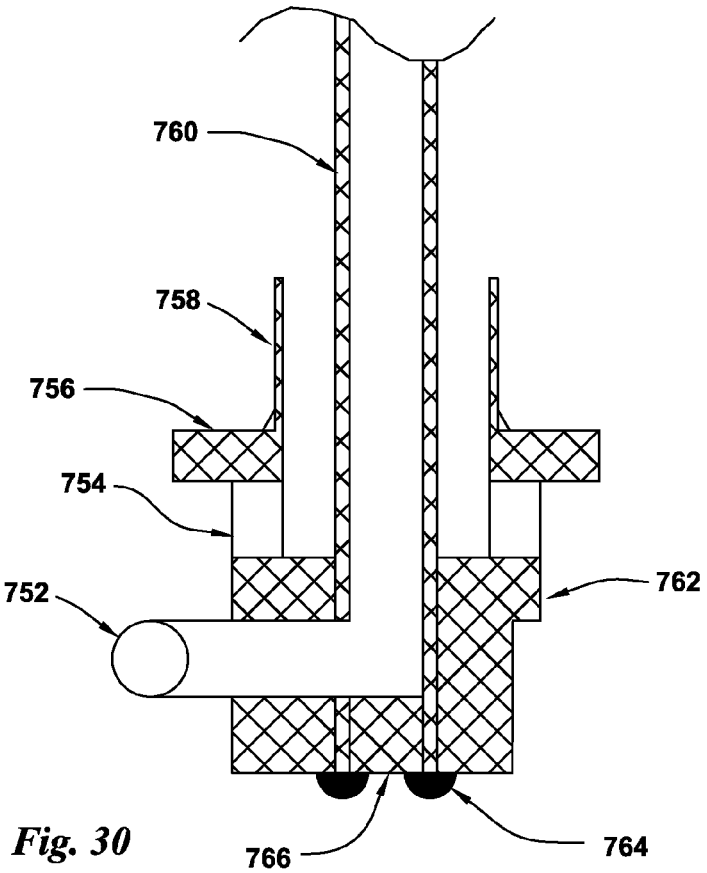
FIG. 30 is a cross section view of a spindle shaft vacuum tube pneumatic adapter device.

FIG. 30 is a cross section view of a spindle shaft vacuum tube pneumatic adapter device. A cylindrical spindle shaft (not shown) has a pneumatic adapter device 762 that has a port-hole opening 754 that provides pressure or vacuum to a sealed floating workholder elastomeric tube chamber (not shown) and a flat-surfaced annular edge 756. The pneumatic adapter device 762 also is supplied vacuum through a rigid hollow metal tube 760 that is attached by welds 764 to the pneumatic adapter device 762 and where a plug 766 is used to seal the end of the metal tube 760.

Figure 31:
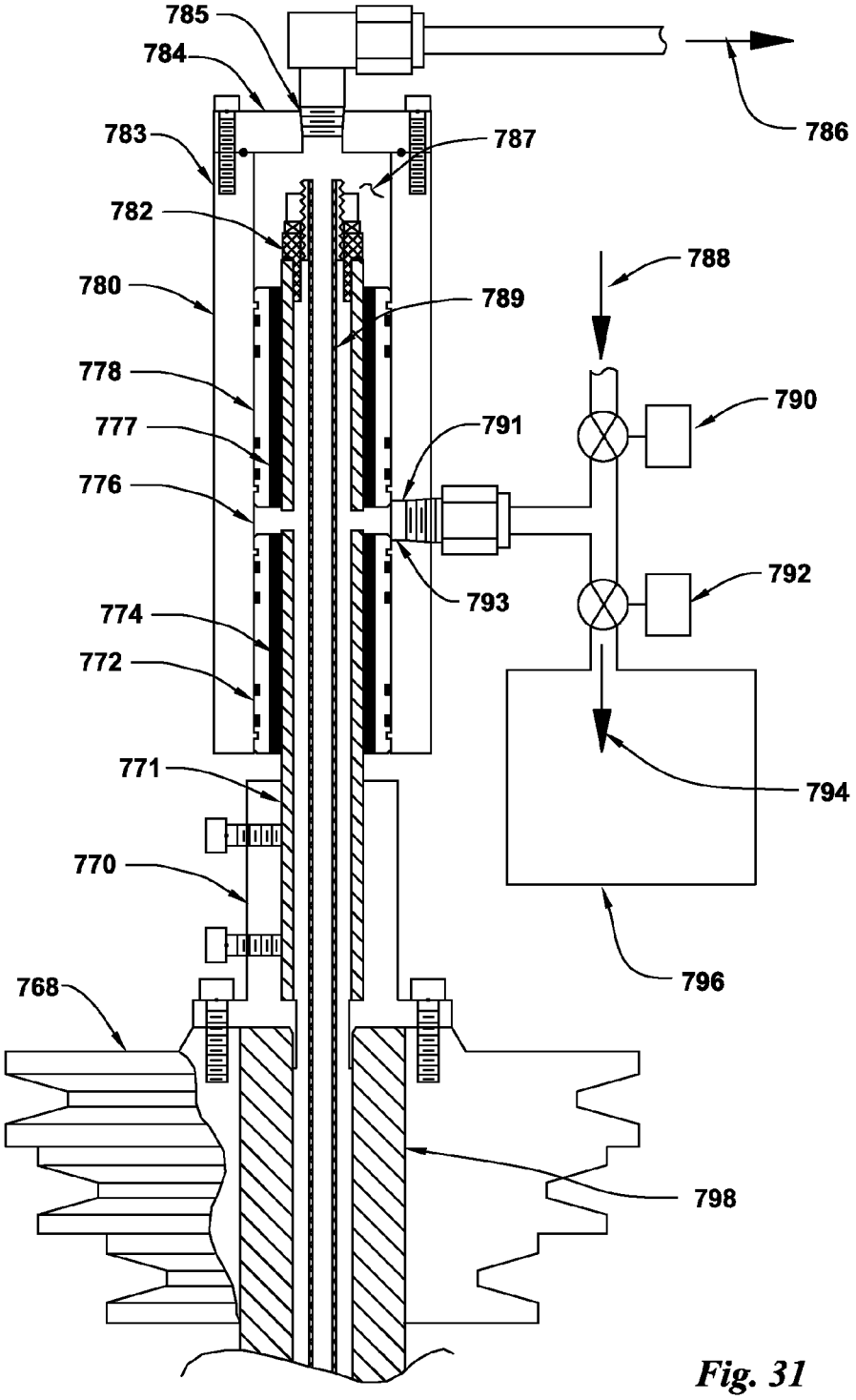
FIG. 31 is a cross section view of an air bearing fluid high speed rotary union device.

FIG. 31 is a cross section view of an air bearing fluid high speed rotary union device. A stationary vacuum and fluid rotary union device 783 is attached to a hollow rotatable carrier drive shaft 798 is a friction-free air-bearing rotary union that can be operated of very high rotational speeds that exceed 3,000 rpm for long periods of time. At least two cylindrical air bearing devices 778 have opposed cylindrical air bearing device ends where the at least two cylindrical air bearing devices 778 are positioned adjacent to each other longitudinally along the outside diameter of a cylindrical rotatable hollow air bearing shaft 771 having a cylindrical rotatable hollow air bearing shaft 771 open top end and having a cylindrical rotatable hollow air bearing shaft 771 open bottom end wherein the end of one cylindrical air bearing device 778 is positioned nominally adjacent to the cylindrical rotatable hollow air bearing shaft 771 open top end.

The cylindrical rotatable hollow air bearing shaft 771 open bottom end is attached to the hollow rotatable carrier drive shaft 798 where the cylindrical rotatable hollow air bearing shaft 771 is concentric with the hollow rotatable carrier drive shaft 798. Here, pressurized air is supplied to the at least two cylindrical air bearing devices 778 wherein an air film is formed between the at least two cylindrical air bearing devices 778 and the cylindrical rotatable hollow air bearing shaft 798. The cylindrical air bearing devices 778 can be mechanical devices with air grooves to provide the air-bearing air film effect or the cylindrical air bearing devices 778 can be air bearings that have porous carbon 777 to provide the air-bearing air film effect. An advantage of the porous carbon 777 cylindrical air bearing devices 778 is that the hollow rotatable carrier drive shaft 798 and the cylindrical rotatable hollow air bearing shaft 771 can be rotated at very slow rotation speeds without air pressure being applied to the stationary cylindrical air bearing devices 778 without damage to the porous carbon 777 cylindrical air bearing devices 778 occurring.

A stationary vacuum rotary union end-cap 784 is attached to a vacuum and fluid rotary union housing 780 that surrounds the at least two cylindrical air bearing devices 778 to form a sealed vacuum and fluid rotary union 783 housing 780 internal chamber 787 located at the cylindrical rotatable hollow air bearing shaft 771 open top end and where a vacuum port hole 785 extends through the vacuum rotary union end-cap 784 into the stationary vacuum and fluid rotary union 783 housing 780 internal chamber 787. The vacuum or fluid 786 supplied to the vacuum rotary union end-cap 784 vacuum port hole 785 is routed into the stationary vacuum and fluid rotary union housing 780 internal chamber 787 and is routed to the top open end of the hollow spindle shaft tube 789 that is positioned within the vacuum and fluid rotary union housing 780 internal chamber 787.

There are gap-spaces 776 between the ends of adjacent at least two cylindrical air bearing devices 778 positioned longitudinally along the outside diameter of the cylindrical rotatable hollow air bearing shaft 771 where at least one pressure port hole 793 extends radially through the cylindrical rotatable hollow air bearing shaft 771 at the location of the respective gap-spaces between respective two adjacent cylindrical air bearing devices 778. Pressure-entry port holes 791 extend radially through the vacuum and fluid rotary union housing 780 that surrounds the at least two cylindrical air bearing devices 778 at the locations of the respective gap-spaces 776 between respective two adjacent cylindrical air bearing devices 778.

Pressurized air 788 and vacuum 794 supplied to respective pressure-entry port holes 791 that extend radially through the vacuum and fluid rotary union housing 780 is routed into the at least one pressure port hole 793 extending radially through the cylindrical rotatable hollow air bearing shaft 771 and i) is routed into the gap-spaces 776 between the ends of adjacent at least two cylindrical air bearing devices 778 and is routed into a respective annular space gap-space passageway between the hollow spindle shaft tube 789 and the cylindrical rotatable hollow air bearing shaft 771 where it is routed into the annular gap between the hollow spindle shaft tube 789 and the hollow rotatable carrier drive shaft 798 hollow opening and into the sealed enclosed elastomeric tube pressure chambers (not shown) or ii) is routed into respective tubes or passageways (not shown) that are connected with multiple respective sealed enclosed elastomeric tube (not shown) pressure chambers (not shown) that are located in the abrading machine workpiece substrate carrier apparatus (not shown).

Vacuum 794 can be supplied through the annular gap between the hollow spindle shaft tube 789 and the carrier drive shaft 798 hollow opening to contract the rotatable elastomeric tube spring device in a vertical direction from a substantial-volume vacuum surge tank 796 that is located nominally near the abrading machine workpiece substrate carrier apparatus. Here, a substantial amount of controlled vacuum 794 is quickly applied to the sealed enclosed elastomeric tube pressure chamber wherein the controlled vacuum negative pressure acts on the rotatable workpiece carrier plate top surface and compresses the rotatable elastomeric tube spring device which is flexed upward in a vertical direction. The rotatable workpiece carrier plate and the workpiece attached to the rotatable workpiece carrier plate can be quickly raised away from the rotatable abrading platen abrading surface. The selection of vacuum 794 or pressurized air 788 being directed into the pressure port hole 793 is controlled respectively by the solenoid vales 792 and 790.

If desired, leaks in the elastomeric tube chamber or cracks in the elastomeric tube device can be detected by monitoring the flow of pressurized air into the elastomeric tube chamber. If a elastomeric tube leak occurs, there will be a steady-state increase flow of air into the chamber that is required to make up for the air that escapes from the localized leak that exists in the defective, fractured or damaged elastomeric tube device. Use of an air or fluid flow-rate monitoring sensor device that senses unusual increased pressurized air flow rates that exceed normal air leakage rates that exist in the sealed elastomeric tube chamber can be used as an indicator of impending failure of the flexible elastomeric tube device.

During the typical operation of the floating elastomeric tube workpiece carrier device, the air flow of the pressurized air into the sealed elastomeric tube chamber will change during the abrading procedure. The air flow rate will change as the elastomeric tube expands or contracts in a vertical direction along the rotary axis of the workpiece carrier spindle drive shaft. However, during an abrading procedure, after the initial abrading contact of the workpiece with the platen abrasive, there is very little air flow into the sealed elastomeric tube chamber. The amount of air flow rate that typically exists is to provide make-up air for the leakage of air thought the elastomeric tube chamber sealed joints can be determined and used as a set-point reference by an air flow-rate monitoring and control system. When the air flow rates into the sealed elastomeric tube chamber exceeds this established-reference normalized air flow rates, the air flow rate monitoring system can be used to provide warning that new or larger leaks exist. Here, the abrading procedure operator can then investigate these excessive leaks and determine if corrective maintenance action is required.

Figure 32:
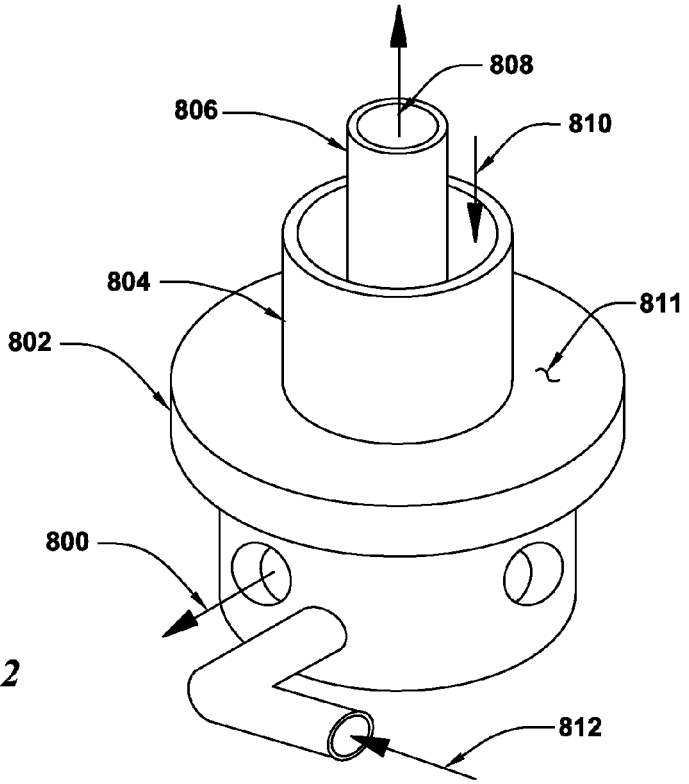
FIG. 32 is an isometric view of a spindle shaft vacuum tube pneumatic adapter device.

FIG. 32 is an isometric view of a spindle shaft vacuum tube pneumatic adapter device. A cylindrical spindle shaft (not shown) has a pneumatic adapter device 802 that has a port-hole opening 800 that provides supplied pressurized air 810 or vacuum to a sealed floating workholder elastomeric tube chamber (not shown) and a flat-surfaced annular edge 811. The pneumatic adapter device 802 also is supplied vacuum 808 through a rigid hollow metal tube 806 that is attached by welds or adhesives to the pneumatic adapter device 802 and where a plug (not shown) is used to seal the end of the metal tube 806. The pneumatic adapter device 802 has a thin-walled shoulder 804 that allows the pneumatic adapter device 802 to be concentrically centered with the hollow rotatable carrier drive shaft (not shown).

Figure 33:
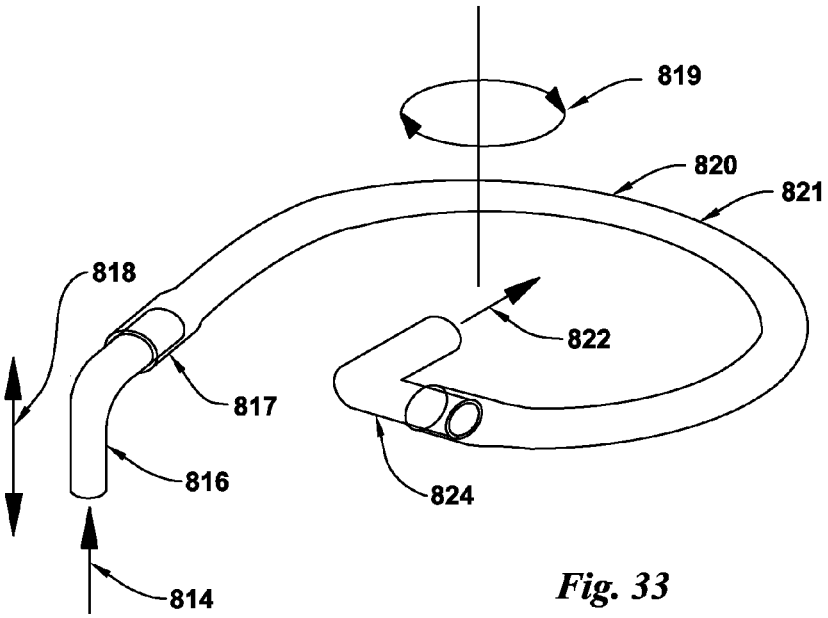
FIG. 33 is an isometric view of a hollow flexible fluid tube routed to a carrier rotor plate.

FIG. 33 is an isometric view of a hollow flexible fluid tube that is routed to fluid passageways that are connected to fluid port holes in the rotatable workpiece carrier plate. A hollow flexible fluid tube 820 that is routed to fluid passageways (not shown) that are connected to fluid port holes (not shown) in the rotatable workpiece carrier plate (not shown) flat bottom surface (not shown). The hollow flexible fluid tube 820 has a circular arc-segment shape 821 wherein the circular arc-segment 821 arc length ranges from 30 degrees to 720 degrees where the preferred circular arc-segment 821 arc length is approximately 270 degrees.

The hollow flexible fluid tube circular arc-segment 821 is located within the circumference and perimeter-envelope of the nominally-annular structural member (not shown) that is attached to the circular rotatable drive plate (not shown). Vacuum 822 is applied to the open end of a pneumatic-type fitting 824 that is attached to a pneumatic adapter device (not shown). The hollow flexible fluid tube circular arc-segment 821 has a connection joint 817 where it is attached to a pneumatic-type fitting 816 that is attached to the workpiece carrier head (not shown) where end of the hollow flexible fluid tube circular arc-segment 821 has an excursion travel 818 as the pneumatic-type fitting 816 moves with the free-floating workpiece carrier head.

The hollow flexible fluid tube 821 can be constructed from elastomeric materials including rubber or from polymer materials including nylon and polyurethane and can be constructed from metal or polymer bellows devices (not shown). The metal or polymer bellows device-type hollow flexible fluid tube 821 can have an internal elastomer material tube liner having a smooth internal tube-wall surface to avoid abrasive debris build-up within the bellows device annular-leaf crevices.

Also, the hollow flexible fluid tube circular arc-segment 821 can have different orientations including near-vertical orientations and the hollow flexible fluid tube 821 can have near-linear shapes as an alternative to the circular arc-segment shape. The amount of flexure excursion distance 818 is substantially small as compared with the overall length of the hollow flexible fluid tube circular arc-segment 821 with the result that the hollow flexible fluid tube circular arc-segment 821 has near-infinite fatigue life as it is flexed during long-term abrading operations.

When a floating elastomeric tube workholder is draw upward by vacuum in the bellow chamber to create a rigid workholder head, the floating head components can be supported by three rigid points that are evenly positioned in a circle to provide uniform solid support of the floating head. The large surface area that the vacuum is applied to provides a very large retaining force that is imposed upward to hold the workpiece holder head against the rigid three-point support. Often this vacuum lifting force exceeds 100 lbs, or much more. The vacuum-raised head is also held rigidly in a lateral (horizontal) direction by the rigid rotating idlers that are in running contact with the outer periphery of the workpiece holder rotor. In addition, the abrading forces that are applied by lowering the whole elastomeric tube workpiece carrier head where the workpiece is in abrading contact with the platen abrasive also increase the force that urges the workpiece rotor against the three-point vertical stops.

The three-point supports can be localized small-sized flat-surfaced supports or the three-point supports can be spherical-shaped ball-type contacts that are in contact with a annular flat supporting surface. The rounded spherical shapes of the ball-supports tend to be self cleaning in the presence of unwanted debris that may reside in the elastomeric tube chamber. Here, the spherical shape tends to push aside debris where intimate contact between the spherical balls and the supporting surface is not affected and the workpiece rotor does not experience unwanted tilting action due to debris being position between the vertical-stop supports.

The vertical-stop supports can be manufactured where the workpiece rotor workpiece mounting surface is precisely perpendicular to the rotational axis of the elastomeric tube spindle shaft. One configuration option is to align the rotational axis of the elastomeric tube spindle shaft to be precisely perpendicular to the top flat surface of an air-bearing abrasive spindle that has a floating spherical-action spindle mount. Then, the workpiece rotor is drawn against the vertical stops with vacuum and then the whole elastomeric tube workpiece head is lowered where the workpiece mounting surface of the workpiece rotor is held in abrading contact with that abrasive covered platen. This abrading action on the workpiece rotor will establish a flat workpiece mounting surface that is perpendicular to the elastomeric tube spindle axis of rotation. This set-up will allow the rigid spindle to grind or lap both surfaces of a workpiece to be precisely parallel to each other.

When an elastomeric tube workholder is used, the workpiece carrier rotor floats freely to provide uniform conformal contact of the workpiece flat surface with the flat-surface platen abrasive. This uniform conformal workpiece contact occurs even when there is a nominal perpendicular misalignment of the elastomeric tube workholder device rotation spindle shaft with the flat surface of the platen abrasive.

During an abrading operation, both the workpiece and the platen are rotating, often at the very high speeds of 3,000 rpm or more. Abrasive lapping and polishing at these speeds provide workpiece material removal rates that can exceed, by a factor of ten, the removal rates that are provided by conventional wafer polishing machines that often only rotate at speeds of approximately 30 rpm. However, to provide assurance that the floating elastomeric tube workholder workpiece carrier rotor has stable and smooth abrading operation, the individual and sub-assembly components of the elastomeric tube workholder are dynamically balanced. In addition, whenever the elastomeric tube workholder device is operated, the moving workpiece carrier rotor is constantly held in full flat-faced abrading contact with the moving platen abrasive surface during the abrading operation.

Typically at the start of an abrading procedure, the workpiece is placed in low abrading pressure flat-surfaced contact with the platen abrasive where both the workpiece and the platen are not rotating. Then the rotational speeds of both the workpiece and the platen are progressively increased, where they remain approximately equal to each other, as the abrading pressure is increased with the speed increase. The abrading speed-pressure operation is reversed at the last phase of the abrading procedure where the rotational speeds of both the workpiece and the platen are progressively decreased, where they remain approximately equal to each other, as the abrading pressure is also decreased as the rotational speeds are brought to zero. Low abrading speeds and low abrading pressures at the end-phase of an abrading procedure assures that the developed flatness of the workpiece is maintained as the lapping or polishing action on the workpiece is completed.

During the abrading process, a dynamic stabilizing factor for the "floating" wafer and wafer carrier rotor is the presence of the abrading pressures and forces that are applied to the abraded workpieces. Even though the abrading pressures used with the high speed flat lapping raised-island abrasive disks are only a small fraction of the abrading pressures commonly used in CMP pad wafer polishing, the total applied force on the wafer is still very large. Often, CMP pad abrading pressures range from 4 to 8 psi. The abrading pressures that are typically used with a raised-island abrasive disk are only about 1 psi.

However, because of the large surface area of a typical wafer, the total net downward force on that wafer is very large. For example, a 300 mm (12 inch) diameter wafer has a surface area of approximately 100 square inches. A 1 psi abrading pressure results in a net abrading force of about 100 lbs. This abrading force is applied uniformly across the full flat surface of the wafer. Here, the 100 lb force is used to force the wafer into abrading contact with the moving platen abrasive surface. This large applied abrading force prevents any separation of the wafer from intimate contact with the platen abrasive as the wafer is rotated. The wafer is held in abrading contact with the platen abrasive surface at all times and at all abrading speeds.

Lateral movement of the wafer and the wafer carrier rotor is prevented by the stationary-positioned carrier rotor idlers. These idlers maintain the lateral position of the carrier rotor even when the wafer and the carrier rotor are subjected to very large abrading forces that act laterally along the flat surface of the moving abrasive.

The dynamic balance of the rotating wafer carrier rotor is not affected when a new wafer is attached to the rotor when the wafer is concentrically centered on the rotor. Centering the wafer on the rotor is a simple attachment procedure because both the rotor and the wafer have circular shapes. Also, the weight of the thin wafer substrate is quite small compared to the weight of the wafer carrier rotor. Further, a slight off-center placement of a wafer on a carrier rotor will not have a significant impact on the dynamic action of the rotor. Any out-of-balance vibrations of the rotor that are caused a non-concentric placement of the wafer on the rotor will be immediately damped-out by the liquid damping action of the water film that is present between the wafer and the platen abrasive. The carrier rotor stationary idlers that surround the rotor and contact the rotor outer periphery also prevent out-of-balance vibrations from exciting the motion of the rotor as it rotates.

The elastomeric tube carrier can be operated at very high speeds with great stability even though the wafer and wafer rotor are supported by the very flexible elastomeric tube. Here, the coolant water film between the wafer and the flat moving abrasive provides dynamic stability to the rotating wafer. The coolant wafer film acts as a vibration-type damping agent when it is cohesively bonding the wafer to the abrasive. Cohesive bonding of the water film prevents the wafer from developing dynamic instabilities even when the wafer is rotated at very high speeds that can exceed 3,000 rpm. This cohesive bonding effect of water films is even a commonly used technique for the attachment of wafers to the wafer carrier heads that are used for CMP polishing of semiconductor wafers.

Because the wafer is attached to the carrier rotor with very large attachment forces that are created by the vacuum wafer attachment system, the wafer carrier rotor is also dynamically stabilized by the water film adhesive bonding forces. Typically, these water or liquid slurry bonding forces are so great between the wafer and a continuous-flat abrasive surface that large forces are required to separate a polished wafer substrate from the rotary platen precision-flat abrasive surface.

The slide-pin device must have sufficient rotational strength to successfully rotate the wafer when the wafer is subjected to these coolant water film cohesive bonding forces. Here, this very thin film of coolant water must be sheared when the wafer is rotated. As the abraded wafer becomes flatter, it assumes the precision-flatness of the platen abrasive surface and the water film becomes thinner. As the water film becomes thinner, the water cohesive bonding forces become larger and more torque is required to rotate the wafer and shear this film of water (or liquid slurry). Also, more torque is required to rotate the abrasive coated platen.

This effect is well known in the abrasives industry. The more perfect the flatness of a workpiece, the more torque is required to rotate both the wafer and the abrasive coated platen. And, more force is required to separate the finished workpiece substrate from the liquid coated platen. Because of the water or liquid abrasive slurry cohesion effect during the abrading process, the wafer remains in stable flat-surfaced contact with the rigid abrasive-coated platen throughout the abrading process.

One example of this type of sliding "stiction" can be seen by observing the "adhesive bonding" action that takes place when the water wetted flat surfaces of two glass plates are mutually positioned together with a very thin film of water in the small interface gap between the plates. After the plates are in full-faced flat contact, the plates become "adhesively bonded" to each other. Here it is very difficult to pull the two plates apart from each other in a direction that is perpendicular to the plate flat surfaces. Also, it is very difficult to slide one plate along the surface of the other plate.

The elastomeric tube workholder system can have one or more distance measuring sensors that can be used to provide assurance that a workpiece is in full flat-surfaced contact with the platen abrasive surface prior to rotation of the elastomeric tube workholder during an abrading procedure. It is desirable that the flexible elastomeric tube workholder is not rotated if the workpiece which is attached to the elastomeric tube workholder is not in full flat-surfaced contact with the platen abrasive surface. This is done to avoid dynamically unstable operation of the system. When the free-floating elastomeric tube rigid lower flange that the workpiece is attached to is allowed to move in a vertical direction along the rotational axis of the elastomeric tube without continual contact of the workpiece with the abrasive, undesirable oscillations of the workpiece can occur. Contact of the workpiece with the abrasive prevents these vibration-type oscillations from occurring. The workpiece can be rotated at slow speeds without contact of the workpiece with the abrasive but high speed rotation of the workpiece can cause These distance-measuring sensors can also be used to position the workpiece in flat-surfaced contact with the platen abrasive surface where the free-floating elastomeric tube workholder flange is positioned mid-span of the total allowable excursion distance of the flexible elastomeric tube device. Positioning the workholder flange at the nominal mid-span allows material to be removed from the workpiece surface during the abrading operation without contact of the elastomeric tube device vertical stops. Because the motion of the workpiece is not impeded by the vertical stop devices, the abrading pressure can be accurately controlled throughout the abrading procedure.

Use of non-contacting ultrasonic or laser distance measuring sensors that are mounted on the stationary frame of the elastomeric tube device allows the distances to the movable workholder to be accurately determined. Also, contact-type mechanical or electronic measuring devices including calipers, vernier calipers, micrometers and LVDTs (linear variable differential transformers) can be used to measure the distances between locations on the stationary elastomeric tube device frame and locations on the exposed surface of the elastomeric tube workholder device that the workpieces are attached to. The measurements are typically made between a point or spot-area on the exterior surface of the free-floating rigid flange that is attached to flexible elastomeric tube. These reference distance measurements can be made when workpieces are attached to the free-floating rigid flange that is attached to flexible elastomeric tube or when no workpiece is attached to the floating flange.

This distance is measured to selected areas on the elastomeric tube rigid lower flange when the flange is stationary or moving. One or more of these distance sensors can be used to independently measure distances at different locations around the periphery of the movable rigid lower flange. Typically the rigid flange moves downward vertically as air pressure is increased in the sealed elastomeric tube chamber. The flange can also be moved upward vertically if vacuum is applied to the sealed elastomeric tube chamber. Each of the sensors can independently measure a distance to a selected area-spot on a rotating workholder. Here, an angular-position device such as an encoder can be attached to the elastomeric tube rotary drive shaft and used to position a selected flange area-spot to be rotationally aligned with the selected stationary distance-sensor.

The distance sensors can also be used to dynamically detect the existence and location of non-parallel surfaces on workpieces as they are rotated and abraded. Here, the distances to the selected flange area-spots, as measured by the stationary sensors, will change as the workpiece is rotated which indicates the existence of non-parallel workpiece opposed surfaces. The targeted position spot-areas on the circumference of the elastomeric tube lower floating flange can be located with the use of the elastomeric tube rotary drive shaft encoder. If desired, vacuum can be applied to the elastomeric tube chamber to force the lower flange, with the attached workpiece, vertically upward against a elastomeric tube workpiece device internal-stop and the whole elastomeric tube workholder can be lowered vertically to abrade the non-parallel workpiece surface. With this process procedure, the distance sensor and the elastomeric tube device abrading control system are used to abrade the workpiece non-parallel surface until it becomes co-planar with the opposed workpiece surface that is attached to the elastomeric tube workholder.

The thickness of the abraded workpieces can be controlled very precisely with the use of the distance sensors. The sensors can be used to measure the thickness of a workpiece prior to abrading activity and can be used to dynamically determine the amount of material that has been removed from the workpieces and to determine the rate of material removal from the workpieces during the abrading procedure. Multiple distance sensors can be positioned around the circumference of the circular workpiece carriers which can be used to determine the parallelism of the two opposed flat surfaces of workpieces by providing position data to a control or monitoring system device.

As a part of the procedure of positioning the workpiece in flat-surfaced contact with the platen abrasive, the air pressure in the elastomeric tube chamber can be increased by a selected increment. Then a distance sensor, or multiple sensors, can be activated to determine if the rigid elastomeric tube flange moves downward from the position that existed before the elastomeric tube chamber pressure was increased. If the elastomeric tube flange distance does not increase substantially with the increase of the elastomeric tube chamber pressure, it is now established that the workpiece that is attached to the elastomeric tube rigid lower flange is in contact with the platen abrasive. This pressure-change test is done when both the elastomeric tube-attached workpiece and the platen are stationary.

Because the workpiece and the elastomeric tube lower flange are rigid, they will not be nominally compressed when the typically-small incremental pressure increase is applied to the flexible elastomeric tube sealed chamber. A small amount of movement of the elastomeric tube flange can occur if the film of coolant water that exists on the surface of the platen abrasive is reduced in water film thickness. The very thin water film could be reduced in thickness due to the incremental pressure increase that is applied to the flexible elastomeric tube sealed chamber. However, the reduction in the water film thickness is typically very small compared to the total allowable vertical excursion distance controlled by the elastomeric tube device. If desired, the workpiece contact and alignment process can be repeated where the elastomeric tube chamber pressure can be increased another increment and the distance measurements can be made. This procedure can be repeated until assurance is provided that the workpiece is in full flat-surfaced contact with the platen flat-surfaced abrasive coating.

Also, a workpiece position control system can be used with the elastomeric tube workholder device. Here, a process procedure protocol can be established to use the stationary distance sensors to establish a reference-base of information. For example, reference data can be generated to establish where the flexible elastomeric tube rigid flange is positioned relative to the allowable range of motion that controls the vertical excursion of the elastomeric tube device lower flange vertically along the axis of rotation of the elastomeric tube device. With this described system, the elastomeric tube device has built-in mechanical-stop devices that limit the total excursion of the flexible elastomeric tube to a total vertical excursion of approximately 0.25 inches (0.63 cm).

The uppermost and lowermost reference measured distances can be established by simply applying vacuum or air pressure to the elastomeric tube sealed pressure chamber. To determine when a flexible elastomeric tube rigid flange is positioned at its uppermost position, where the elastomeric tube device upper vertical stop is contacted, sufficient vacuum can be applied to the elastomeric tube pressure chamber to move the flexible elastomeric tube rigid flange upward into this upper-stop contacting position. This uppermost raised reference dimension distance can then be measured by the distance sensor or sensors. To determine when the flexible elastomeric tube rigid flange is positioned at its lowermost position, where the elastomeric tube device lower vertical stop is contacted, sufficient air pressure can be applied to the elastomeric tube pressure chamber to move the flexible elastomeric tube rigid flange into this lower-stop contacting position. This lowermost reference dimension distance can then be measured by the distance sensor or sensors.

It is desired that the workpiece is abraded when the flexible elastomeric tube device rigid lower flange and the workpiece is positioned at the nominal-center of the total excursion range of 0.25 inches (0.63 cm). In this nominal-center position, the rigid lower flange, with the attached workpiece, is free to travel vertically upward by a nominal 0.125 inches (0.317 cm) which is about one-half of the total 0.25 inch (0.63 cm) excursion range. The flange and the workpiece are also free to travel vertically 0.125 inches (0.317 cm) downward from this workpiece-centered position. This position provides sufficient downward excursion of the workpiece to allow for the vertical travel of the elastomeric tube flange to make up for the material that is removed from the workpiece surface by abrading action In one example, a process is described for centering the workpiece position where it is in flat-surfaced contact with the platen abrasive while the elastomeric tube rigid flange is positioned vertically at the nominal center of the total elastomeric tube flange excursion distance. Here, the distance sensor or sensors or measuring devices are used to establish the upper and lower excursion position limits of the flexible elastomeric tube workholder rigid flange that the workpiece is attached to. First, the workpiece is attached to the movable elastomeric tube rigid lower flange. Then sufficient air pressure is applied to the elastomeric tube sealed abrasive pressure chamber to force the elastomeric tube lower flange into the elastomeric tube-device internal downward vertical stop device. This downward vertical-stop distance is then established as a reference distance.

Next, the whole elastomeric tube assembly is lowered vertically until the attached workpiece just contacts the platen flat abrasive surface. The whole elastomeric tube assembly is then further lowered until the elastomeric tube rigid flange is positioned at the nominal-center of the elastomeric tube workholder total allowable vertical excursion distance. During this last assembly lowering action, the flexible elastomeric tube is collapsed somewhat in a vertical direction to allow the workpiece to maintain its flat-faced contact with the platen abrasive flat surface while the whole elastomeric tube assembly is lowered vertically. The additional non-vertical flexibility of the elastomeric tube allows the workpiece to assume its desired flat-faced contact with the platen abrasive flat surface.

After the workpiece is positioned in flat-faced contact with the platen abrasive where the elastomeric tube rigid flange is positioned at the nominal-center of the elastomeric tube workholder total allowable vertical excursion distance, the workpiece abrading procedure is begun. Here, a selected abrading air pressure is applied to the sealed elastomeric tube chamber to establish the workpiece abrading pressure that is desired for the start of the workpiece surface abrading procedure. Both the elastomeric tube workholder and the platen rotations are started after the desired abrading pressure is applied to the workpiece. During the full abrading procedure both the abrading pressures and the abrading speeds of the workpiece and the platen are changed at different process times as a function of the abrading protocol used for the selected workpiece and the type of abrading that is done. Workpiece abrading actions can include grinding, lapping and polishing.

The non-contact distance measurement sensors can also be used to dynamically monitor the amount of material that is removed from the abraded surface of the workpiece during the abrading procedure. As the material is removed from the surface of the workpiece, the workpiece becomes thinner and the elastomeric tube rigid flange that is attached to the flexible elastomeric tube moves downward toward the platen abrasive surface. As the elastomeric tube rigid flange moves downward, the measured distance between the stationary elastomeric tube device frame and the elastomeric tube rigid flange increases. Measurement sensors can easily determine these distance changes of much less than 0.0001 inches (0.254 micron) of material removal from a workpiece surface. Use of single or multiple measurement sensors that are positioned around the circumference of the elastomeric tube rigid flange workholder device can provide additional information as to the parallelism of the workpiece abraded surface and the workpiece non-abraded surface. These measurements can be made when the workholder is stationary or they can be dynamic measurements that are made when the workpiece is rotated.

Figure 34:
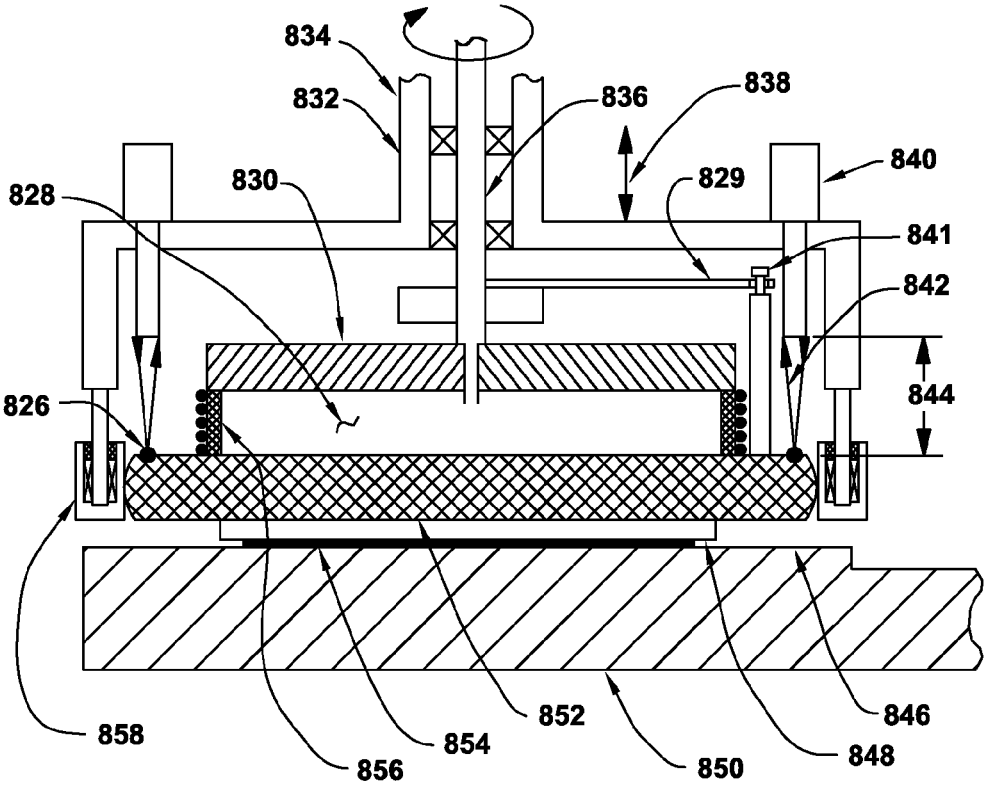
FIG. 34 is a cross section view of a slide-pin workholder having measurement devices.

FIG. 34 is a cross section view of a slide-pin driven floating workpiece carrier having workpiece rotor position measurement devices. A stationary workpiece carrier head assembly 834 has a flat-surfaced workpiece 848 that is attached to a rigid floating workpiece carrier rotor 852. The workpiece carrier rotor 852 is rotationally driven by a slide-pin arm 829 and a slide-pin device 841 that is attached to a sliding pin bracket that is attached to a rotational drive shaft 836. The nominally-horizontal drive plate 830 is attached to the hollow drive shaft 836, having a rotation axis, which is supported by a vertically movable stationary carrier housing 832 where the carrier housing 832 can be raised and lowered in a vertical direction 838. The flexible elastomeric tube device 856 that is attached to the drive plate 830 is also attached to the workpiece carrier rotor 852 that is rotationally driven by the slide-pin arm device 829.

The workpiece carrier rotor 852 has an outer periphery that has a spherical shape which allows the workpiece carrier rotor 852 outer periphery to remain in contact with stationary rotational roller idlers 858 when the rotating carrier rotor 852 is tilted. The workpiece carrier rotor 852 and the flexible elastomeric tube device 856 have rotation axes that are coincident with the hollow drive shaft 836 rotation axis. The workpiece 848 that is attached to the workpiece carrier elastomeric tube lower flange rotor 852 is rotationally driven by the flexible slide-pin device 829. The workpiece 848 is shown in abrading contact with the abrasive 854 coating on the flat surface 846 of the rotary platen 850.

Pressurized air can be supplied through the hollow drive shaft 836 that has a fluid passage that allows the pressurized air, or vacuum, to fill the sealed chamber 828 that is formed by the sealed flexible elastomeric tube device 856. The flexible elastomeric tube device 856 has a vertical spring constant which allows the force to be calculated that is required to compress or expand the elastomeric tube 856 a specified vertical distance. The flexible elastomeric tube device 856 has a vertical spring constant which allows the force to be calculated that is required to compress or expand the elastomeric tube 856 a specified distance. The flexible elastomeric tube device 856 also has a lateral or horizontal spring constant which allows the force to be calculated that is required to distort the elastomeric tube 856 a specified lateral or horizontal distance.

The workpiece carrier rotor 852 and the flat-surfaced workpiece 848 such as a semiconductor wafer is allowed to be tilted from a horizontal position when they are stationary or rotated by the flexing action provided by the elastomeric tube devices 856 that can be operated at very high rotational speeds. One or more distance measurement devices 840 are attached to the stationary non-rotating stationary workpiece carrier head assembly 834 stationary carrier housing 832 where the stationary non-rotating stationary workpiece carrier head assembly 834 and the stationary carrier housing 832 can be raised and lowered vertically in the direction 838.

Multiple distance measurement devices 840 can be positioned around the outer periphery of the workpiece carrier rotor 852 and can be used to provide independent measurements of the distances 844. The measurement distances 844 are equivalently measured from the stationary carrier housing 832 to a selected area spot 826 located on a surface of the floating workpiece carrier elastomeric tube lower flange rotor 852 which the workpiece 848 is attached to. Non-contacting ultrasonic or laser distance measuring sensors devices 840 or contact-type mechanical or electronic measuring devices including calipers, vernier calipers, micrometers and linear variable differential transformers (LVDT) can be used to measure the distances 844. A non-contacting measuring device 840 emits and receives rays or signals 842 that indicate the distances 844.

Figure 35:
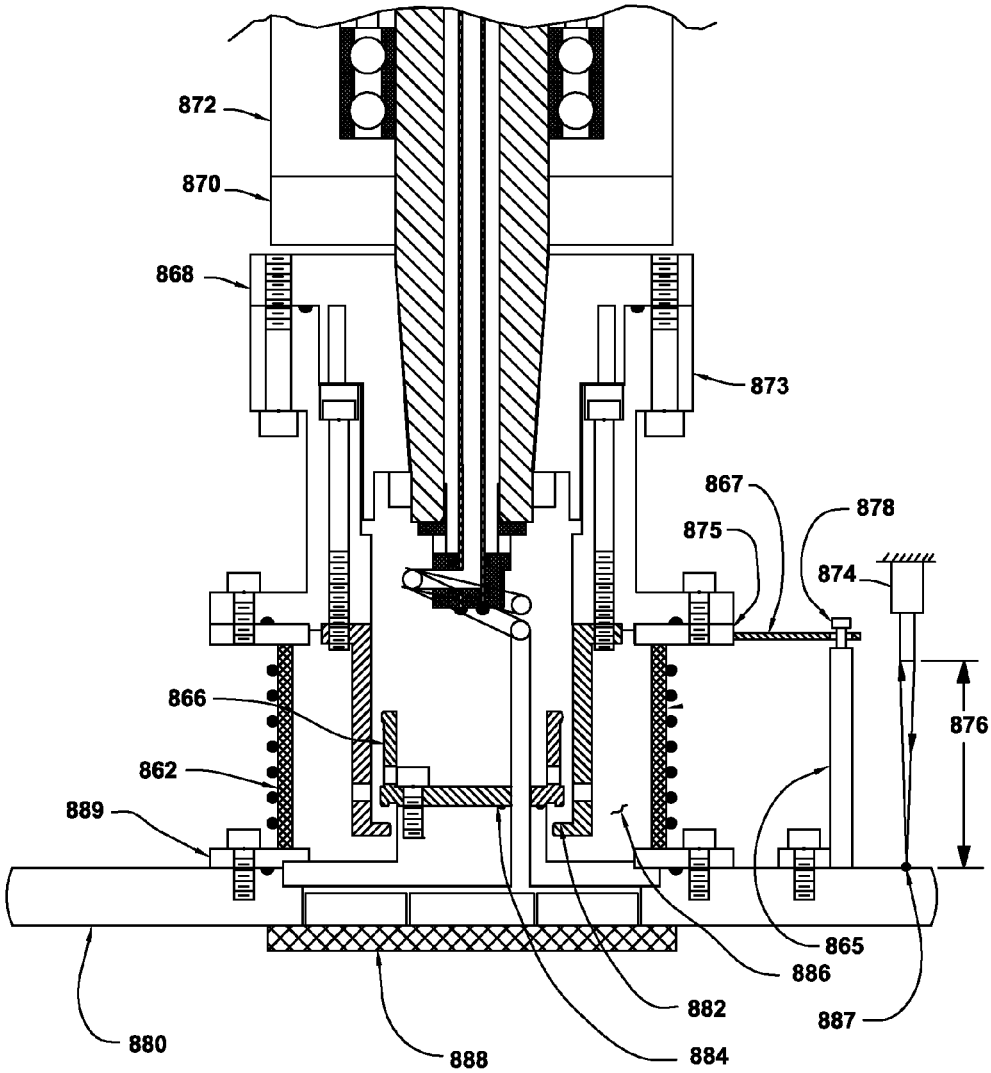
FIG. 35 is a cross section view of a slide-pin workpiece carrier with distance sensors.

FIG. 35 is a cross section view of a slide-pin floating workpiece carrier with distance sensors. A rotary spindle 872 has a rotary end 870 and shaft having an attached rotary spindle head 868. A flexible elastomeric tube 862 has an attached upper elastomeric tube flange 875 that rotates with the rotary spindle 872 rotary end 870 but is held stationary in a vertical direction along the rotational axis of the elastomeric tube 862 and the rotary spindle 872. The flexible elastomeric tube 862 also has an attached free-floating lower elastomeric tube flange 889 that rotates where a workpiece 888 is attached to a rotary workholder 880 that is attached to the elastomeric tube lower rigid flange 889.

A vertical stop device 882 is attached to the rotary spindle head 868 and acts in conjunction with the elastomeric tube stop-device 866 that is attached to the free floating rotary workholder 880. The vertical stop device 882 and the stop-device 866 act with the rotary workholder 880 to limit the excursion travel of the free-floating rotary workholder 880 in a upward or downward vertical direction along the rotational axis of the elastomeric tube 862 and the rotary spindle 872 and also acts to limit the excursion travel of the free-floating rotary workholder 880 in a lateral or horizontal direction perpendicular to the rotational axis of the elastomeric tube 862 and the rotary spindle 872. When the vertical stop device 882 contacts the elastomeric tube stop-device 866 at the contact point 884 the free-floating rotary workholder rotor 880 and the attached workpiece 888 are restrained in a downward vertical direction.

The workpiece carrier rotor 880 has a vacuum-attached workpiece 88. The carrier rotor 888 is attached to a pin bracket 865 that has an attached slide-pin 878 that is in sliding contact with a slide pin arm 867 that is attached to a upper elastomeric tube flange 875 that is attached to a rotary workpiece carrier housing 873. The slide-pin 878 can slide horizontally and vertically (up and down and sideways in the figure) relative to the slide pin arm 867 and maintain contact with the slide pin arm 867 to transmit workpiece carrier rotor 880 rotational forces that are applied by the slide pin arm 867 to the slide-pin 878. The slide pin 878 moves in a vertical direction along the rotation axis of the rotary spindle 872

One or more stationary non-contacting distance sensors 874 can be used to measure the distance 876 between target measuring spot-areas 887 located on the rotary workholder 880 and a stationary position on the elastomeric tube floating workpiece carrier device stationary frame (not shown) at one or more locations around the periphery of the circular rotary workholder 880. The distance sensors can also be contacting-type sensors or mechanical distance read-out devices. The sensors can be activated to independently or simultaneously measures the multiple reference distances around the periphery of the circular rotary workholder 880 to determine the position of the elastomeric tube 862 or the amount of the elastomeric tube 862 expansion relative to the center-point (not shown) of the total allowed vertical excursion.

The single or multiple sensors 874 can also be used to determine the amount of material that was removed from a workpiece during the abrading procedure or determine the rate of material removal from the workpiece 888. These single or multiple sensors can also be used to determine the state of co-planar parallelism between the two opposed surfaces of a workpiece 888 at each stage of an abrading procedure or dynamically during the abrading procedure.

Controlled-pressurized air or vacuum can be routed to the sealed elastomeric tube chamber 886 to provide abrading pressure which forces the workpiece 888 against an abrasive surface (not shown) on a rotary platen (not shown). The controlled pressure air in the elastomeric tube chamber 886 acts against the elastomeric tube 862 vertical spring constant to expand the flexible elastomeric tube 862 vertically a selected distance which moves the free-floating lower elastomeric tube flange 875 and the attached workpiece 888 a selected or calculated vertical distance. A vacuum can also be applied to the elastomeric tube chamber 886 to act against the elastomeric tube 862 vertical spring constant to contract the flexible elastomeric tube 862 vertically a selected distance which moves the free-floating lower elastomeric tube flange 875 and the attached workpiece 888 a selected or calculated upward vertical distance.

Figure 36:
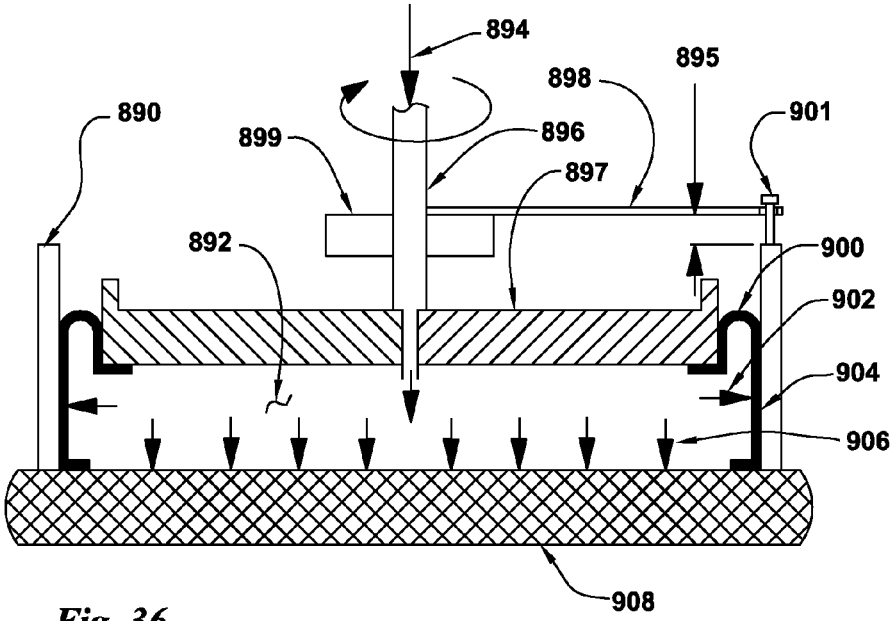
FIG. 36 is a cross section view of a slide-pin workholder with a rolling diaphragm.

FIG. 36 is a cross section view of a slide-pin workholder with a rolling diaphragm. A horizontal rotatable plate 897 is attached to and rotationally driven by a shaft 896 having a drive hub 899. An annular elastomeric rolling diaphragm 904 having an annular elastomeric crest 900 is attached to the rotatable plate 897 and is attached to a workpiece carrier rotor 908 which together form a sealed chamber 892 which can be pressurized with a fluid having a pressure 894 where the fluid has a fluid passageway in the hollow shaft 896. Annular elastomeric rolling diaphragms 904 can be supplied by the Bellofram Corporation of Newell, W. Va.

When an abrading pressure 894 is applied through the hollow shaft 896 and to the sealed chamber 892, a pressure force 906 is applied to the top surface of the workpiece carrier rotor 908 where the pressure 906 is then applied to a workpiece (not shown) attached to the workpiece carrier rotor 908 as it contacts a moving platen (not shown) flat abrading surface. The pressure 906 also tends to urge the workpiece carrier rotor 908 downward where the top annular elastomeric crest 900 of the annular rolling diaphragm 904 rolls downward in a direction along the vertical rotation axis of the drive shaft 896. The pressure 894 also produces a pressure force 902 that acts radially against the vertical wall of the rolling diaphragm 904, pushing it against the rigid vertical wall of a workpiece carrier rotor 908 annular support bracket 890.

A slide-pin drive arm 898 is attached to the drive shaft 896 drive hub 899 where the slide-pin drive arm 898 is in sliding contact with a slide-pin 901 that is attached to an annular wall bracket 890 that is attached to the workpiece carrier rotor 908. Rotation of the drive shaft 896 rotates the workpiece carrier rotor 908. When applied pressure 894 moves the workpiece carrier rotor 908 down the vertical axis a distance 895, the slide-pin 901 moves downward but remains in sliding contact with the slide-pin drive arm 898.

Figure 37:
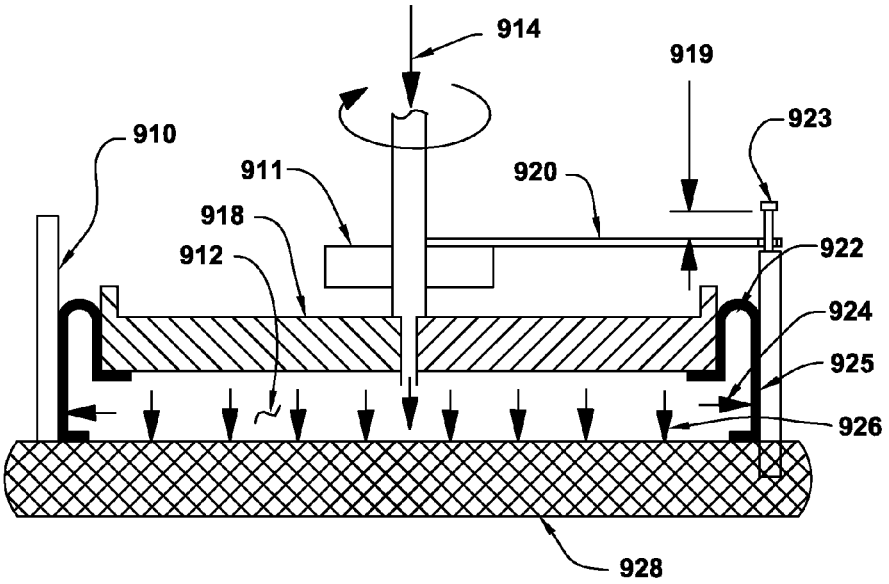
FIG. 37 is a cross section view of a lowered slide-pin workholder with a rolling diaphragm.

FIG. 37 is a cross section view of a lowered slide-pin workholder with a rolling diaphragm. When an abrasive workholder (not shown) is lowed where the workpiece (not shown) is in abrading contact with an abrasive coating on a rotary platen (not shown), the workpiece carrier rotor 928 is typically moved upward relative to the workholder. Here, a horizontal rotatable plate 918 is attached to and rotationally driven by a shaft 916 having a drive hub 917. An annular elastomeric rolling diaphragm 925 having an annular elastomeric crest 922 is attached to the rotatable plate 918 and is attached to a workpiece carrier rotor 928 which together form a sealed chamber 912 which can be pressurized with a fluid having a pressure 914 where the fluid has a fluid passageway in the hollow shaft 916.

When an abrading pressure 914 is applied through the hollow shaft 916 and to the sealed chamber 912, a pressure force 926 is applied to the top surface of the workpiece carrier rotor 928 where the pressure 926 is then applied to a workpiece attached to the workpiece carrier rotor 928 as it contacts a moving platen flat abrading surface. When the workpiece carrier rotor 928 moves upward, the top annular elastomeric crest 922 of the annular rolling diaphragm 925 rolls upward in a direction along the vertical rotation axis of the drive shaft 916. The pressure 914 also produces a pressure force 924 that acts radially against the vertical wall of the rolling diaphragm 925, pushing it against the rigid vertical wall of a workpiece carrier rotor 928 annular support bracket 910.

A slide-pin drive arm 920 is attached to the drive shaft drive hub 911 where the slide-pin drive arm 920 is in sliding contact with a slide-pin 923 that is attached to an annular wall bracket 910 that is attached to the workpiece carrier rotor 928. Rotation of the drive shaft rotates the workpiece carrier rotor 928. When applied pressure 914 moves the workpiece carrier rotor 928 up the vertical axis a distance 919, the slide-pin 923 moves upward but remains in sliding contact with the slide-pin drive arm 920.

Figure 38:
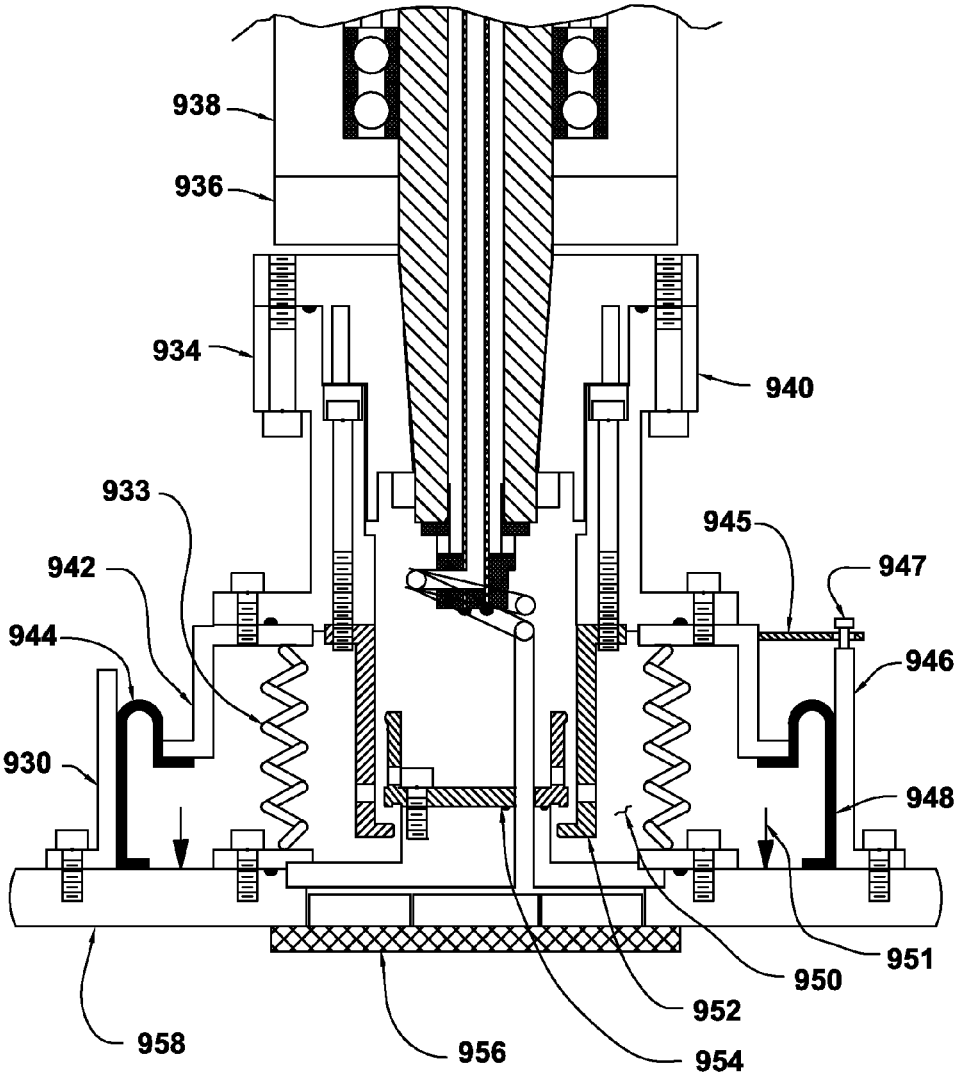
FIG. 38 is a cross section view of a slide-pin spindle workholder with a rolling diaphragm.

FIG. 38 is a cross section view of a slide-pin spindle workholder with a rolling diaphragm. A rotary spindle 938 has a rotary end 936 and shaft having an attached rotary spindle head 934. A flexible annular rolling diaphragm 948 is attached to an upper rolling diaphragm flange 942 that rotates with the rotary spindle 938 rotary end 936 but is held stationary in a vertical direction along the rotational axis of the rolling diaphragm 948 and the rotary spindle 938. The flexible rolling diaphragm 948 is also attached to the free floating rotary workholder 958.

A vertical stop device 952 is attached to the rotary spindle head 934 and acts in conjunction with the rolling diaphragm stop-device 954 that is attached to the free floating rotary workholder 958. The vertical stop device 952 and the stop-device 954 act with the rotary workholder 958 to limit the excursion travel of the free-floating rotary workholder 958 in a upward or downward vertical direction along the rotational axis of the rolling diaphragm 948 and the rotary spindle 938 and also acts to limit the excursion travel of the free-floating rotary workholder 958 in a lateral or horizontal direction perpendicular to the rotational axis of the rolling diaphragm 948 and the rotary spindle 938. When the vertical stop device 952 contacts the rolling diaphragm stop-device 954 the free-floating rotary workholder rotor 958 and the attached workpiece 956 are restrained in a downward vertical direction.

The workpiece rotor 958 has a vacuum-attached workpiece 956. The workpiece rotor 958 is attached to a rotary workpiece carrier housing 940 by a slide-pin arm 945 that is in sliding contact with a slide-pin 947 that is attached to an annular bracket 930.

Controlled-pressurized air or vacuum can be routed to the sealed rolling diaphragm chamber 950 to provide abrading pressure which forces the workpiece 956 against an abrasive surface (not shown) on a rotary platen (not shown). The controlled pressure 951 in the rolling diaphragm chamber 950 acts against the extension spring 933 that is attached to the upper rolling diaphragm flange 942 and to the workpiece rotor 958. Here, the counterbalance extension springs 933 provides a lifting force along the rotational axis of the rolling diaphragm 948 and the rotary spindle 938 to support the weight of the workpiece carrier rotor 958 and the workpiece 956 and to raise the workpiece 956 away from the abrasive surface when the abrading pressure 894 in the sealed chamber 950 is reduced.

Figure 39:
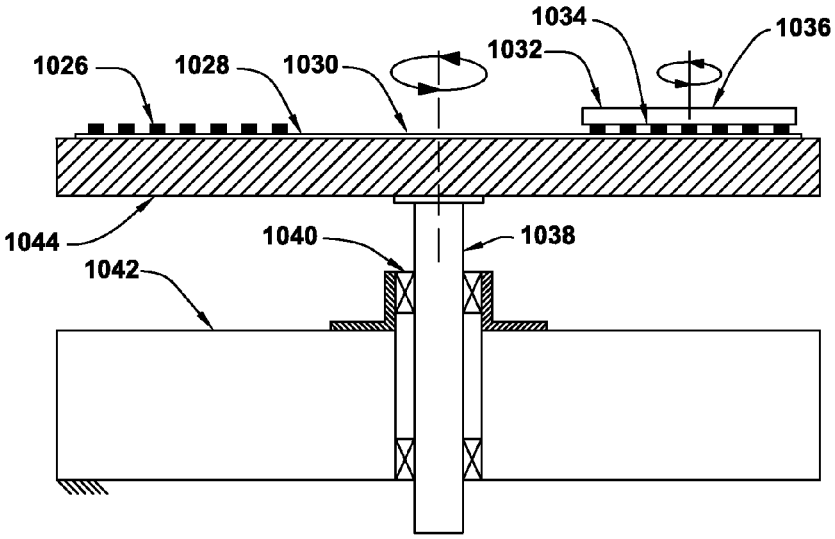
FIG. 39 is a cross section view of a rotatable platen with a raised-island abrasive disk.

FIG. 39 is a cross section view of a rotatable platen with a raised-island abrasive disk. An abrasive disk 1028 having an annular band of abrasive coated raised islands 1026 that are attached to the disk 1028 transparent or non-transparent backing 1030 is attached to a flat-surfaced rotary platen 1044. A circular-shaped wafer substrate 1032 has a wafer back-side flat surface 1036 and has an abraded flat surface 1034 that is in abrading contact with the abrasive-coated raised islands 1026. The platen 1044 is attached to a rotary shaft 1038 that is supported by bearings 1040 that are supported by a machine base 1042. The wafer substrate 1032 can also be a workpiece that is lapped or polished.

Figure 40:
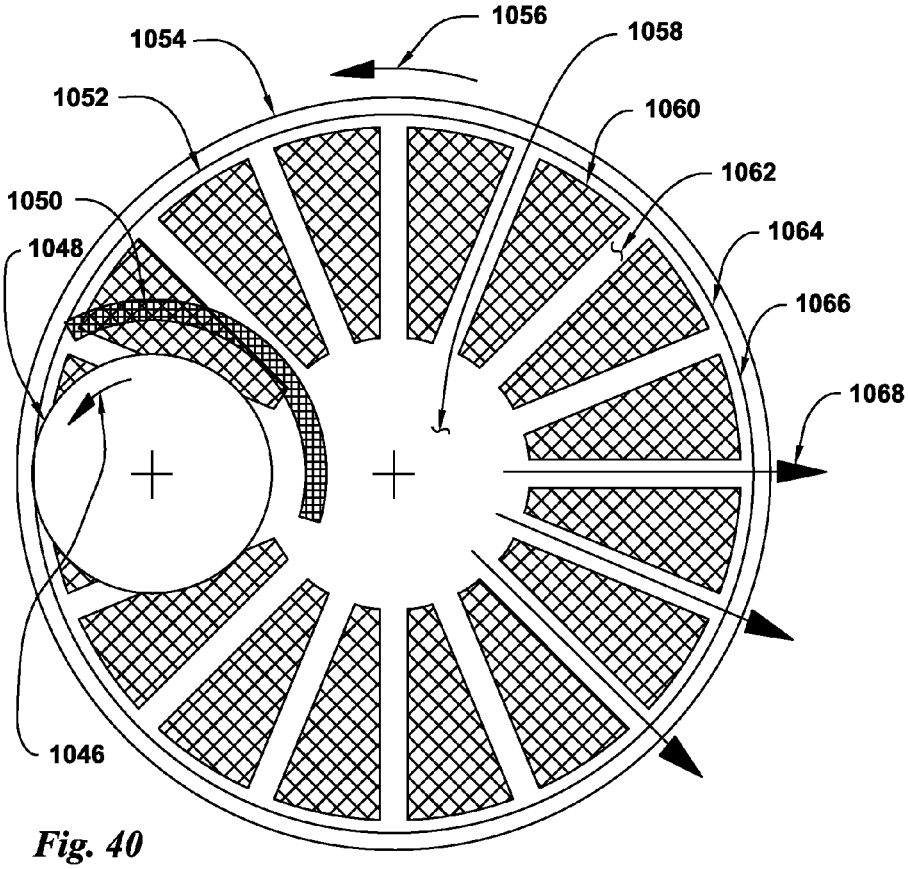
FIG. 40 is a top view of a rotatable platen with a radial-bar raised-island abrasive disk.

FIG. 40 is a top view of a rotatable platen with a flexible radial-bar raised-island abrasive disk. An abrasive disk 1052 having an annular band of pie-shaped abrasive coated raised islands 1060 that are attached to the disk 1052 backing 1064 that is attached to a flat-surfaced rotary platen 1054. A flat-surfaced rotary wafer substrate 1048 has an abraded surface that is in abrading contact with the abrasive-coated raised islands 1060. The raised-island abrasive disk 1052 has a continuous transparent or non-transparent backing 1064 where the abrasive disk 1052 center-area 1058 is free of raised islands 1060 and where the continuous backing 1064 allows the flexible abrasive disk 1052 to be attached to the platen flat-surfaced platen 1054 with vacuum.

A coolant water-bar 1050 applies coolant water (not shown) to the outer periphery of the rotating workpiece 1048 in an water-wetted area that is upstream of the rotating workpiece 1048 as observed from a position on the workpiece 1048 looking at the approaching abrasive raised islands 1060 that are transported toward the workpiece 1048 by the rotating platen 1054 that rotates in a direction 1056. The workpiece 1048 rotates in the same direction as the platen 1054 in a direction 1046 to provide uniform abrading speeds across the full abraded surface of the workpiece 1048. The coolant water-bar 1050 also applies coolant water to the central non-island portion area of the annular abrasive disk 1052. The applied coolant water contacts the top surfaces of the individual raised islands 1060 as they approach the stationary-position but rotating workpiece 1048 and is also applied to the open recessed-area channels 1062 that are located between adjacent pie-shaped abrasive coated raised islands 1060.

The excess coolant water washes-off any abrading debris (not shown) that exists on the top surface of the raised islands 1060 prior to these washed-islands contacting the workpiece 1048. The debris is carried by the coolant water and routed into the recessed radial channels 1062 by gravity forces. Applied coolant water also flows radially outward in the radial channels 1062 to the outer periphery 1066 of the raised-island abrasive disk 1052 which flushes the abrading debris 1068 off the abrasive disk 1052. Here, centrifugal forces generated by rotation of the rotating platen 1054 drives the excess coolant water and the combined-water-carried abrading debris 1068 past the outer periphery 1066 of the abrasive disk 1052. These radial streams of water and debris 1068 flow within the recessed radial channels 1062 at a level below the top surfaces of the abrasive-coated raised islands 1060 which prevents the debris 1068 from contaminating the top exposed abrasive surface of the raised islands 1060 and creating scratches on the abraded surface of the workpieces 1048. Water is continuously applied to the moving abrasive disk 1052 which provides continuous washing of the rotating workpiece 1048 as it is abraded and continuous washing of the abrasive disk 1052.

Figure 41:
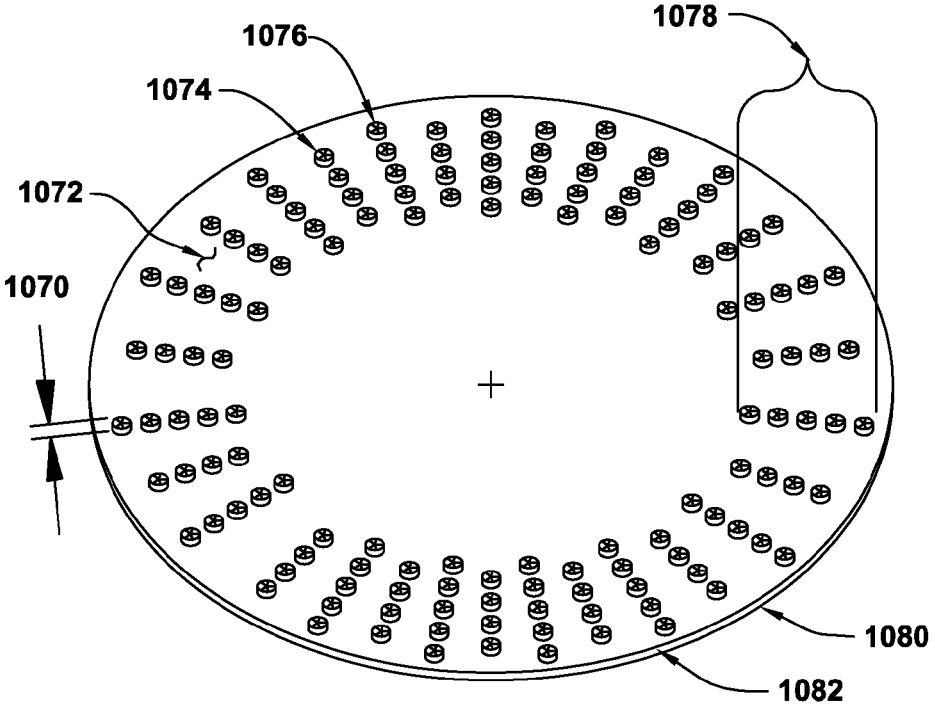
FIG. 41 is an isometric view of an abrasive disk with an annual band of raised islands.

FIG. 41 is an isometric view of an abrasive disk with an annual band of raised islands. A flexible abrasive disk 1012 has attached raised island structures 1074 that are top-coated with abrasive particles 1076 where the island structures 1074 are attached to a disk 1012 transparent or non-transparent backing 1014. The raised-island disk 1012 has annular bands of abrasive-coated 1076 raised islands 1074 where the annular bands have a radial width of 1078. Each island 1074 has a typical width 1070. The islands 1074 can be circular as shown here or can have a variety of shapes comprising radial bars (not shown) where the abrasive-coated 1076 raised islands 1074 allow the abrasive disks 1080 to be used successfully at very high abrading speeds in the presence of coolant water without hydroplaning of the workpieces (not shown). There are channel gap openings 1072 that exist on the abrasive disk 1080 between the raised island structures 1074.

For high speed flat lapping or polishing, the abrasive disk 1012 has an overall thickness variation, as measured from the top of the abrasive-coated 1076 raised islands 1074 to the bottom surface of the abrasive disk backing 1082, that is typically less than 0.0001 inches 0.254 micron). This abrasive disk 1012 precision surface flatness is necessary to provide an abrasive coating that is uniformly flat across the full annular band abrading surface of the abrasive disk 1012 which allows the abrasive disk 1012 to be used at very high abrading speeds of 10,000 surface feet (3,048 m) per minute or more. These high abrading speeds are desirable as the workpiece material removal rate is directly proportional to the abrading speeds.

Figure 42:
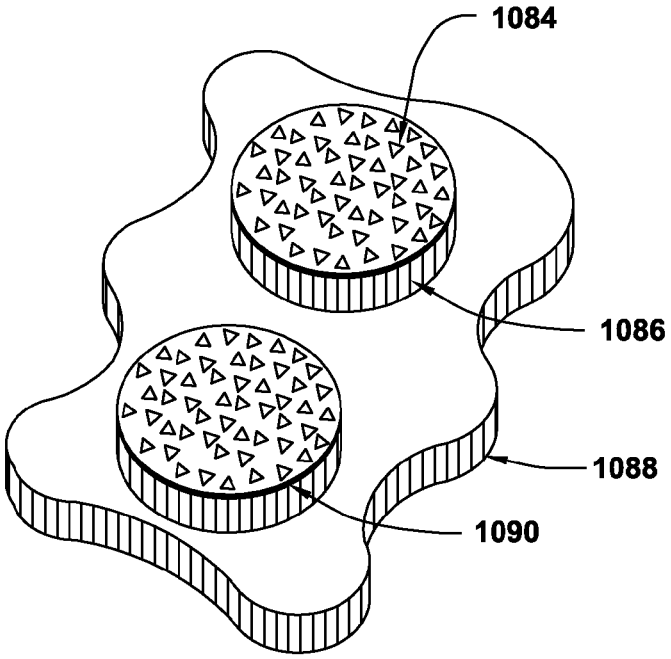
FIG. 42 is an isometric view of a portion of an abrasive disk with individual raised islands.

FIG. 42 is an isometric view of a portion of an abrasive disk with individual raised islands. A transparent or non-transparent backing sheet 1088 has raised island structures 1086 that are top-coated with an abrasive-slurry layer mixture 1022 which is filled with abrasive particles 1084. The abrasive coating 1090 on the raised islands 1086 includes individual abrasive particles 1084 or ceramic spherical beads (not shown) that are filled with very small diamond, cubic boron nitride (CBN) or aluminum oxide abrasive particles. The sizes of the abrasive particles 1084 contained in the beads ranges from 60 microns to submicron sizes where the smaller sizes are typically used to polish semiconductor wafers.

Figure 43:
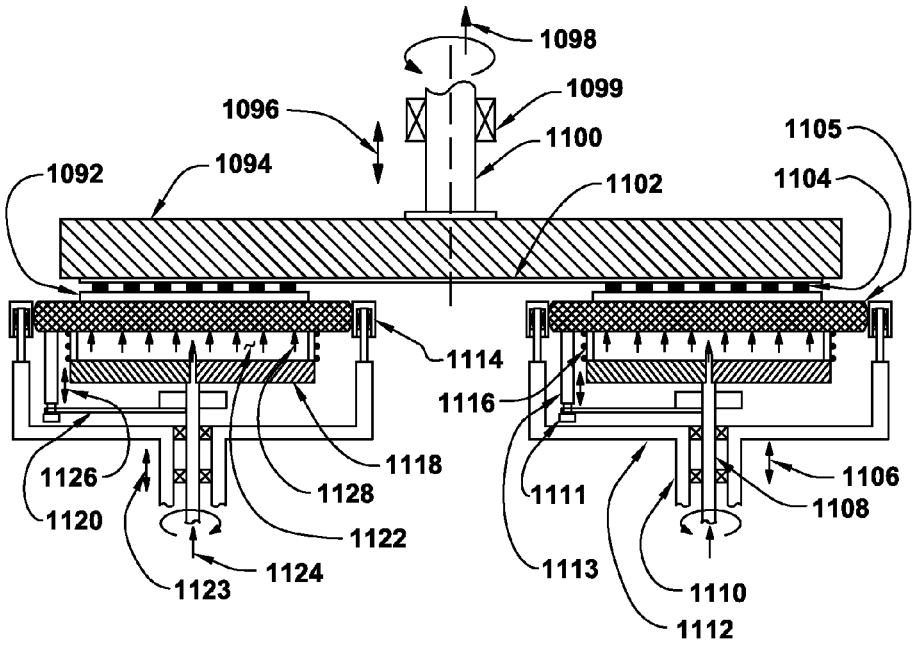
FIG. 43 is a cross section view of a platen with a bottom-side slide-pin abrading heads.

FIG. 43 is a cross section view of a platen with a bottom-side slide-pin floating abrading head disk. A horizontal rotary platen 1094 is mounted where an abrasive disk 1102 is attached to the platen 1094 lower surface where the abrasive disk 1102 has an annular band of abrasive coated raised islands 1104 that are attached to the disk 1102 transparent or non-transparent backing which is attached to a flat-surfaced rotary platen 1094 with vacuum. 1098. The platen 1094 is attached to a rotary shaft 1100 that is supported by bearings 1099 that are supported by a machine base (not shown).

At least one workpiece abrading head 1112 is positioned below the horizontal rotary platen 1094 and are positioned around the circumference of the horizontal rotary platen 1094 where at least one circular-shaped wafer substrate 1092 having a wafer back-side flat surface and an abraded flat surface can be positioned to be in abrading contact with the abrasive-coated raised islands 1104. The wafer workpiece 1092 is attached to a rotatable workpiece rotor 1105 with vacuum where the rotatable workpiece rotor 1105 has a spherical-shaped outer periphery edge that contacts multiple idlers 1114 that are spaced around the circumference of the rotatable floating workpiece rotor 1105 to hold the stationary-position rotating workpiece rotor 1105 laterally to resist horizontal abrading forces that are applied to the wafer substrates 1092 by the moving abrasive disk 1102.

The workpiece abrading heads 1112 have a housing frame 1110 that can be raised or lowered in a vertical direction 1106 to position the wafer substrate 1092 to be in abrading contact with the abrasive-coated raised islands 1104 or to lower the wafer workpiece 1092 to separate it a distance from the abrasive-coated raised islands 1104. The workpiece abrading heads 1112 have a drive plate 1118 which is attached to a flexible annular wire-reinforced elastomeric tube 1116 or a flexible elastomeric annular rolling diaphragm 1116.

The workpiece abrading heads 1112 are rotationally driven by a slide-pin arm 1120 that is in sliding contact with a slide-pin 1111 that is attached to a slide-pin drive bracket 1113 that is attached to the rotatable workpiece carrier rotor 1105. The nominally-horizontal drive plate 1118 is attached to a hollow drive shaft 1108 having a rotation axis is supported by bearings that are supported by the stationary carrier housing 1110. The wafer substrate 1092 can also be a workpiece that is lapped or polished. Fluid pressure 1124 that is applied to the hollow drive shaft 1108 causes an abrading pressure 1128 to be applied to the workpiece rotor 1105 and is transmitted directly to the workpieces 1092 to force them against the moving abrasive-coated raised islands 1104.

The horizontal rotary platen 1094 that is attached to the rotary shaft 1100 that is supported by bearings 1099 that are supported by a machine base is typically held in a stationary position. Here, the wafer workpiece 1092 is brought into having abrading contact with the abrasive-coated raised islands 1104 by vertical motion of the workpiece abrading heads 1112 or by applying abrading pressure 1124 to the sealed chambers 1122 where the floating workpiece rotors 1105 are moved up vertically 1126 when the workpiece abrading heads 1112 are held in a stationary vertical position. Also, the horizontal rotary platen 1094 can be raised or lowered 1096 to position the wafer workpieces 1092 to be in abrading contact with the abrasive-coated raised islands 1104 when the workpiece abrading heads 1112 are held in a stationary vertical position.

Figure 44:
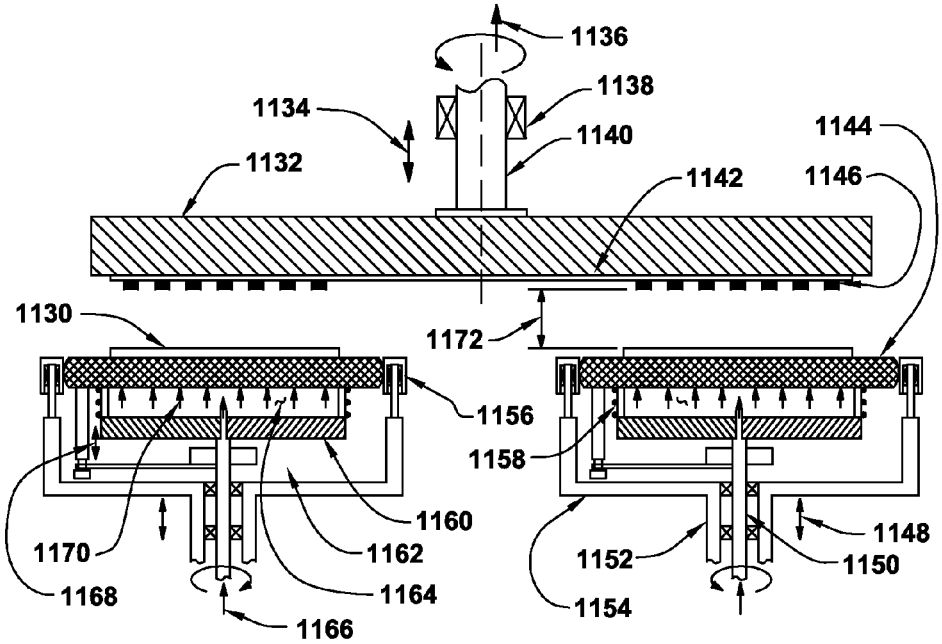
FIG. 44 is a cross section view of a platen with bottom lowered slide-pin abrading heads.

FIG. 44 is a cross section view of a platen with a bottom-side floating abrading heads with lowered floating abrading heads. A horizontal rotary platen 1132 is mounted where an abrasive disk 1142 is attached to the platen 1132 lower surface where the abrasive disk 1142 has an annular band of abrasive coated raised islands 1146 that are attached to the disk 1142 transparent or non-transparent backing which is attached to a flat-surfaced rotary platen 1132 with vacuum. 1136. The platen 1132 is attached to a rotary shaft 1140 that is supported by bearings 1138 that are supported by a machine base (not shown).

At least one workpiece abrading head 1154 is positioned below the horizontal rotary platen 1132 and are positioned around the circumference of the horizontal rotary platen 1132 where at least one circular-shaped wafer substrate 1130 having a wafer back-side flat surface and an abraded flat surface can be positioned to be in abrading contact with the abrasive-coated raised islands 1146. The wafer workpiece 1130 is attached to a rotatable workpiece rotor 1144 with vacuum where the rotatable workpiece rotor 1144 has a spherical-shaped outer periphery edge that contacts multiple idlers 1156 that are spaced around the circumference of the rotatable floating workpiece rotor 1144 to hold the stationary-position rotating workpiece rotor 1144 laterally to resist horizontal abrading forces that are applied to the wafer substrates 1130 by the moving abrasive disk 1142.

The workpiece abrading heads 1154 have a housing frame 1152 that can be raised or lowered in a vertical direction 1148 to position the wafer substrate 1130 to be in abrading contact with the abrasive-coated raised islands 1146 or to lower the wafer workpiece 1130 to separate it a distance 1172 from the abrasive-coated raised islands 1146. The workpiece abrading heads 1154 have a drive plate 1160 which is attached to a flexible annular wire-reinforced elastomeric tube 1116 or a flexible elastomeric annular rolling diaphragm 1116.

The workpiece abrading heads 1154 are rotationally driven by a slide-pin arm that is in sliding contact with a slide-pin that is attached to a slide-pin drive bracket that is attached to the rotatable workpiece carrier rotor. The nominally-horizontal drive plate 1160 is attached to a hollow drive shaft 1150 having a rotation axis is supported by bearings that are supported by the stationary carrier housing 1152. The wafer substrate 1130 can also be a workpiece that is lapped or polished. Fluid pressure 1166 that is applied to the hollow drive shaft 1150 can cause an abrading pressure 1170 to be applied to the workpiece rotor 1144 and is transmitted directly to the workpieces 1130 to force them against the moving abrasive-coated raised islands 1146.

The horizontal rotary platen 1132 that is attached to the rotary shaft 1140 that is supported by bearings 1138 that are supported by a machine base is typically held in a stationary position. Here, the wafer workpieces 1130 can be moved a distance 1172 from abrading contact with the abrasive-coated raised islands 1146 by vertical motion of the workpiece abrading heads 1154 or by reducing the abrading pressure 1166 in the sealed chambers 1164 where the floating workpiece rotors 1144 are moved down vertically 1168 a distance 1172 when the workpiece abrading heads 1154 are held in a stationary vertical position. Also, the horizontal rotary platen 1132 can be raised a distance 1134 to position the wafer workpieces 1130 to be moved from a distance 1172 from abrading contact with the abrasive-coated raised islands 1146 when the workpiece abrading heads 1154 are held in a stationary vertical position.

The abrading machine floating workpiece substrate carrier apparatus and processes to use it are described here. An abrading machine floating workpiece substrate carrier apparatus is described comprising:

a.) a workpiece substrate carrier frame moveable in a vertical direction that supports an attached rotatable workpiece carrier spindle having a hollow rotatable carrier drive shaft that has a vertical rotatable carrier drive shaft axis of rotation;

b) a rotatable drive housing having a rotatable drive housing rotation axis where the rotatable drive housing is attached to the rotatable carrier drive shaft wherein the rotatable drive housing rotation axis is coincident with the rotatable carrier drive shaft axis of rotation;

c) a rotatable flexible annular elastomeric tube device having an axial length, an annular top surface, an annular bottom surface and an axis of rotation that extends along the axial length wherein the elastomeric tube device annular bottom surface is moveable relative to the elastomeric tube device annular top surface;

d) a floating circular rotatable workpiece carrier plate having a workpiece carrier plate top surface, an opposed nominally-horizontal workpiece carrier plate flat bottom surface, a workpiece carrier plate rotation axis that is nominally-perpendicular to the workpiece carrier plate flat bottom surface and a workpiece carrier plate outer periphery annular surface located between the workpiece carrier plate top and bottom surfaces;

e) wherein the rotatable annular elastomeric tube device annular top surface is attached to the rotatable drive housing and the elastomeric tube device annular bottom surface is attached to the workpiece carrier plate top surface wherein the elastomeric tube device axis of rotation is nominally-coincident with the vertical rotatable carrier drive shaft axis of rotation;

f) a rotatable drive housing bracket that is attached to the rotatable drive housing and a workpiece carrier plate bracket that is attached to the workpiece carrier plate wherein the rotatable drive housing bracket and the workpiece carrier plate bracket are in vertical and horizontal sliding contact with each other at a bracket sliding joint and wherein the rotary drive housing bracket can be rotated by the rotatable drive housing to transmit torque, measured about the rotatable drive housing rotation axis, through the bracket sliding joint to the workpiece carrier plate bracket to provide rotation of the workpiece carrier plate about the workpiece carrier plate rotation axis, and wherein the workpiece carrier plate is movable vertically in a direction along the workpiece carrier plate rotation axis, and wherein the workpiece carrier plate is movable horizontally in a direction perpendicular to the workpiece carrier plate rotation axis;

g) at least two rotatable idlers having rotation axes wherein the rotatable idlers have outer periphery cylindrical or spherical surfaces that are rotatable about the rotatable idlers rotation axes;

h) wherein the at least two rotatable idlers are attached to the movable workpiece substrate carrier frame wherein the at least two rotatable idlers' rotation axes are nominally parallel to the vertical rotatable carrier drive shaft axis of rotation and wherein the at least two respective rotatable idler's outer periphery cylindrical or spherical surfaces are in contact with the floating circular workpiece carrier plate outer periphery annular surface, wherein the at least two rotatable idlers maintain the floating circular workpiece carrier plate rotation axis to be nominally concentric with the carrier drive shaft axis of rotation;

i) wherein the floating circular workpiece carrier plate is moveable relative to the movable workpiece substrate carrier frame in a nominally-vertical direction along the floating circular workpiece carrier plate rotation axis wherein the at least two respective rotatable idler's outer periphery cylindrical surfaces are in vertical sliding contact with the floating circular workpiece carrier plate outer periphery annular surface;

j) wherein at least one workpiece having opposed workpiece top and bottom surfaces is attached to the workpiece carrier plate flat bottom surface;

k) a rotatable abrading platen having a flat abrasive coated abrading surface that is nominally horizontal.

In another embodiment, the apparatus elastomeric tube device annular top surface that is attached to the rotatable drive housing and the elastomeric tube device annular bottom surface that is attached to the workpiece carrier plate top surface form a sealed enclosed elastomeric tube-device pressure chamber having an internal volume contained by the elastomeric tube-device, the rotatable drive housing and the workpiece carrier plate top surface. Also, controlled-pressure air or controlled-pressure fluid or controlled-pressure vacuum is accessible into the sealed enclosed elastomeric tube device pressure chamber through an air, fluid or vacuum passageway connecting an air, fluid or vacuum passageway in the hollow rotatable carrier drive shaft to the enclosed elastomeric tube device pressure chamber and wherein the pressure or vacuum present in the enclosed elastomeric tube device pressure chamber can move the workpiece carrier plate vertically.

Further, the workpiece carrier plate top surface is configured so that controlled vacuum applied to the sealed enclosed elastomeric tube device pressure chamber generates a lifting force on the workpiece carrier plate capable of moving the workpiece carrier plate toward the rotatable drive housing thereby compressing the rotatable elastomeric tube device in a direction along the elastomeric tube device axis of rotation wherein the workpiece carrier plate is moved vertically away from the rotatable abrading platen abrading surface.

In addition, the flexible annular elastomeric tube device is constructed from or mold-formed from impervious flexible materials comprising silicone rubber, room temperature vulcanizing (RTV) silicone rubber, natural rubber, synthetic rubber, thermoset polyurethane, thermoplastic polyurethane, flexible polymers, composite materials, polymer-impregnated woven cloths, sealed fiber materials, laminated sheets of combinations of these materials and sheets of these materials. Also, the flexible annular elastomeric tube device is a bellows-type annular-pleated elastomeric tube. And, the flexible annular elastomeric tube device is reinforced with rigid or semi-rigid annular hoop devices that are attached to selected individual annular-pleated portions of the bellows-type annular-pleated elastomeric tube.

In another embodiment, the rotatable drive housing bracket and the workpiece carrier plate bracket act together with mutual sliding contact to rotate the workpiece carrier in both clockwise and counterclockwise directions and to rotationally accelerate and decelerate the workpiece carrier and wherein the rotatable drive housing bracket and the workpiece carrier plate bracket act together to prevent rotation of the workpiece carrier plate relative to the rotatable drive housing.

Further, the rotatable drive housing has an attached rotatable drive housing vertical excursion-stop device and an attached rotatable drive housing horizontal excursion-stop device, and wherein the floating circular rotatable workpiece carrier plate has an attached floating circular rotatable workpiece carrier plate vertical excursion-stop device and an attached floating circular rotatable workpiece carrier plate horizontal excursion-stop device wherein the horizontal and vertical movement distance of the floating circular rotatable workpiece carrier plate is controlled and limited by contacting of the rotatable drive housing vertical excursion-stop device with the floating circular rotatable workpiece carrier plate vertical excursion-stop device and by contacting of the rotatable drive housing horizontal excursion-stop device with the floating circular rotatable workpiece carrier plate horizontal excursion-stop device.

In addition, a rotatable stationary vacuum, air or fluid rotary union is attached to the hollow carrier drive shaft which supplies vacuum or pressurized fluid to a hollow carrier drive shaft fluid passageway that is connected to a hollow flexible fluid tube that is routed to fluid passageways connected to vacuum or fluid port holes in the workpiece carrier plate flat bottom surface. Also, a rotatable stationary vacuum, air or fluid rotary union supplies pressurized fluid or vacuum to a hollow carrier drive shaft fluid passageway in the hollow carrier drive shaft that is routed to the sealed elastomeric tube device pressure chamber.

In another embodiment, vacuum is supplied to the hollow flexible fluid tube that is routed to fluid passageways connected to vacuum or fluid port holes in the workpiece carrier plate flat bottom surface wherein the vacuum attaches at least one workpiece to the workpiece carrier plate flat bottom surface. Also, pressurized fluid is supplied to the sealed elastomeric tube device pressure chamber and wherein the applied pressure acts on the workpiece carrier plate top surface which creates an abrading force that is transmitted through the workpiece carrier plate thickness wherein this abrading force is transmitted to at least one workpiece that is attached to the workpiece carrier plate which forces the at least one workpiece into flat-surfaced abrading contact with the rotatable abrading platen abrading surface.

Further, a process is described where vacuum is applied to the sealed enclosed elastomeric tube device pressure chamber wherein the vacuum generates a vacuum lifting force on the workpiece carrier plate wherein the vacuum lifting force forces the workpiece carrier plate top surface in rigid contact against a rotatable drive housing vertical excursion-stop device that is attached to the rotatable drive housing and wherein the workpiece substrate carrier frame and the attached workpiece carrier spindle are moved vertically to a position wherein a workpiece that is attached to the workpiece carrier plate flat bottom surface is in abrading contact with the rotatable abrading platen abrading surface.

In addition, central portions of the floating circular rotatable workpiece carrier plate workpiece carrier plate are flexible in a vertical direction and wherein the workpiece carrier plate outer periphery annular surface is substantially rigid in a horizontal direction, wherein portions of the workpiece carrier plate flat bottom surface can be distorted out-of-plane by the controlled-pressure air or controlled-pressure fluid or controlled-pressure vacuum present in the sealed enclosed elastomeric tube device pressure chamber which acts on the workpiece carrier plate top surface.

Also, multiple rotatable elastomeric tube devices are positioned concentric with respect to each other to form independent annular or circular rotatable elastomeric tube devices' sealed enclosed elastomeric tube device pressure chambers wherein independent sealed enclosed elastomeric tube device pressure chambers are formed between adjacent sealed enclosed elastomeric tube device pressure chambers, wherein each independent sealed rotatable elastomeric tube device sealed enclosed pressure chamber has an independent controlled-pressure air or controlled-pressure fluid source to provide independent controlled-pressure air or controlled-pressure fluid pressures to the respective rotatable elastomeric tube device's sealed enclosed pressure chambers, wherein the flexible workpiece carrier plate bottom surface can assume non-flat shapes at the location of each independent rotatable elastomeric tube device's sealed enclosed pressure chamber and the respective rotatable elastomeric tube device's sealed enclosed pressure chambers apply independently controlled abrading pressures to the portions of the at least one workpiece abraded surface that is positioned on the flexible workpiece carrier plate at the respective rotatable elastomeric tube device's sealed enclosed pressure chambers when the at least one workpiece abraded surface is in abrading contact with the rotatable abrading platen abrading surface.

Further, the floating workpiece carrier plate outer diameter outer periphery surface has a spherical shape. And also, the stationary vacuum and fluid rotary union that is attached to the hollow rotatable carrier drive shaft is a friction-free air-bearing rotary union. In addition, vacuum supplied to the sealed enclosed elastomeric tube device pressure chamber which generates a lifting force on the workpiece carrier plate that is capable of moving the workpiece carrier plate toward the rotatable drive housing is provided by a vacuum surge tank having a substantial tank volume wherein the at least one workpiece that is attached to the workpiece carrier plate is moved rapidly away from abrading contact with the rotatable abrading platen abrading surface.

In another embodiment, a process is described of providing abrading workpieces using an abrading machine floating workpiece substrate carrier apparatus comprising:

a.) providing a workpiece substrate carrier frame moveable in a vertical direction that supports an attached rotatable workpiece carrier spindle having a hollow rotatable carrier drive shaft that has a vertical rotatable carrier drive shaft axis of rotation;

b) providing a rotatable drive housing having a rotatable drive housing rotation axis and attaching the rotatable drive housing to the rotatable carrier drive shaft wherein the rotatable drive housing rotation axis is coincident with the rotatable carrier drive shaft axis of rotation;

c) providing a rotatable flexible annular elastomeric tube device having an axial length, an annular top surface, an annular bottom surface and an axis of rotation that extends along the axial length wherein the elastomeric tube device annular bottom surface is moveable relative to the elastomeric tube device annular top surface;

d) providing a floating circular rotatable workpiece carrier plate having a workpiece carrier plate top surface, an opposed nominally-horizontal workpiece carrier plate flat bottom surface, a workpiece carrier plate rotation axis that is nominally-perpendicular to the workpiece carrier plate flat bottom surface and a workpiece carrier plate outer periphery annular surface located between the workpiece carrier plate top and bottom surfaces;

e) attaching the rotatable annular elastomeric tube device annular top surface to the rotatable drive housing and attaching the elastomeric tube device annular bottom surface to the workpiece carrier plate top surface wherein the elastomeric tube device axis of rotation is nominally-coincident with the vertical rotatable carrier drive shaft axis of rotation;

f) providing a rotatable drive housing bracket and attaching it to the rotatable drive housing and providing a workpiece carrier plate bracket and attaching it to the workpiece carrier plate wherein the rotatable drive housing bracket and the workpiece carrier plate bracket are in vertical and horizontal sliding contact with each other at a bracket sliding joint and wherein the rotary drive housing bracket can be rotated by the rotatable drive housing to transmit torque, measured about the rotatable drive housing rotation axis, through the bracket sliding joint to the workpiece carrier plate bracket to provide rotation of the workpiece carrier plate about the workpiece carrier plate rotation axis, and wherein the workpiece carrier plate is movable vertically in a direction along the workpiece carrier plate rotation axis, and wherein the workpiece carrier plate is movable horizontally in a direction perpendicular to the workpiece carrier plate rotation axis;

g) providing at least two rotatable idlers having rotation axes wherein the rotatable idlers have outer periphery cylindrical or spherical surfaces that are rotatable about the rotatable idlers rotation axes;

h) attaching the at least two rotatable idlers to the movable workpiece substrate carrier frame wherein the at least two rotatable idlers' rotation axes are nominally parallel to the vertical rotatable carrier drive shaft axis of rotation and wherein the at least two respective rotatable idler's outer periphery cylindrical or spherical surfaces are in contact with the floating circular workpiece carrier plate outer periphery annular surface, wherein the at least two rotatable idlers maintain the floating circular workpiece carrier plate rotation axis to be nominally concentric with the carrier drive shaft axis of rotation;

i) providing that the floating circular workpiece carrier plate is moveable relative to the movable workpiece substrate carrier frame in a nominally-vertical direction along the floating circular workpiece carrier plate rotation axis wherein the at least two respective rotatable idler's outer periphery cylindrical surfaces are in vertical sliding contact with the floating circular workpiece carrier plate outer periphery annular surface;

j) attaching at least one workpiece having opposed workpiece top and bottom surfaces to the workpiece carrier plate flat bottom surface;

k) providing a rotatable abrading platen having a flat abrasive coated abrading surface that is nominally horizontal.

l) moving the workpiece substrate carrier frame and the attached workpiece carrier spindle vertically to position the flat workpiece bottom surface of at least one workpiece that is attached to the workpiece carrier plate flat bottom surface close to flat-surfaced abrading contact with the rotatable abrading platen abrading surface after which the movable workpiece substrate carrier frame and the workpiece carrier spindle are held stationary at that position and wherein the workpiece carrier plate is moved in a vertical direction relative to the stationary workpiece substrate carrier frame by adjusting the pressure in the sealed enclosed elastomeric tube device pressure chamber wherein the at least one workpiece bottom surface is positioned in flat-surfaced abrading contact with the rotatable abrading platen abrading surface.

What is claimed:

1. A rotating platen abrasive lapping and polishing apparatus having a floating workpiece substrate carrier apparatus comprising:

a.) a workpiece substrate carrier frame moveable in a vertical direction that supports an attached rotatable workpiece carrier spindle having a hollow rotatable carrier drive shaft that has a vertical rotatable carrier drive shaft axis of rotation;

b) a rotatable drive housing having a rotatable drive housing rotation axis where the rotatable drive housing is attached to the rotatable carrier drive shaft wherein the rotatable drive housing rotation axis is coincident with the rotatable carrier drive shaft axis of rotation;

c) a rotatable flexible annular elastomeric tube device having an axial length, an annular top surface, an annular bottom surface and an axis of rotation that extends along the axial length wherein the elastomeric tube device annular bottom surface is moveable relative to the elastomeric tube device annular top surface;

d) a floating circular rotatable workpiece carrier plate having a workpiece carrier plate top surface, an opposed nominally-horizontal workpiece carrier plate flat bottom surface, a workpiece carrier plate rotation axis that is nominally-perpendicular to the workpiece carrier plate flat bottom surface and a workpiece carrier plate outer periphery annular surface located between the workpiece carrier plate top and bottom surfaces;

e) wherein the rotatable annular elastomeric tube device annular top surface is attached to the rotatable drive housing and the elastomeric tube device annular bottom surface is attached to the workpiece carrier plate top surface wherein the elastomeric tube device axis of rotation is nominally-coincident with the vertical rotatable carrier drive shaft axis of rotation;

f) a rotatable drive housing bracket that is attached to the rotatable drive housing and a workpiece carrier plate bracket that is attached to the workpiece carrier plate wherein the rotatable drive housing bracket and the workpiece carrier plate bracket are in vertical and horizontal sliding contact with each other at a bracket sliding joint and wherein the rotary drive housing bracket can be rotated by the rotatable drive housing to transmit torque, measured about the rotatable drive housing rotation axis, through the bracket sliding joint to the workpiece carrier plate bracket to provide rotation of the workpiece carrier plate about the workpiece carrier plate rotation axis, and wherein the workpiece carrier plate is movable vertically in a direction along the workpiece carrier plate rotation axis, and wherein the workpiece carrier plate is movable horizontally in a direction perpendicular to the workpiece carrier plate rotation axis;

g) at least two rotatable idlers having rotation axes wherein the rotatable idlers have outer periphery cylindrical or spherical surfaces that are rotatable about the rotatable idlers rotation axes;

h) wherein the at least two rotatable idlers are attached to the movable workpiece substrate carrier frame wherein the at least two rotatable idlers' rotation axes are nominally parallel to the vertical rotatable carrier drive shaft axis of rotation and wherein the at least two respective rotatable idler's outer periphery cylindrical or spherical surfaces are in contact with the floating circular workpiece carrier plate outer periphery annular surface, wherein the at least two rotatable idlers maintain the floating circular workpiece carrier plate rotation axis to be nominally concentric with the carrier drive shaft axis of rotation;

i) wherein the floating circular workpiece carrier plate is moveable relative to the movable workpiece substrate carrier frame in a nominally-vertical direction along the floating circular workpiece carrier plate rotation axis wherein the at least two respective rotatable idler's outer periphery cylindrical surfaces are in vertical sliding contact with the floating circular workpiece carrier plate outer periphery annular surface;

j) wherein at least one workpiece having opposed workpiece top and bottom surfaces is attached to the workpiece carrier plate flat bottom surface; and k) a rotatable abrading platen having a flat abrasive coated abrading surface that is nominally horizontal.

2. The apparatus of claim 1 where the elastomeric tube device annular top surface that is attached to the rotatable drive housing and the elastomeric tube device annular bottom surface that is attached to the workpiece carrier plate top surface form a sealed enclosed elastomeric tube-device pressure chamber having an internal volume contained by the elastomeric tube-device, the rotatable drive housing and the workpiece carrier plate top surface.

3. The apparatus of claim 2 wherein controlled-pressure air or controlled-pressure fluid or controlled-pressure vacuum is accessible into the sealed enclosed elastomeric tube device pressure chamber through an air, fluid or vacuum passageway connecting an air, fluid or vacuum passageway in the hollow rotatable carrier drive shaft to the enclosed elastomeric tube device pressure chamber and wherein the pressure or vacuum present in the enclosed elastomeric tube device pressure chamber can move the workpiece carrier plate vertically.

4. The apparatus of claim 3 wherein the workpiece carrier plate top surface is configured so that controlled vacuum applied to the sealed enclosed elastomeric tube device pressure chamber generates a lifting force on the workpiece carrier plate capable of moving the workpiece carrier plate toward the rotatable drive housing thereby compressing the rotatable elastomeric tube device in a direction along the elastomeric tube device axis of rotation wherein the workpiece carrier plate is moved vertically away from the rotatable abrading platen abrading surface.

5. The apparatus of claim 1 wherein the flexible annular elastomeric tube device is constructed from or mold-formed from impervious flexible materials comprising silicone rubber, room temperature vulcanizing (RTV) silicone rubber, natural rubber, synthetic rubber, thermoset polyurethane, thermoplastic polyurethane, flexible polymers, composite materials, polymer-impregnated woven cloths, sealed fiber materials, laminated sheets of combinations of these materials and sheets of these materials.

6. The apparatus of claim 5 wherein the flexible annular elastomeric tube device is a bellows-type annular-pleated elastomeric tube.

7. The apparatus of claim 6 wherein the flexible annular elastomeric tube device is reinforced with rigid or semi-rigid annular hoop devices that are attached to selected individual annular-pleated portions of the bellows-type annular-pleated elastomeric tube.

8. The apparatus of claim 1 wherein the rotatable drive housing bracket and the workpiece carrier plate bracket act together with mutual sliding contact to rotate the workpiece carrier in both clockwise and counterclockwise directions and to rotationally accelerate and decelerate the workpiece carrier and wherein the rotatable drive housing bracket and the workpiece carrier plate bracket act together to prevent rotation of the workpiece carrier plate relative to the rotatable drive housing.

9. The apparatus of claim 1 wherein the rotatable drive housing has an attached rotatable drive housing vertical excursion-stop device and an attached rotatable drive housing horizontal excursion-stop device, and wherein the floating circular rotatable workpiece carrier plate has an attached floating circular rotatable workpiece carrier plate vertical excursion-stop device and an attached floating circular rotatable workpiece carrier plate horizontal excursion-stop device wherein the horizontal and vertical movement distance of the floating circular rotatable workpiece carrier plate is controlled and limited by contacting of the rotatable drive housing vertical excursion-stop device with the floating circular rotatable workpiece carrier plate vertical excursion-stop device and by contacting of the rotatable drive housing horizontal excursion-stop device with the floating circular rotatable workpiece carrier plate horizontal excursion-stop device.

10. The apparatus of claim 1 wherein a rotatable stationary vacuum, air or fluid rotary union is attached to the hollow carrier drive shaft which supplies vacuum or pressurized fluid to a hollow carrier drive shaft fluid passageway that is connected to a hollow flexible fluid tube that is routed to fluid passageways connected to vacuum or fluid port holes in the workpiece carrier plate flat bottom surface.

11. The apparatus of claim 3 wherein a rotatable stationary vacuum, air or fluid rotary union supplies pressurized fluid or vacuum to a hollow carrier drive shaft fluid passageway in the hollow carrier drive shaft that is routed to the sealed elastomeric tube device pressure chamber.

12. A process for using the apparatus of claim 10 to polish a surface by rotating the rotatable abrading platen having a flat abrasive coated abrading surface against a workpiece wherein vacuum is supplied to the hollow flexible fluid tube that is routed to fluid passageways connected to vacuum or fluid port holes in the workpiece carrier plate flat bottom surface wherein the vacuum attaches at least one workpiece to the workpiece carrier plate flat bottom surface.

13. A process for the apparatus of claim 11 wherein pressurized fluid is supplied to the sealed elastomeric tube device pressure chamber and wherein the applied pressure acts on the workpiece carrier plate top surface which creates an abrading force that is transmitted through the workpiece carrier plate thickness wherein this abrading force is transmitted to at least one workpiece that is attached to the workpiece carrier plate which forces the at least one workpiece into flat-surfaced abrading contact with the rotatable abrading platen abrading surface.

14. A process for using the apparatus of claim 3 to polish a surface by rotating the rotatable abrading platen having a flat abrasive coated abrading surface against a workpiece wherein vacuum is applied to the sealed enclosed elastomeric tube device pressure chamber wherein the vacuum generates a vacuum lifting force on the workpiece carrier plate wherein the vacuum lifting force forces the workpiece carrier plate top surface in rigid contact against a rotatable drive housing vertical excursion-stop device that is attached to the rotatable drive housing and wherein the workpiece substrate carrier frame and the attached workpiece carrier spindle are moved vertically to a position wherein a workpiece that is attached to the workpiece carrier plate flat bottom surface is in abrading contact with the rotatable abrading platen abrading surface.

15. The apparatus of claim 3 wherein central portions of the floating circular rotatable workpiece carrier plate workpiece carrier plate are flexible in a vertical direction and wherein the workpiece carrier plate outer periphery annular surface is substantially rigid in a horizontal direction, wherein portions of the workpiece carrier plate flat bottom surface can be distorted out-of-plane by the controlled-pressure air or controlled-pressure fluid or controlled-pressure vacuum present in the sealed enclosed elastomeric tube device pressure chamber which acts on the workpiece carrier plate top surface.

16. The apparatus of claim 15 wherein multiple rotatable elastomeric tube devices are positioned concentric with respect to each other to form independent annular or circular rotatable elastomeric tube devices' sealed enclosed elastomeric tube device pressure chambers wherein independent sealed enclosed elastomeric tube device pressure chambers are formed between adjacent sealed enclosed elastomeric tube device pressure chambers, wherein each independent sealed rotatable elastomeric tube device sealed enclosed pressure chamber has an independent controlled-pressure air or controlled-pressure fluid source to provide independent controlled-pressure air or controlled-pressure fluid pressures to the respective rotatable elastomeric tube device's sealed enclosed pressure chambers, wherein the flexible workpiece carrier plate bottom surface can assume non-flat shapes at the location of each independent rotatable elastomeric tube device's sealed enclosed pressure chamber and the respective rotatable elastomeric tube device's sealed enclosed pressure chambers apply independently controlled abrading pressures to the portions of the at least one workpiece abraded surface that is positioned on the flexible workpiece carrier plate at the respective rotatable elastomeric tube device's sealed enclosed pressure chambers when the at least one workpiece abraded surface is in abrading contact with the rotatable abrading platen abrading surface.

17. The apparatus of claim 1 wherein the floating workpiece carrier plate outer diameter outer periphery surface has a spherical shape.

18. The apparatus of claim 11 wherein the stationary vacuum and fluid rotary union that is attached to the hollow rotatable carrier drive shaft is a friction-free air-bearing rotary union.

19. The apparatus of claim 4 wherein vacuum supplied to the sealed enclosed elastomeric tube device pressure chamber which generates a lifting force on the workpiece carrier plate that is capable of moving the workpiece carrier plate toward the rotatable drive housing is provided by a vacuum surge tank having a substantial tank volume wherein the at least one workpiece that is attached to the workpiece carrier plate is moved rapidly away from abrading contact with the rotatable abrading platen abrading surface.

20. A process of providing abrading workpieces using an abrading machine floating workpiece substrate carrier apparatus comprising:

a.) providing a workpiece substrate carrier frame moveable in a vertical direction that supports an attached rotatable workpiece carrier spindle having a hollow rotatable carrier drive shaft that has a vertical rotatable carrier drive shaft axis of rotation;

b) providing a rotatable drive housing having a rotatable drive housing rotation axis and attaching the rotatable drive housing to the rotatable carrier drive shaft wherein the rotatable drive housing rotation axis is coincident with the rotatable carrier drive shaft axis of rotation;

c) providing a rotatable flexible annular elastomeric tube device having an axial length, an annular top surface, an annular bottom surface and an axis of rotation that extends along the axial length wherein the elastomeric tube device annular bottom surface is moveable relative to the elastomeric tube device annular top surface;

d) providing a floating circular rotatable workpiece carrier plate having a workpiece carrier plate top surface, an opposed nominally-horizontal workpiece carrier plate flat bottom surface, a workpiece carrier plate rotation axis that is nominally-perpendicular to the workpiece carrier plate flat bottom surface and a workpiece carrier plate outer periphery annular surface located between the workpiece carrier plate top and bottom surfaces;

e) attaching the rotatable annular elastomeric tube device annular top surface to the rotatable drive housing and attaching the elastomeric tube device annular bottom surface to the workpiece carrier plate top surface wherein the elastomeric tube device axis of rotation is nominally-coincident with the vertical rotatable carrier drive shaft axis of rotation;

f) providing a rotatable drive housing bracket and attaching it to the rotatable drive housing and providing a workpiece carrier plate bracket and attaching it to the workpiece carrier plate wherein the rotatable drive housing bracket and the workpiece carrier plate bracket are in vertical and horizontal sliding contact with each other at a bracket sliding joint and wherein the rotary drive housing bracket can be rotated by the rotatable drive housing to transmit torque, measured about the rotatable drive housing rotation axis, through the bracket sliding joint to the workpiece carrier plate bracket to provide rotation of the workpiece carrier plate about the workpiece carrier plate rotation axis, and wherein the workpiece carrier plate is movable vertically in a direction along the workpiece carrier plate rotation axis, and wherein the workpiece carrier plate is movable horizontally in a direction perpendicular to the workpiece carrier plate rotation axis;

g) providing at least two rotatable idlers having rotation axes wherein the rotatable idlers have outer periphery cylindrical or spherical surfaces that are rotatable about the rotatable idlers rotation axes;

h) attaching the at least two rotatable idlers to the movable workpiece substrate carrier frame wherein the at least two rotatable idlers' rotation axes are nominally parallel to the vertical rotatable carrier drive shaft axis of rotation and wherein the at least two respective rotatable idler's outer periphery cylindrical or spherical surfaces are in contact with the floating circular workpiece carrier plate outer periphery annular surface, wherein the at least two rotatable idlers maintain the floating circular workpiece carrier plate rotation axis to be nominally concentric with the carrier drive shaft axis of rotation;

i) providing that the floating circular workpiece carrier plate is moveable relative to the movable workpiece substrate carrier frame in a nominally-vertical direction along the floating circular workpiece carrier plate rotation axis wherein the at least two respective rotatable idler's outer periphery cylindrical surfaces are in vertical sliding contact with the floating circular workpiece carrier plate outer periphery annular surface;

j) attaching at least one workpiece having opposed workpiece top and bottom surfaces to the workpiece carrier plate flat bottom surface;

k) providing a rotatable abrading platen having a flat abrasive coated abrading surface that is nominally horizontal.

l) moving the workpiece substrate carrier frame and the attached workpiece carrier spindle vertically to position the flat workpiece bottom surface of at least one workpiece that is attached to the workpiece carrier plate flat bottom surface close to flat-surfaced abrading contact with the rotatable abrading platen abrading surface after which the movable workpiece substrate carrier frame and the workpiece carrier spindle are held stationary at that position and wherein the workpiece carrier plate is moved in a vertical direction relative to the stationary workpiece substrate carrier frame by adjusting the pressure in the sealed enclosed elastomeric tube device pressure chamber wherein the at least one workpiece bottom surface is positioned in flat-surfaced abrading contact with the rotatable abrading platen abrading surface.

21. The apparatus of claim 1 wherein a bearing is attached to either the rotatable drive housing bracket or the workpiece carrier bracket wherein the bearing provides rolling contact between the rotatable drive housing bracket and the workpiece carrier bracket.

* * * * *